US007620348B2

(12) United States Patent
Okamoto et al.

(10) Patent No.: US 7,620,348 B2
(45) Date of Patent: Nov. 17, 2009

(54) CONTAINER FOR DEVELOPING AGENT, AND IMAGE FORMING APPARATUS INCORPORATING THE SAME

(75) Inventors: Katsumi Okamoto, Azumino (JP); Hiroshi Kato, Okaya (JP); Takami Naruta, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 255 days.

(21) Appl. No.: 11/611,033

(22) Filed: Dec. 14, 2006

(65) Prior Publication Data

US 2008/0031658 A1 Feb. 7, 2008

(30) Foreign Application Priority Data

| | | |
|---|---|---|
| Dec. 15, 2005 | (JP) | P2005-361446 |
| Dec. 15, 2005 | (JP) | P2005-361447 |
| Dec. 15, 2005 | (JP) | P2005-361448 |
| Dec. 15, 2005 | (JP) | P2005-361449 |
| Dec. 15, 2005 | (JP) | P2005-361450 |

(51) Int. Cl.
*G03G 15/08* (2006.01)

(52) U.S. Cl. ..... 399/258; 399/262

(58) Field of Classification Search ..... 222/DIG. 1; 399/258, 260, 262
See application file for complete search history.

(56) References Cited

U.S. PATENT DOCUMENTS

| | | | | |
|---|---|---|---|---|
| 5,313,993 | A * | 5/1994 | Corby et al. | 141/364 |
| 2005/0089347 | A1 * | 4/2005 | Muramatsu et al. | 399/262 |

FOREIGN PATENT DOCUMENTS

| | | |
|---|---|---|
| JP | 4-30605 | 7/1992 |
| JP | 4-76112 | 12/1992 |
| JP | 3570714 | 7/2004 |

* cited by examiner

*Primary Examiner*—Hoang Ngo
(74) *Attorney, Agent, or Firm*—Hogan & Hartson LLP

(57) ABSTRACT

In a container is adapted to be coupled with another container, a first wall member defines a first storage space adapted to store developing agent for forming an image on a recording medium. A first coupler is adapted to be coupled with a second coupler provided with the first another container. A first communicator is operable to communicate the first storage space with a second storage space provided with the first another container by way of the first coupler and the second coupler, when the container is coupled with another container.

19 Claims, 39 Drawing Sheets

CONTAINER FOR DEVELOPING AGENT, AND IMAGE FORMING APPARATUS INCORPORATING THE SAME

BACKGROUND

1. Technical Field

The present invention relates to a developing agent container and an image forming apparatus, and more specifically, to a developing agent container and an image forming apparatus capable of realizing the replenishment work of developing agent with no concern for leakage of the developing agent, instead of the work of replacing a developing agent container while paying careful attention so that the developing agent may not leak.

2. Related Art

An image forming apparatus using an electrophotographic recording method that exposes an electrostatic latent image on the basis of image data to form a toner image on the surface of an image carrier fabricated of a photoconductive material is known conventionally. In this image forming apparatus, a developing device (process unit) performs toner development of making toner (developing agent) adhere to the electrostatic latent image on the surface of the image carrier to develop the image, and then transfers the toner image to a recording medium, such as recording paper, to form an image.

In this type of image forming apparatus, the toner to develop the electrostatic latent image on the surface of the image carrier is reserved within the body of the apparatus so that it can be supplied to a developing device, and this toner is consumed whenever images are formed on recording paper, etc. Therefore, a method of replenishing toner to a hopper that reserves the toner to reserve the toner is adopted (for example, refer to Japanese Utility Model Publication No. 4-30605U and Japanese Patent Publication No. 4-76112B), and a method of replacing a container for reserving toner to replenish the toner is adopted (for example, refer to Japanese Patent No. 3570714).

Here, since the toner is fine powder, if the toner falls or leaks during replacement of a container, and then floats in the shape of smoke, it may be stuck on surroundings, polluting them, and the cleaning thereof becomes troublesome. For this reason, various studies have been made so that toner may not leak during replenishment of toner or replacement of a container (for example, refer to Japanese Utility Model Publication No. 4-30605U and Japanese Patent Publication No. 4-76112B). Further, a method of reducing the volume of a toner container to be replaced, facilitating handling of the container, is performed (for example, refer to Japanese Patent No. 3570714).

However, the developing agent containers as described in the above publications requires various kinds of work, such as the work of removing the container from the apparatus body side, and the work of connecting a new container to the apparatus body side, which are troublesome. Further, when the developing agent container is connected to the apparatus body side among the above kinds of work, multi-stage actions, such as fitting or twisting the container are needed, and even when the container is removed, multi-stage actions, such as fitting or twisting the container are needed. This is troublesome.

Moreover, in such developing agent containers, various studies that prevent toner from leaking out during replenishment work of toner have been made. However, since toner may leak out from the developing agent container removed from the apparatus body side and may pollute an operator and its surroundings, the operator should perform the work while paying careful attention so that the toner may not leak out, which is troublesome.

Further, among developing agent containers other than those described in the above publications, there is a developing agent containers of a type that is mounted to the apparatus body side after a toner replenishing port is opened.

In this type of developing agent container, careful attention is required so that toner may not leak out during mounting of a toner container to the apparatus body side. Also, since toner has adhered to a sealing film removed to open the toner replenishing port, careful attention should be paid so as to prevent toner from adhering to surroundings and polluting them, even in the disposal of the container. This is troublesome.

SUMMARY

It is therefore one advantageous aspect of the invention to provide a developing agent container and an image forming apparatus that make it possible to easily perform the replenishment work of toner and is easy to handle.

According to one aspect of the invention, there is provided a container, adapted to be coupled with first another container, the container comprising:

a first wall member, defining a first storage space adapted to store developing agent for forming an image on a recording medium;

a first coupler, adapted to be coupled with a second coupler provided with the first another container; and a first communicator, operable to communicate the first storage space with a second storage space provided with the first another container by way of the first coupler and the second coupler, when the container is coupled with the first another container.

The container may be adapted to be coupled with an image forming apparatus. The first coupler may be adapted to be coupled with a third coupler provided with the image forming apparatus. The first communicator may be operable to communicate the first storage with the image forming apparatus to supply the developing agent from the container to the image forming apparatus.

The first communicator may include a film member, sealing the first coupler and adapted to be cut by a cutter provided with the third coupler when the first coupler is coupled with the third coupler.

The first communicator may include a first traction member adapted to engage with a second traction member provided with the third coupler when the first coupler is coupled with the third coupler, thereby pulling the film member in a direction away from the cutter.

The container may be adapted to be coupled with a second another container, and may further comprise a third coupler, adapted to be coupled with a fourth coupler provided with the second another container; and a second communicator, operable to communicate the first storage space with a third storage space provided with the second another container by way of the third coupler and the fourth coupler, when the container is coupled with the second another container.

The first wall member may be deformable so that a volume of the first storage space is variable. The first coupler and the third coupler may be engageable with each other when the volume of the first storage space is reduced.

The first communicator may include: a first film member, sealing the first coupler; and a first cutter operable to cut the first film member when the first coupler is coupled with the second coupler. The second communicator may include a second film member, sealing the third coupler and adapted to be cut by a second cutter provided with the fourth coupler when the third coupler is coupled with the fourth coupler.

The first communicator may include a first traction member adapted to engage with a second traction member provided with the second coupler when the first coupler is coupled with the second coupler, thereby pulling the first film cut by the first cutter in a direction away from the first cutter. The second communicator may include a third traction member adapted to engage with a fourth traction member provided with the fourth coupler when the third coupler is coupled with the fourth coupler, thereby pulling the second film cut by the second cutter in a direction away from the second cutter.

The first cutter may include: a needle portion adapted to first come in contact with the first film member; and a blade portion extending along an inner periphery of the first coupler, and adapted to come in contact with the first film member subsequent to the needle portion.

The container may further comprise a first retainer, provided on the first coupler and adapted to engage with a second retainer provided on the second coupler when the first coupler is coupled with the second coupler, thereby retaining the coupled state of the first coupler and the second coupler.

At least one of a size and a shape of the first retainer may be uniquely indicative of a type of the developing agent stored in the first storage space.

The first wall member may be deformable so that a volume of the first storage space is variable.

The first wall member may be flexible.

The container may further comprise a first hanging member, provided on the first wall member and adapted to engage with a second hanging member provided with an image forming apparatus, thereby hanging up the first wall member.

The container may further comprise a casing member, surrounding the first wall member and having a larger stiffness than the first wall member.

The casing member may be removably coupled with the first coupler.

The first wall member may include a bellows section.

The first communicator may include a cutter operable to cut a part of the first wall member when the first coupler is coupled with the second coupler.

The first communicator may include a first traction member adapted to engage with a second traction member provided with the second coupler when the first coupler is coupled with the second coupler, thereby pulling the part of the wall member in a direction away from the cutter The cutter may include: a needle portion adapted to first come in contact with the part of the first wall member; and a blade portion extending along an inner periphery of the first coupler, and adapted to come in contact with the part of the first wall member subsequent to the needle portion.

The container may further comprise a sealing member, provided on the first wall member and adapted to seal a gap formed between the first wall member and a second wall member defining the second storage space when the first coupler is coupled with the second coupler.

The first coupler may comprise a vibration generator operable to generate vibration when the first coupler is coupled with the second coupler.

According to one aspect of the invention, there is provided an image forming apparatus, comprising:

a container chamber, adapted to accommodate a plurality of containers, each of which is the above container, in a state that the containers are coupled with each other;

a developing device, operable to develop an electrostatic latent image formed on an image carrier with developing agent; and a replenishing device, comprising a third coupler coupled with the first coupler of the container, and operable to replenish the developing agent stored in the first storage space to the developing device.

A total amount of the developing agent once accommodated in the container chamber may correspond to a lifetime of the developing device.

DETAILED DESCRIPTION OF EXEMPLARY EMBODIMENTS

Exemplary embodiments of the invention will be described below in detail with reference to the accompanying drawings. First, with reference to FIGS. 1 to 8, a developing agent container according to a first embodiment of the invention will be described.

Figure 1:
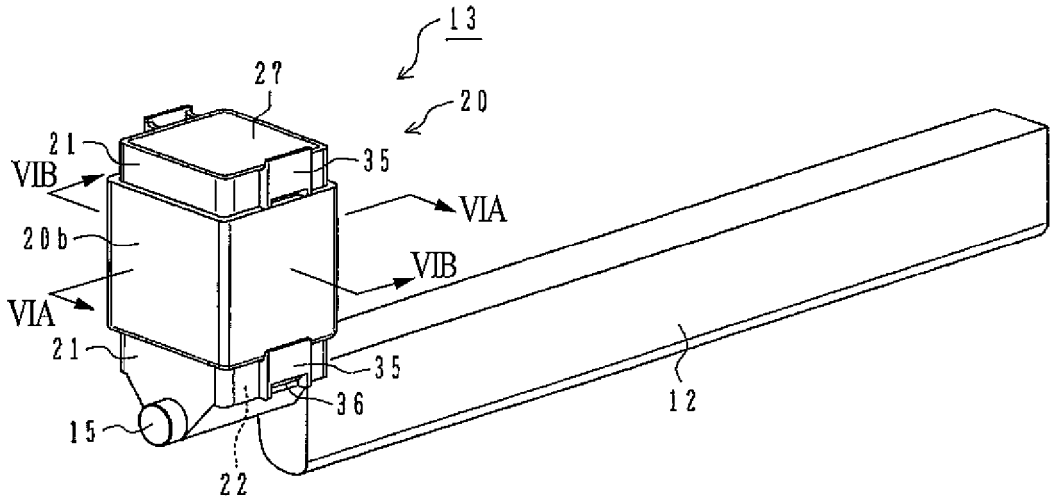
FIG. 1 is a perspective view showing a coupled state of a developing unit and a replenishing unit in an image forming apparatus according to a first embodiment of the invention.
Figure 2:
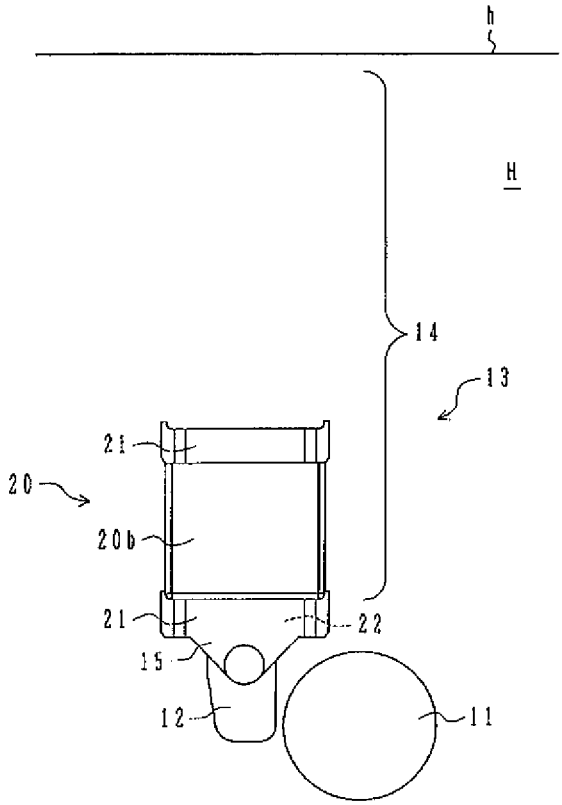
FIG. 2 is a side view showing the coupled state of the developing unit and the replenishing unit.

In FIGS. 1 and 2, an image forming apparatus is a printer that is utilized while it is connected to an external apparatus, such as a personal computer, that creates and outputs images, such as characters. This image forming apparatus is adapted to receive image data, such as characters, sent from the external apparatus to form an electrostatic latent image on a photoconductive drum (image carrier) 11 by an electrophotographic recording method, and thereafter cause a developing unit 12 to selectively adhere a toner (developing agent) to the electrostatic latent image to develop the latent image, and is constructed to cause the toner image to be transferred to and fixed on one side or both sides of a conveyed recording paper to form an image. This developing unit 12 is designed such that the toner that develops the electrostatic latent image on the photoconductive drum 11 is supplied (replenished) from a replenishing unit 13.

This replenishing unit 13 is adapted to set the developing agent container 20 in a set space 14 secured within an outer housing h of an apparatus body H, and connects and sets a coupler 22 of the developing agent container 20 to a coupler 21 of a conveyer 15, on the side of an apparatus body H, connected to the developing unit 12. The conveyer 15 on the side of the apparatus body H receives the toner to be conveyed and supplied to the developing unit 12 when the toner contained in the developing agent container 20 falls so as to be dropped into a communication space 15*a* (refer to FIG. 3B) through the couplers 21 and 22. The communication space 15*a* has built therein, for example, a conveying member (not shown), such as a screw. Here, the set space 14 of the replenishing unit 13 is set to have such an amount that the developing agent container 20 that contains as much toner as the developing unit 12 can repetitively develop electrostatic latent images on the photoconductive drum 11, that is, toner of an amount corresponding to the serviceability limit (lifetime) of the developing unit 12, may be set, and as described below, the set space 14 is designed to be able to connect and join developing agent containers 20 of a number corresponding to the amount of toner that can develops the latent image.

The couplers 21 and 22 of the conveyer 15 and the replenishing unit 13, as shown in FIG. 3A to FIG. 4B, are fabricated by metal-molding, for example, a resin material, etc. in the shape of a substantially rectangular cylinder having dimensions that can be combined mutually, and are designed as a pair of male and female structures.

The coupler 21 on the side of the developing unit 12 (the apparatus body H) is arranged in an upper portion of the conveyer 15, and is designed as a female opening (female coupler) 21 formed in the shape of an opening that opens the internal communication space 15*a* to the outside. The coupler 22 on the side of the replenishing unit 13 (the developing agent container 20) is arranged in a lower portion of the developing agent container 20, and is designed as a male opening (male coupler) 22 formed in the shape of an opening that opens a storage space 20*a* to the outside.

Figure 3A:
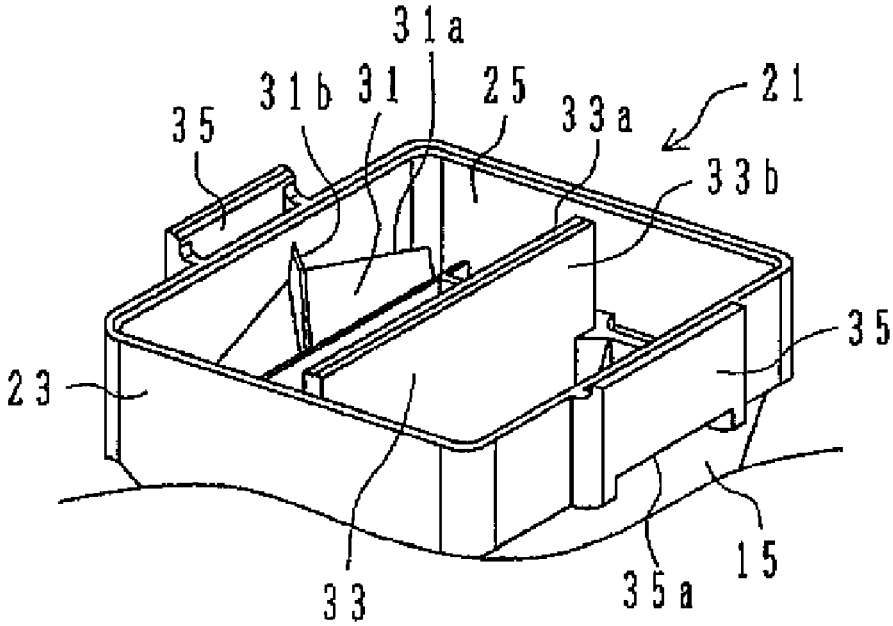
FIG. 3A is a perspective view showing a female opening of a developing agent container in the image forming apparatus of FIG. 1.
Figure 3B:
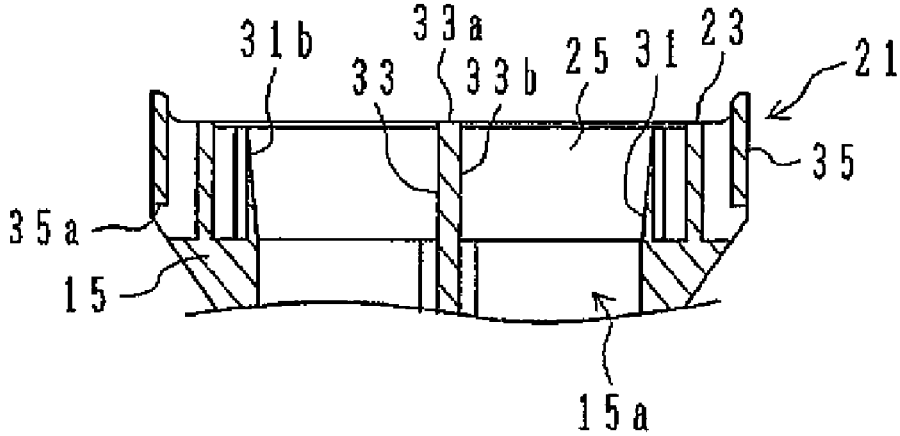
FIG. 3B is a section view showing the female opening in the developing agent container of FIG. 3A.
Figure 4A:
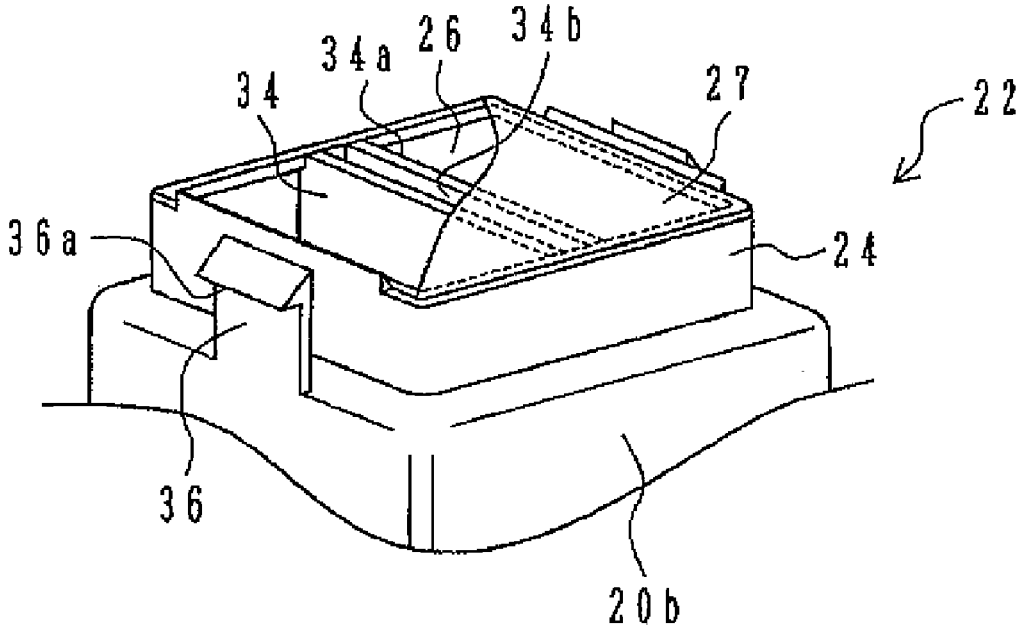
FIG. 4A is a partially-removed perspective view showing a male opening provided in a lower part of a developing agent container in the replenishing unit.
Figure 4B:
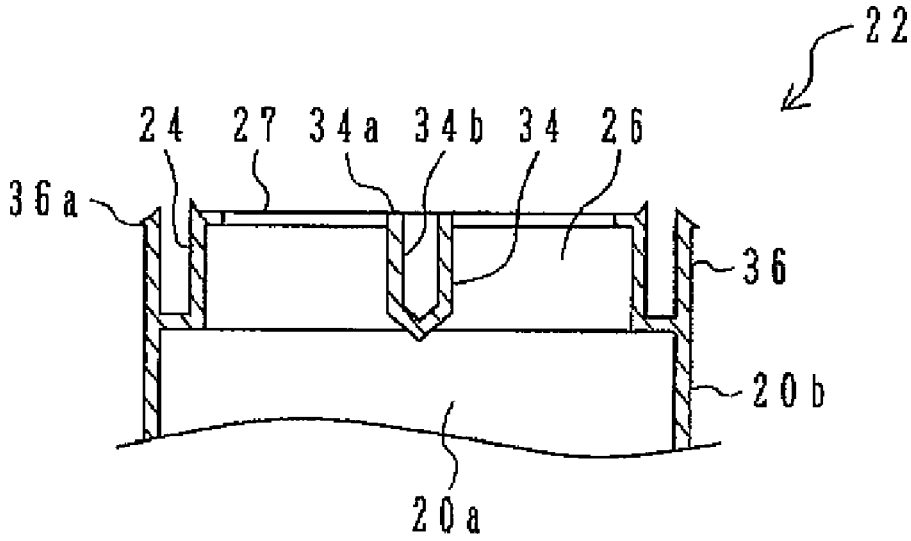
FIG. 4B is a section view of the male opening of FIG. 4A.

The female opening 21 on the side of the developing unit 12, as shown in FIGS. 3A and 3B, is connected to an upper portion of a wall member 15*b* that defines the communication space 15*a* of the conveyer 15, and a communication port 25 is formed in a peripheral edge 23 formed in the shape of a substantially rectangular cylinder so as to permit inflow of toner into the communication space 15*a*. On the other hand, the male opening 22 on the side of the replenishing unit 13, as shown in FIGS. 4A and 4B, is connected to a lower portion of a wall member 20*b* that defines the storage space 20*a* within the developing agent container 20, and a communication port 26 is formed in a peripheral edge 24 formed in the shape of a substantially rectangular cylinder so as to permit outflow of toner from the inside of the storage space 20*a*. That is, in the female opening 21 and the male opening 22, the communication ports 25 and 26 are formed in the peripheral edges 23 and 24 so as to have built therein communicators permits closed of toner. Although the female opening 21 and the male opening 22 having a structure in which a coupler and a communicator are constructed integrally will be described as an example in the present embodiment, it goes without saying that the invention is not limited thereto, and a structure for a coupler only and a structure for a communicator only may be constructed separately.

For the developing unit 12 and the replenishing unit 13, the inner face spacing of the peripheral edge 23 of the female opening 21 of the conveyer 15 is set to almost the same dimension as the outer face spacing of the peripheral edge 24 of the male opening 22 of the developing agent container 20.

Figure 6B:
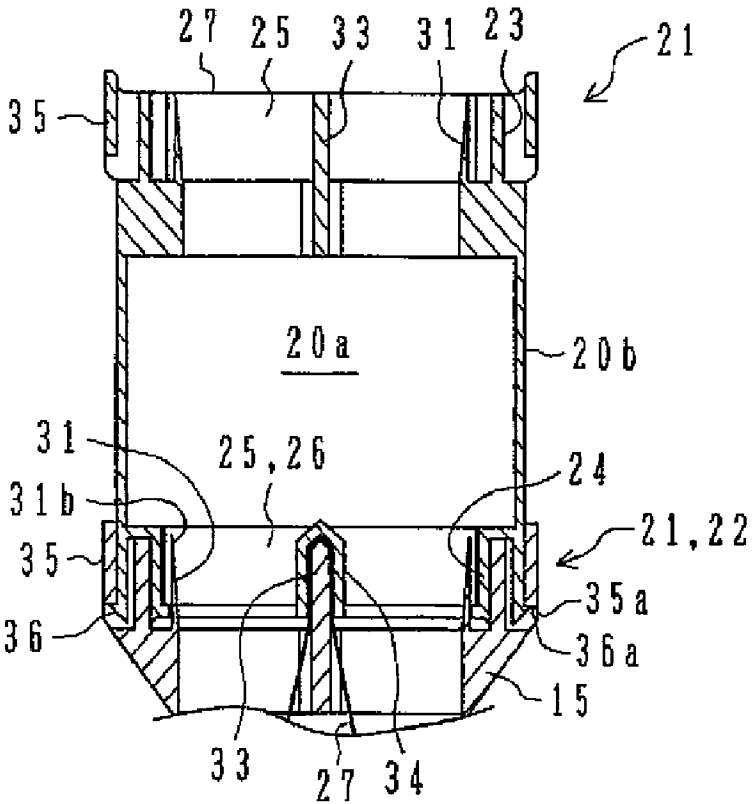
FIG. 6B is a section view taken along a line VIB-VIB in FIG. 1.
Figure 6A:
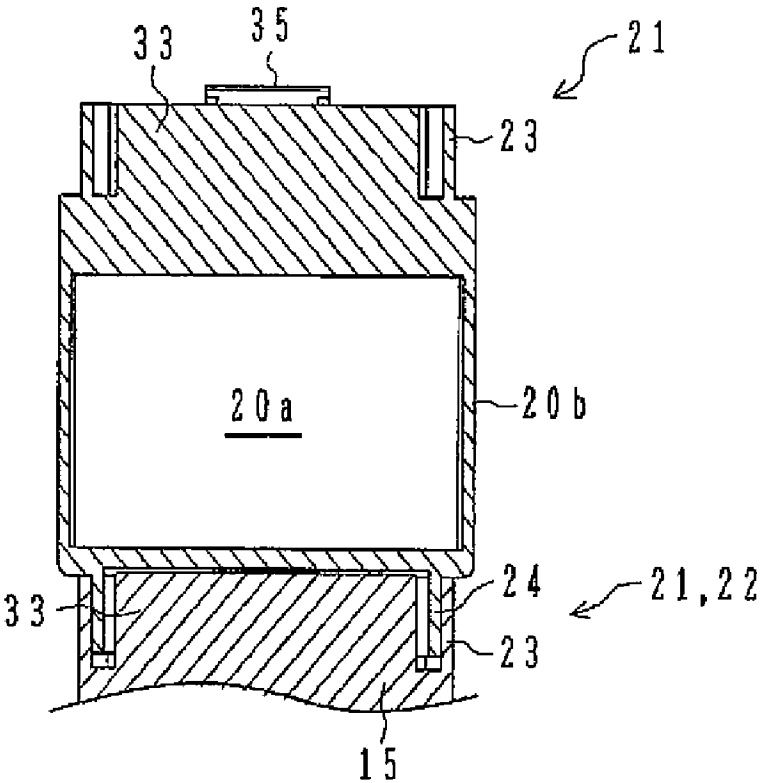
FIG. 6A is a section view taken along a line VIA-VIA in FIG. 1.

As a result, as for the developing unit 12 and the replenishing unit 13, as shown in FIGS. 6A and 6B, the peripheral edge 24 of the lower male opening 22 of the developing agent container 20 is fitted into the peripheral edge 23 of the upper female opening 21 of the conveyer 15 in a state where they come into face contact with each other while they are brought into slide contact with each other, and thus, toner is permitted to drop without leakage through the common communication ports 25 and 26. That is, the female opening 21 and the male opening 22 can connect the conveyer 15 and the developing agent container 20, can join the communication space 15*a* of the conveyer 15 and the storage space 20*a* of the developing agent container 20 in a closed state where toner can flow (outflow and inflow) and the toner does not leak, and can set (couple or join) the developing agent container 20 to the conveyer 15 to allow toner to be supplied to the developing unit 12 from the replenishing unit 13.

Figure 5A:
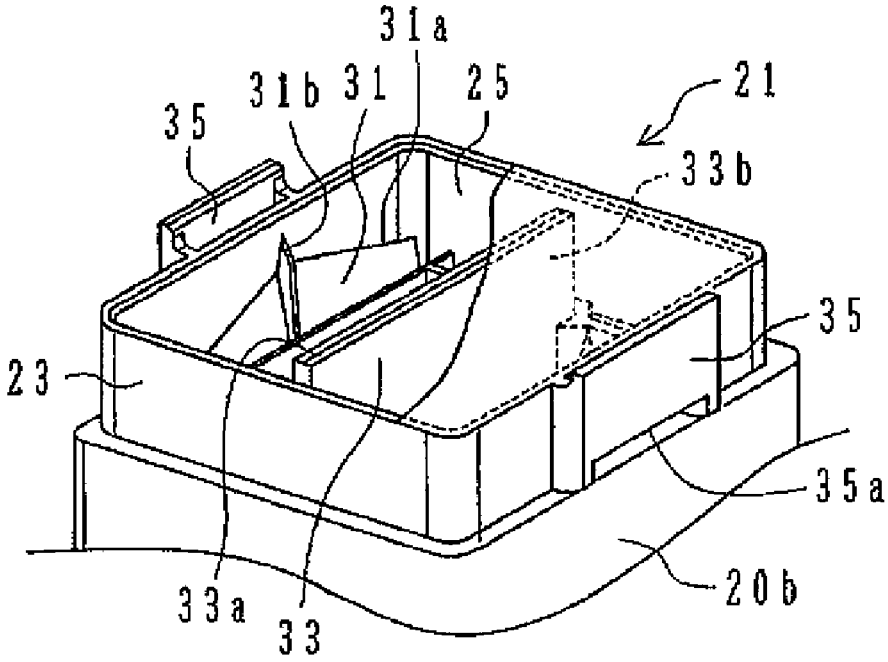
FIG. 5A is a partially-removed perspective view showing a female opening provided in an upper part of the developing agent container in the replenishing unit.
Figure 5B:
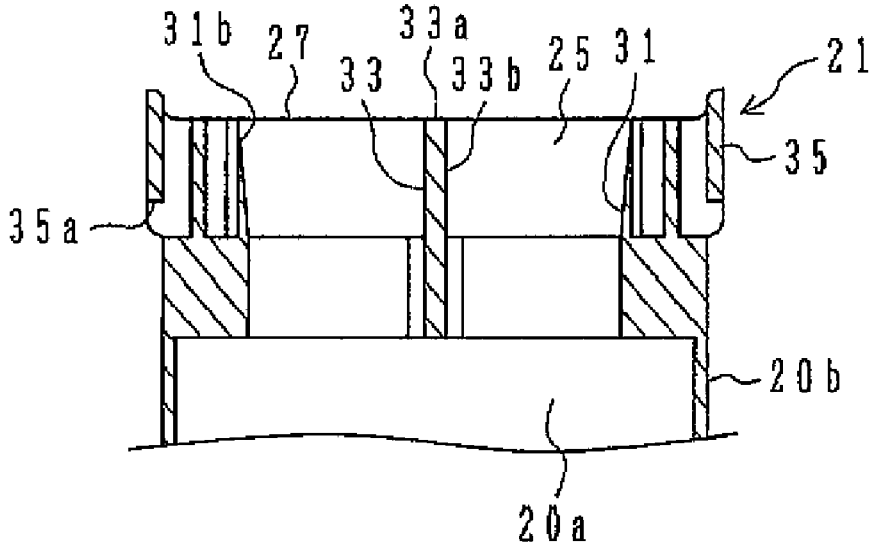
FIG. 5B is a section view of the female opening of FIG. 5A.

Further, as for the developing agent container 20 on the side of the replenishing unit 13, as shown in FIGS. 5A and 5B, the female opening 21 having the same dimension as the conveyer 15 of the developing unit 12 is connected to the upper portion of the wall member 20*b* that defines the storage space 20*a* of toner.

Figure 7:
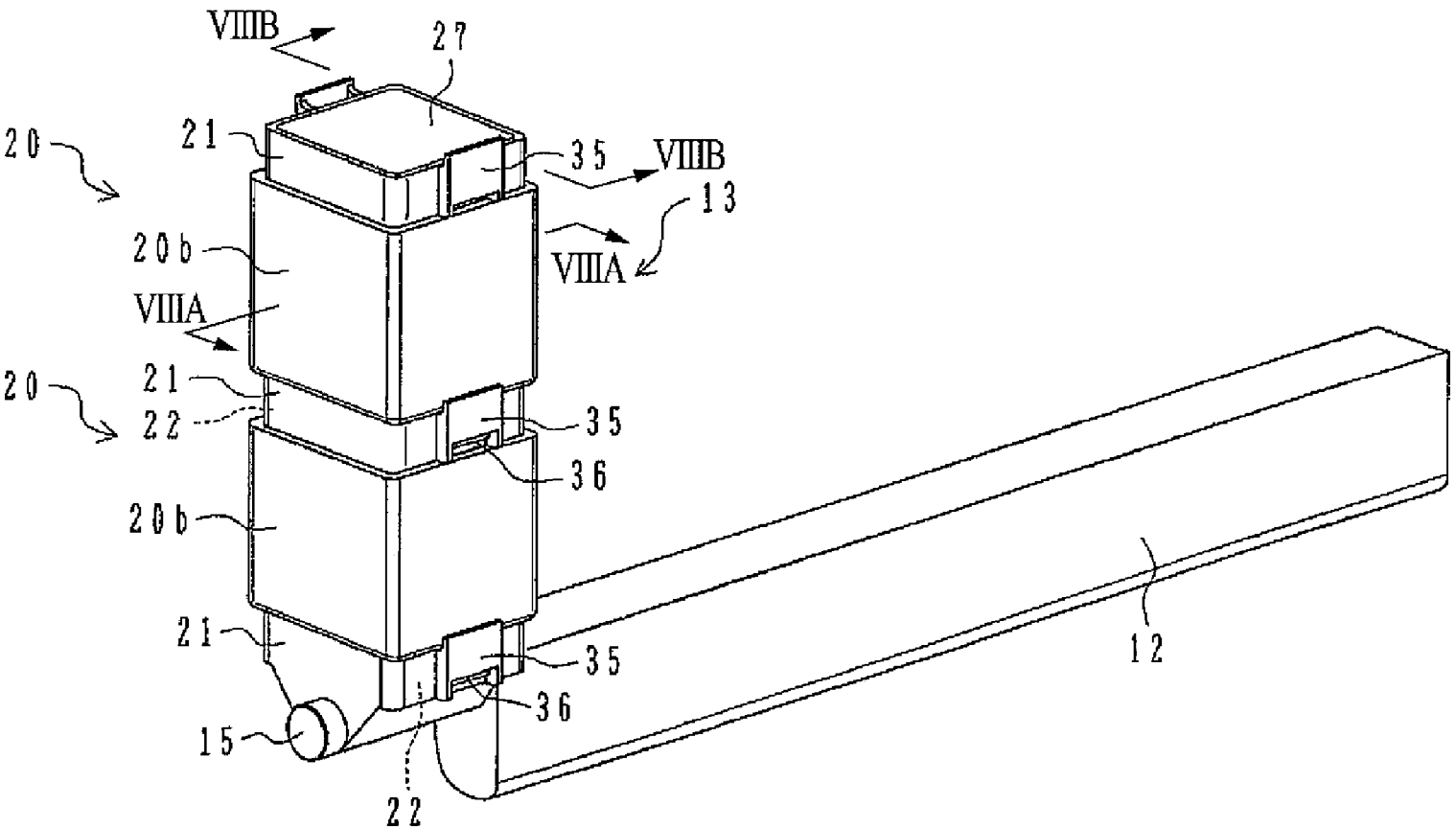
FIG. 7 is a perspective view showing a coupled state of the developing agent containers of FIG. 3A.
Figure 8B:
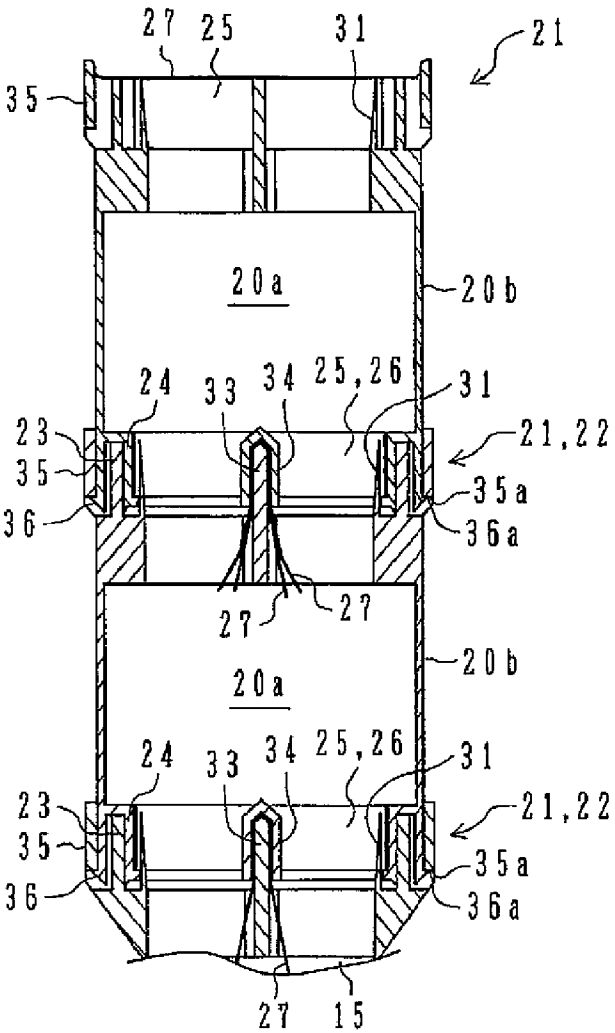
FIG. 8B is a section view taken along a line VIIIB-VIIIB in FIG. 7.
Figure 8A:
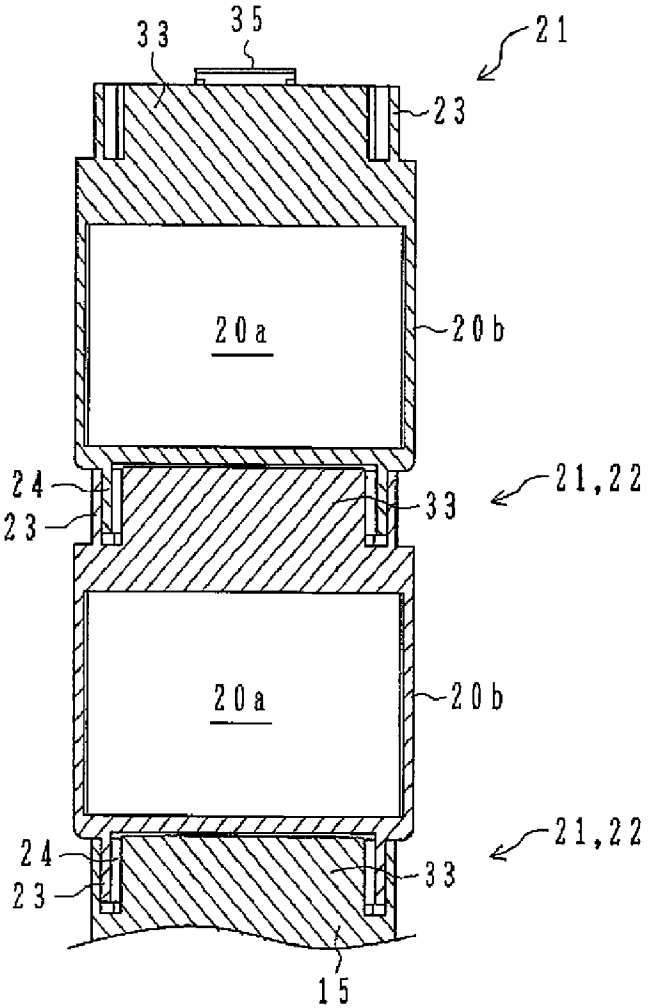
FIG. 8A is a section view taken along a line VIIIA-VIIIA in FIG. 7.

As a result, as for the replenishing unit 13, as shown in FIGS. 7 to 8B, similarly to above, the peripheral edge 24 of the lower male opening 22 of the developing agent container 20 is fitted into the peripheral edge 23 of the upper female opening 21 of the developing agent container 20 in a state where they come into face contact with each other while they are brought into slide contact with each other, and the female opening 21 and the male opening 22 can connect storage spaces 20*a* of separate developing agent containers 20 to connect and set one developing agent container 20 to the other separate developing agent container 20, so that the toner to be replenished to the developing unit 12 from the replenishing unit 13 can be added.

Here, the developing agent container 20 is manufactured in an easily handled manner so that an opening end face of the communication port 25 or 26 of the female opening 21 or the male opening 22 that is arranged vertically may be closed by a sealing film 27 and thereby the stored toner within the storage space 20*a* may not leak before connection to the developing unit 12 (the conveyer 15 or the developing agent container 20 whose connection has been completed).

For this reason, various members that, when the peripheral edges 23 and 24 are connected to each other, cut the sealing film 27 and perform the processing that prevents the sealing film 27 after the cutting from hindering flow of the toner in the communication ports 25 and 26 are arranged in the female opening 21 and the male opening 22.

Specifically, a pair of cutters 31 are erected from the female opening 21 in the vicinity of inside opposite faces (inner faces) of the substantially rectangular peripheral edge 23, and the cutters 31 are molded integrally with the female opening so that they may become parallel to each other in adjacent positions that are spaced from the inner faces by the thickness of the peripheral edge 24 of the male opening 22. Each of the cutters 31 is formed in the shape of a triangular plate whose center becomes an apex. Specifically, the oblique sides of the cutter are formed as cutting blades 31*a*, and an upwardly projecting needle 31*b* is formed in the apex. Further, this cutter 31 is molded integrally with the female opening 21 so that a tip end of the needle 31*b* may be located in a position that retreats further than an opening end of the peripheral edge 23 on which the sealing film 27 is stuck.

As a result, when the peripheral edges 23 and 24 of the female opening 21 and the male opening 22 and connected to each other by fitting, the cutters 31 can cut the sealing film 27 that closes the opening end faces of the communication ports 25 and 26. In this case, when the female opening 21 and the male opening 22 begin to fit to each other so as to be put in a closed state while the opening ends of the peripheral edges 23 and 24 are caused to face each other to stretch the sealing film 27, the needles 31*b* of the cutters 31 can be pierced into two places adjacent to the vicinity of the centers of the inner faces of the peripheral edges 23 and 24 to start cutting, and further when the degree of fitting of the peripheral edges 23 and 24 increases, the cutting blades 31*a* continue the cutting, thereby further extending the cutting range. That is, each of the cutters 31 is arranged only at the peripheral edge 23 of the female opening 21, the needle 31*b* constitutes a cutting starting part, and the cutting blades 31*a* constitute the cutting continuation part.

In the present embodiment, a pair of cutters 31 are arranged so as to cut two places of the sealing film 27. However, it goes without saying that the invention is not limited thereto, and one cutter or three or more cutters may be arranged, and each cutter 31 may have a plurality of needles 31*b* so as to start cutting from two or more places. Further, it may be designed that the cutters 31 are not only arranged at the peripheral edge 23 of the female opening 21 but also arranged at the peripheral edge 24 of the male opening 22 so that the sealing film 27 may be cut from both sides. In this case, the relative positional relationship between the peripheral edges 23 and 24 that combine the female opening 21 and the male opening 22 are limited so that the cutters may not interfere with each other. Therefore, if cutting only is performed, arranging the cutters only at any one of the male and female openings can facilitate design (although the present embodiment may be limited because an insertion member 33 or sheathing member 34 as described below are also arranged).

Further, the female opening 21 is formed integrally with an insertion member 33 that is formed in the shape of an I-shaped cross section in the center between the cutters 31 within the peripheral edge 23. This insertion member 33 extends in a vertical posture parallel to the cutters 31, and thereby is formed so that the sealing film 27 that is stretched at the opening end of the peripheral edge 23 to close the communication port 25 may touch a tip end 33*a*. On the other hand, the male opening 22 is formed integrally with a sheathing member 34 that is formed in the shape of a U-shaped cross section in the center between the opposite faces within the peripheral edge 24. This sheathing member 34 extends in a vertical posture that its upper side is open so as to sheathe insertion member 33 on the side of the female opening 21, and thereby is formed so that the sealing film 27 that is stretched at the opening end of the peripheral edge 24 to close the communication port 26 may touch a tip end 34*a*. In addition, although a gap is formed between the insertion member 33 on the side of the female opening 21 and the inner faces of the peripheral edge 23 so that the peripheral edge 24 on the side of the male opening 22 may be inserted between the insertion member and the peripheral edges 23, the sheathing member 34 on the side of the male opening 22 is provided continuously across between the inner faces of the peripheral edge 24 because it can be inserted into the gap.

As a result, as shown in FIGS. 6A and 6B, in the conveyer 15 of the developing unit 12 that is opened to the set space 14 of the replenishing unit 13, when the peripheral edge 24 of the male opening 22 of the developing agent container 20 is fitted into the peripheral edge 23 of the female opening 21 arranged at the upper portion of the conveyer so that they may be coupled to each other while a closed state is secured, the insertion member 33 on the side of the female opening 21 enters the sheathing member 34 on the side of the male opening 22 concurrently when the sealing film 27 that closes the communication port 26 is cut and communicated. At this time, the sealing film 27 is sandwiched between the tip ends 33*a* and 34*a* of the insertion member 33 and sheathing member 34, and subsequently, enters the sheathing member 34 such that it is wrapped around the insertion member 33. Thereby, the sealing film is towed in the direction of the center between the cutters 31, so that the cutting range can be extended along the inner faces of the peripheral edge 24, and the sealing film is wrapped up gradually while being forcibly deformed in a state where it is sandwiched between side faces 33*b* and 34*b* of the insertion member 33 and sheathing member 34. That is, the cutting range of the sealing film 27 is extended not only in the parts to be cut by the cutters 31 but in a direction that is directed to the tip end 34*a* of the sheathing member 34 from the cutters 31 (direction that intersects the cutting by the cutters 31). Thereby, the sealing film is sandwiched between the side faces 33*b* and 34*b* of the insertion member 33 and the sheathing member 34, and is forcibly folded into two parts. In addition, although the sealing film 27 is folded into two in the present embodiment, the invention is not limited thereto. For example, one side of a cut film may be pressed down and may be bent forcibly downward in opening direction (along the inner face of the peripheral edge).

Accordingly, the stored toner within the developing agent container 20 can be caused to drop (flow) and supplied into the conveyer 15 on the side of the developing unit 12 without being hindered by the sealing film 27, via the communication ports 25 and 26 within the peripheral edges 23 and 24 of the female opening 21 and the male opening 22 that are coupled to each other so that there may be no leakage. Here, within the communication ports 25 and 26, the insertion member 33 is inserted from its tip end 33*a* into the tip end 34*a* of the sheathing member 34 in a downwardly opened posture. Thus, the falling toner is not accumulated between the sealing films 27 or within the sheathing member 34. Similarly, as shown in FIGS. 7 to 8B, in the developing agent container 20, a peripheral edge 24 of a lower male opening 22 of a separate developing agent container 20 is fitted into the peripheral edge 23 of the female opening 21 arranged at the upper portion of the developing agent container so that they may be coupled to each other while a closed state is secured. At this time, the sealing films 27 that close the communication ports 25 and 26 are sandwiched between the insertion member 33 and the sheathing member 34 while being cut by the cutters 31 simultaneously with the coupling, and thereby is compactly folded into two. That is, the replenishing unit 13 is designed so that toner can be replenished by repeating the coupling between such developing agent containers 20 to add the number of the developing agent containers 20 that can be set within the set space 14.

Moreover, the female opening 21 and the male opening 22 include locking mechanisms (outer engaging members) that can be locked so that they may engage with each other at the outside of the peripheral edges 23 and 24 so as to maintain a coupled state. Specifically, female locking receptacles 35 are molded integrally with the female opening 21, and male locking pawls 36 are molded integrally with the male opening 22. Each female locking receptacle 35 of the female opening 21 extends laterally so as to face an outer face (outer face parallel to the insertion member 33) of the peripheral edge 23 adjacent to each cutter 31, and is opened downward. Each male locking pawl 36 of the male opening 22 is erected so as to face an outer face (outer face parallel to the sheathing member 34) of the peripheral edge 24 corresponding to the female locking receptacle 35. An outwardly projecting claw part 36*a* is formed at the tip end of the male locking pawl 36.

As a result, when the peripheral edges 23 and 24 of the female opening 21 and the male opening 22 are fitted to each other so that they may be coupled to each other while a closed state is secured, the male locking pawl 36 enters the female locking receptacle 35, and the claw part 36*a* of the tip end of the claw sticks out. Thereby, since the claw part 36*a* is brought into slide contact with the inner face of the female locking receptacle 35, is elastically deformed, and then is elastically restored so as to face a lower end 35*a* of the receptacle, the male locking pawl 36 is hit and stopped and thereby engaged and locked so that it cannot be pulled out even if it is intended to move in a retreating direction. That is, the female opening 21 and the male opening 22 are brought close to each other so that they may be combined together without peeling off the sealing film 27, and are connected to each other by a simple one action (one operation) of inserting the peripheral edge 24 into the peripheral edge 23. Thereby, the communication ports 25 and 26 within the peripheral edge 23 and 24 are communicated with and joined to each other in a closed state with no leakage of toner, and are locked so that the communicative joined state may be maintained. As a result, the supplying or replenishment work of toner can be completed easily.

Accordingly, when the lower male opening 22 of the developing agent container 20 is coupled to the upper female opening 21 of the conveyer 15 of the developing unit 12, and then the stored toner within the developing agent container 20 is consumed by repetition of a development process (toner development of electrostatic latent images on the photoconductive drum 11) by the developing unit 12, and there is an instruction of replenishment of toner from the apparatus body H side, the lower male opening 22 of the same unused developing agent container 20 is simply coupled to the upper female opening 21 of the used developing agent container 20 similarly to above, without removing the already mounted developing agent container 20 (without performing the replacing work). Thereby, the stored toner in the unused developing agent container 20 can be made to flow into and be supplied to (the communication space 15*a* of) the conveyer 15 of the developing unit 12 via the inside (storage space 20*a*) of the used developing agent container 20.

Figure 9B:
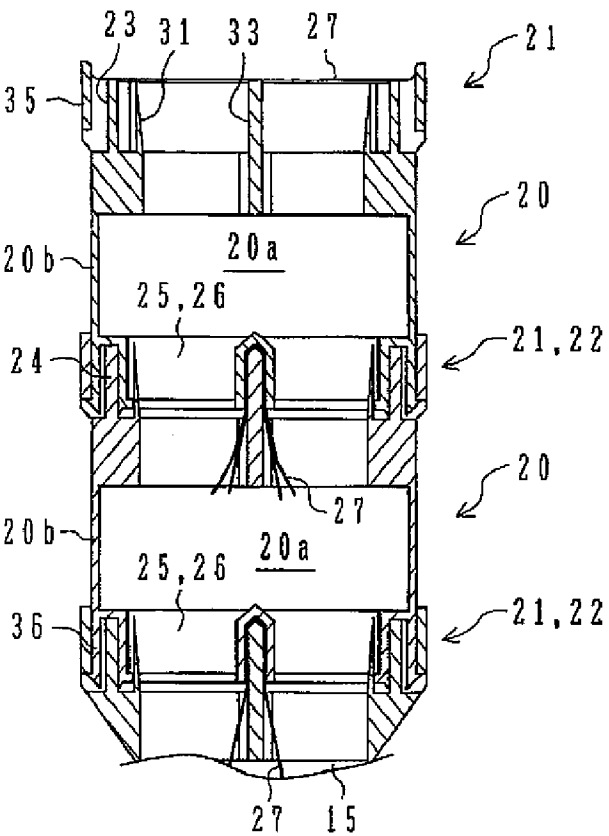
FIG. 9B is a section view showing a coupled state of small-size developing agent containers.
Figure 9A:
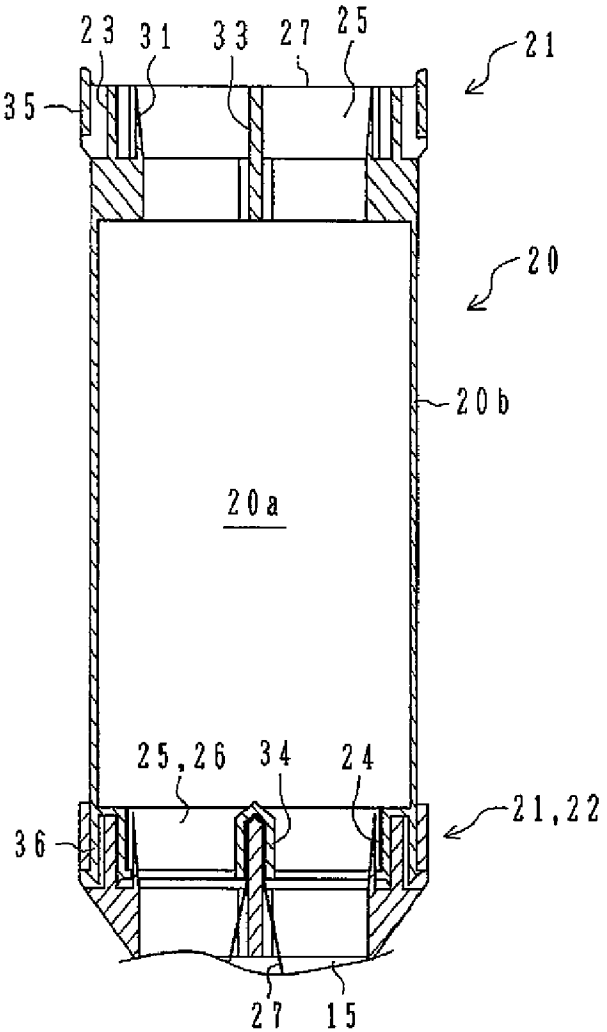
FIG. 9A is a section view showing a coupled state of large-size developing agent containers.

Also, when the number of developing agent containers 20 that can be set within the set space 14 of the replenishing unit 13 are coupled together, and there is again an instruction of replenishment of toner from the apparatus body H side to the developing unit 12 side, it is determined as the serviceability limit of the developing unit 12 without particularly managing the lifetime of the developing unit. Then, the developing unit 12 and the replenishing unit 13 are removed together from the apparatus body H while a plurality of stages of developing agent containers 20 are joined and connected to each other, and then an unused developing unit 12, etc. is newly mounted. That is, the set space 14 of the replenishing unit 13 is set so that the volume of developing agent containers 20 according to the serviceability limit of the developing unit 12 can be coupled together. For example, in the case of a large volume of developing agent container 20 as is shown in FIG. 9A, the developing unit 12 reaches its serviceability limit with few replenishment works of toner, while in the case of a small volume of developing agent container 20 as shown in FIG. 9B, the replenishment work of toner is performed every time. Like this, the volume of a developing agent container can be chosen according to user's usability.

As described above, the present embodiment does not need to perform the replacing work of removing a used developing agent container 20. Therefore, an unused developing agent container 20 can be coupled to the used developing agent container so that toner can be replenished, by the operation of one action of inserting and fitting the male opening 22 into the female opening 21 on the side of the developing unit 12, without leaking out and scattering toner. Accordingly, the replenishment work of toner can be completed by adding and mounting a developing agent container 20 simply and easily without choosing an operator.

Next, a second embodiment of the invention will be described. Here, components similar to those in the above embodiment will be designated by the same reference numerals, and repetitive explanations for those will be omitted. In addition, the same is true in other embodiments to be described below.

An image forming apparatus of the present embodiment shown in FIGS. 10A to 11B has a function to form an electrostatic latent image on the photoconductive drum 11 for every color of received image data, and to transfer and fuse a toner image of the electrostatic latent image, which has been developed with each corresponding color toner, to recording paper, thereby recording and forming a color image, and the developing unit 12 that develops the electrostatic latent image on the photoconductive drum 11 is prepared for every color toner. The replenishing unit 13 (female opening 21 and male opening 22) is designed so as to supply the toner of a color concerned to the developing unit 12 for every color.

That is, the replenishing unit 13 is designed to mount the developing agent container 20 that stores the toner of color according to the developing unit 12 for every color. The female locking receptacle 35 of the upper portion of the conveyer 15 of the developing unit 12 or the upper portion of the female opening 21 of the developing agent container 20, and the male locking pawl 36 of the lower male opening 22 of the developing agent container 20 are designed so that they can be engaged and locked only when the colors of conveyed or stored toner coincide with each other.

Figure 10A:
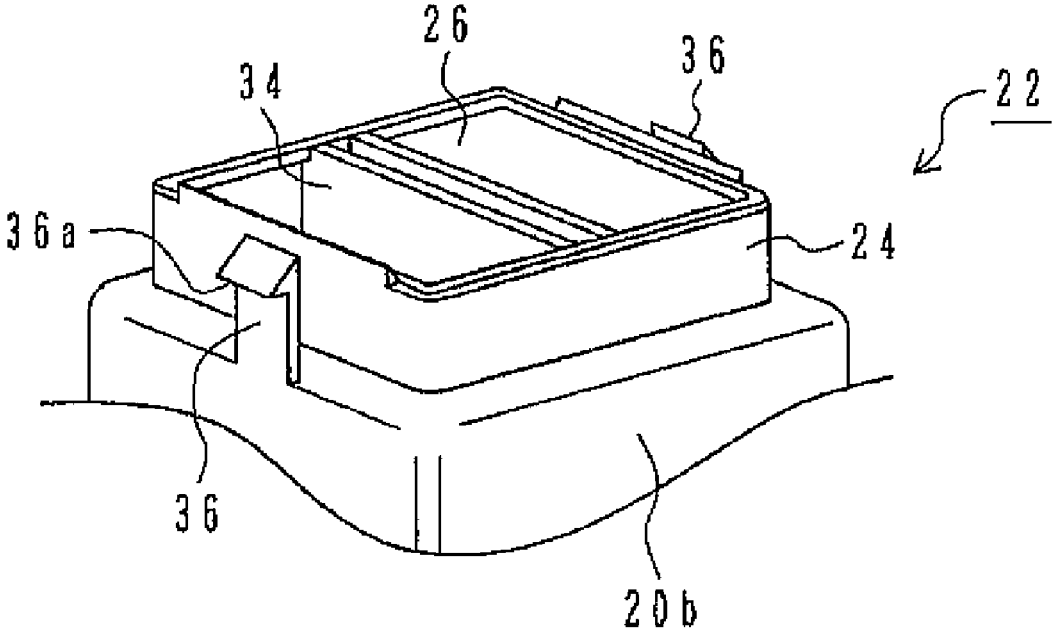
FIG. 10A is a perspective view showing a male opening provided in a lower part of a developing agent container in a replenishing unit according to a second embodiment of the invention.
Figure 10B:
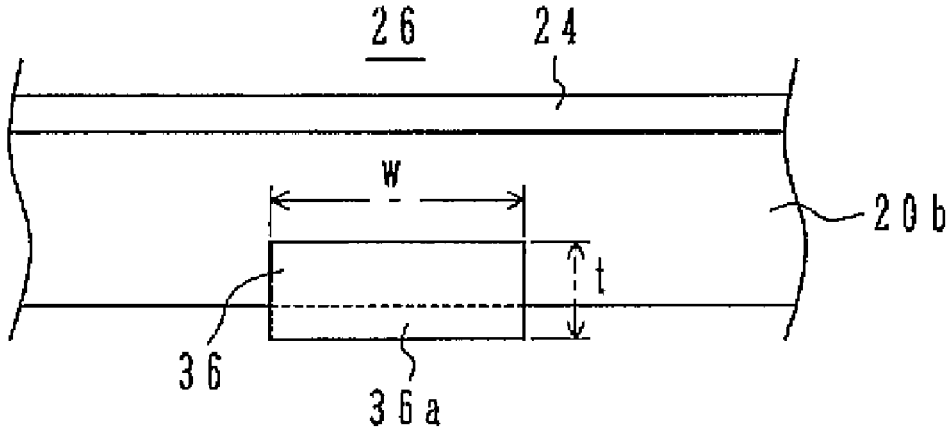
FIG. 10B is an enlarged plan view of a locking pawl in the male opening of FIG. 10A.
Figure 11A:
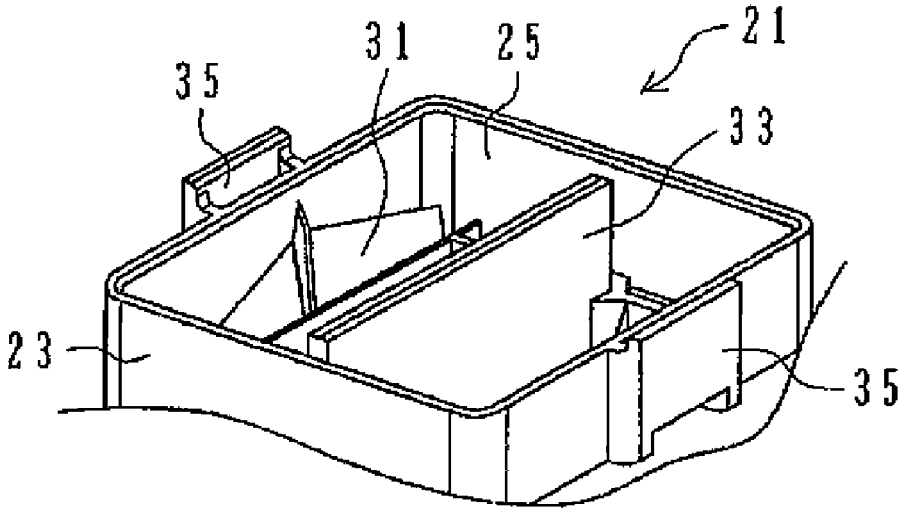
FIG. 11A is a perspective view showing a female opening provided in an upper part of the developing agent container in the replenishing unit.
Figure 11B:
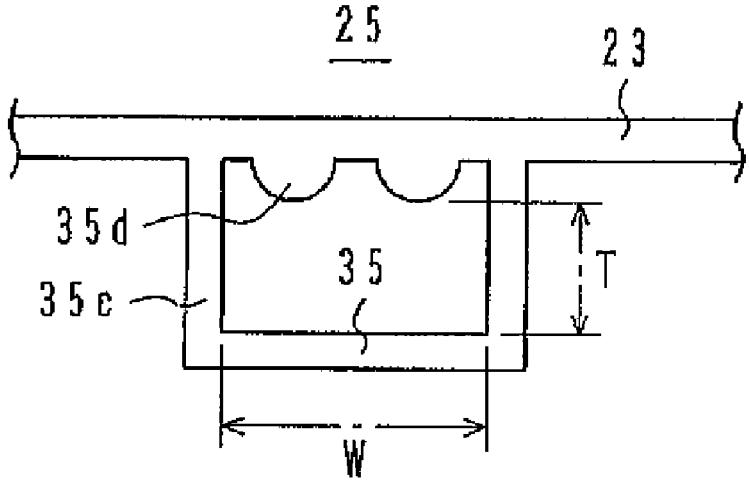
FIG. 11B is an enlarged plan view of a locking receptacle in the male opening of FIG. 11A.

Specifically, the male locking pawl 36, as shown in FIG. 10B, is designed with dimensions of a width "w" and a thickness "t" that are different for every color of the stored toner within the developing agent container 20. The female locking receptacle 35, as shown in FIG. 11, is designed such that it is spaced, opposed, and opened from the outer face of the peripheral edge 23, with dimensions of a width "W" and a thickness "T" that allow insertion of the male locking pawl 36. In detail, the female locking receptacle 35 is set so that supporting plates 35*c* may be erected from the outer face of the peripheral edge 23 of the female opening 21 such that they are spaced from each other by the width "W", and so that projections 35*d* may be formed on the outer face such that the spacing to the female locking receptacle 35 becomes the thickness "T". In addition, the case of the developing agent container 20 that store a different color toner by setting the width "W" or "w" and the thickness "T" or "t" of the female locking receptacle 35 and the male locking pawl 36 to dimensions smaller than those shown in FIGS. 3A to 5B is illustrated as an example.

As a result, in the case of a developing agent container 20 that stores a color toner to be used by the developing unit 12, for example, the male locking pawl 36 of the male opening 22 on the side of the developing agent container 20 shown in FIGS. 10A and 10B can be inserted into, engaged with, and locked to the female locking receptacle 35 of the female opening 21 on the side of the developing unit 12 shown in FIG. 11. However, the male locking pawl 36 of the male opening 22 of the developing agent container 20 of the above-mentioned embodiment, as shown in FIGS. 4A and 4B, that stores a different color toner cannot be inserted into the receptacle, and therefore the sealing film 27 is not cut.

As described above, according to the invention, in addition to the advantageous effects according to the above embodiment, a developing agent container 20 that stores a different color toner is prevented from being coupled to the developing unit 12 side, and thereby coupling of only a developing agent container 20 that stores the same color toner can be permitted. Accordingly, it is possible to prevent a mixed color from being generated due to carelessness during the replenishment work of toner, and it is thus possible to complete high-reliability toner replenishment work.

Here, the present embodiment is designed to prevent coupling of a wrong developing agent container 20 by setting the width "W" and thickness "W" of the male locking pawl 36 and the female locking receptacle 35 to dimensions according to the color of a stored toner However, it goes without saying that the invention is not limited thereto, and for example, a rib and a groove that can be combined may be formed in mutual opposite faces.

Further, although the present embodiment describes the color of a toner to be stored within the developing agent container 20 as a sort of example, it goes without saying that the invention is not limited thereto, and it may be designed so as to perform allowance and rejection of coupling according to the particle diameter, characteristics, etc. of toner.

Further, the structure for identifying the type of a developing agent described in the present embodiment can be suitably combined with the configuration of each embodiment to be described below.

Next, a third embodiment of the invention will be described.

Figure 12:
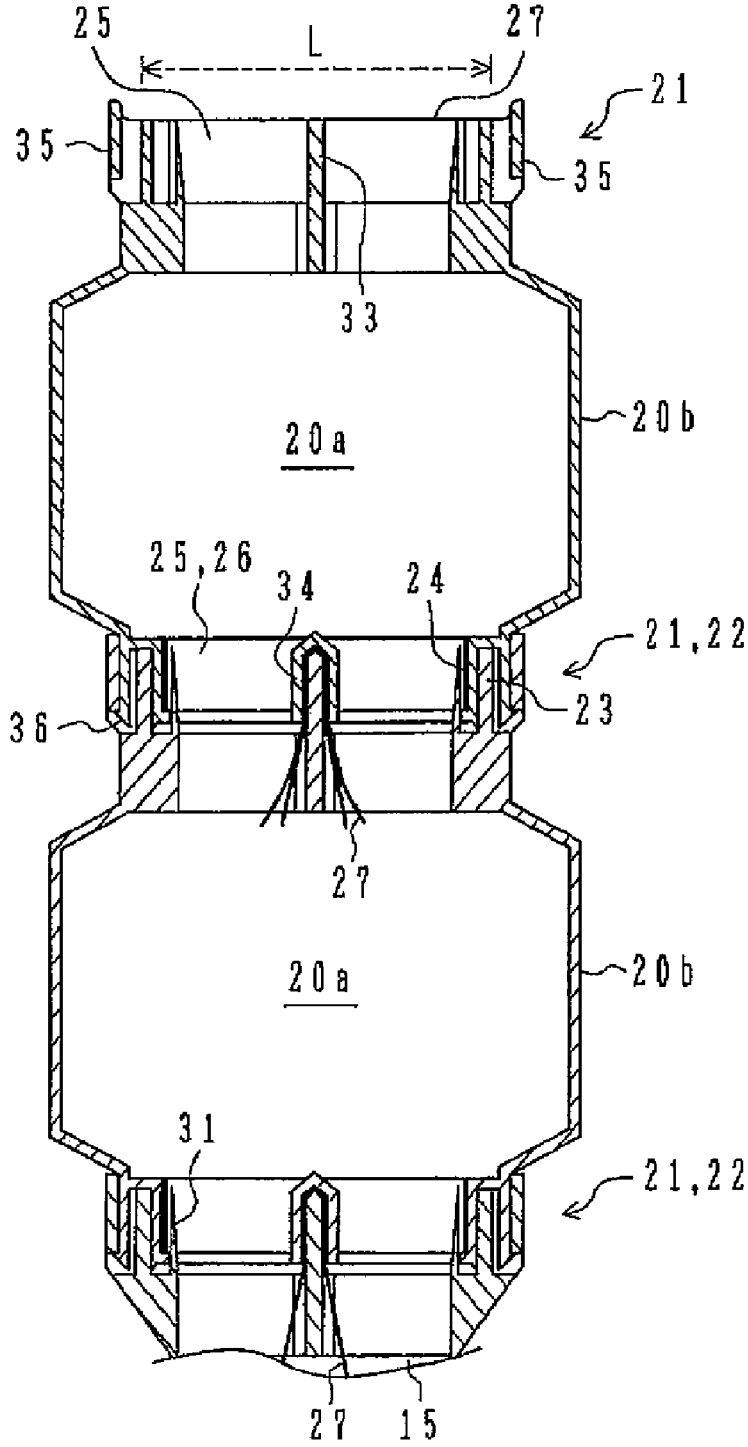
FIG. 12 is a section view showing a coupled state of developing agent containers according to a third embodiment of the invention.

In an image forming apparatus of the present embodiment shown in FIG. 12, similarly to the second embodiment, the replenishing unit 13 (female opening 21 and male opening 22) is designed so as to replenish the toner of a color concerned to the developing unit 12 for every color toner, and the replenishing unit is designed so that the opposing interval L of each of the peripheral edges 23 and 24 of the female opening 21 and male opening 22 may be different for every color of color toners.

Specifically, the female opening 21 and the male opening 22 are designed so as to allow coupling of a developing agent container 20 that stores the same color toner, but to reject coupling of a developing agent container 20 that stores a different color toner by increasing or decreasing the opposing interval L of each of the peripheral edges 23 and 24 according to the color of a toner to be conveyed or stored by the conveyer 15 or the developing agent container 20. In addition, the developing agent container 20 of the present embodiment shows an example in which dimensions are set so that the opposing interval L of each of the peripheral edges 23 and 24 may be made smaller than that of the first embodiment, while the volume of the storage space 20*a* is kept constant.

As a result, in the case of a developing agent container 20 that stores a color toner to be used by the developing unit 12, for example, the male peripheral edge 24 of the male opening 22 on the side of the developing agent container 20 can be fitted into and connected and locked to the peripheral edge 23 of the female opening 21 on the side of the developing unit 12 shown in FIG. 12. However, the peripheral edge 24 of the male opening 22 of the developing agent container 20 of the above-mentioned embodiment, as shown in FIG. 4, that stores a different color toner cannot be inserted into the peripheral edge, and therefore the sealing film 27 is not cut.

As described above, according to the invention, in addition to the advantageous effects according to the above-mentioned second embodiment, a developing agent container 20 that stores a different color toner is prevented from being coupled to the developing unit 12 side, and thereby coupling of only a developing agent container 20 that stores the same color toner can be permitted. Accordingly, it is possible to prevent a mixed color from being generated due to carelessness during the replenishment work of toner, and it is thus possible to complete high-reliability toner replenishment work.

Next, a fourth embodiment of the invention will be described.

Figure 13:
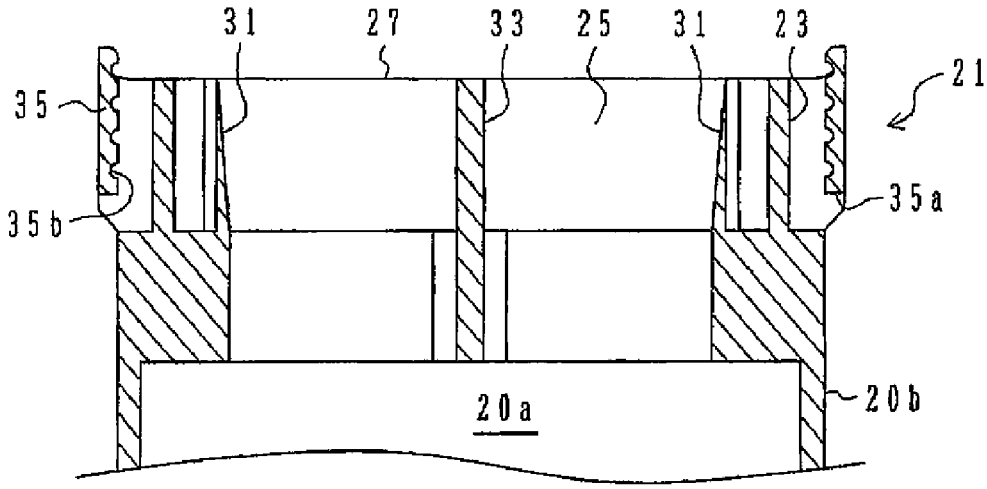
FIG. 13 is a perspective view showing a female opening provided in an upper part of a developing agent container according to a fourth embodiment of the invention.

An image forming apparatus shown in FIG. 13 includes a structure that generates vibration when the developing agent container 20 is set in the replenishing unit 13. A plurality of laterally extending grooves 35*b* are formed in the inner face of the female locking receptacle 35 of the female opening 21 on the side of the developing unit 12.

Figure 14:
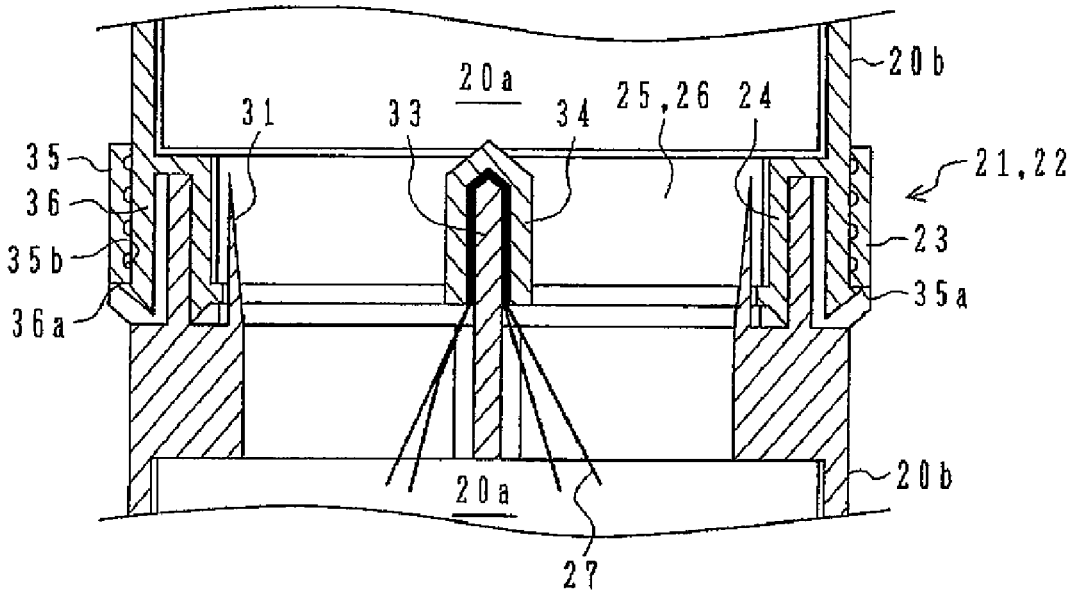
FIG. 14 is a section view showing a male opening provided in a lower part of the developing agent container of FIG. 13.

As a result, as shown in FIG. 14, when the male opening 22 of the developing agent container 20 is coupled to the female opening 21 on the side of the developing unit 12, after the claw part 36*a* of the male locking pawl 36 of the male opening 22 are brought into slide contact with the inner face of the female locking receptacle 35 of the female opening 21 and thereby repeats entry into the grooves 35*b* or withdrawal therefrom, in other words, after the claw part 36*a* repeats vibration, it will be engaged with and locked to the lower end 35*a* of the female locking receptacle 35 so that it cannot be pulled out.

As described above, according to the present embodiment, in addition to the advantageous effects according to the above-mentioned embodiments, vibration can be generated when the male locking pawl 36 is engaged with and locked to the female locking receptacle 35 by coupling the male opening 21 of the developing agent container 20 to the female opening 21 on the side of the developing unit 12, the toner that has adhered to and remained at the inner wall of the storage space 20*a*, etc. can be shaken off. Accordingly, the stored toner within the developing agent container 20 can be replenished to the developing unit 12 side without waste.

Next, a fifth embodiment of the invention will be described.

Figure 15:
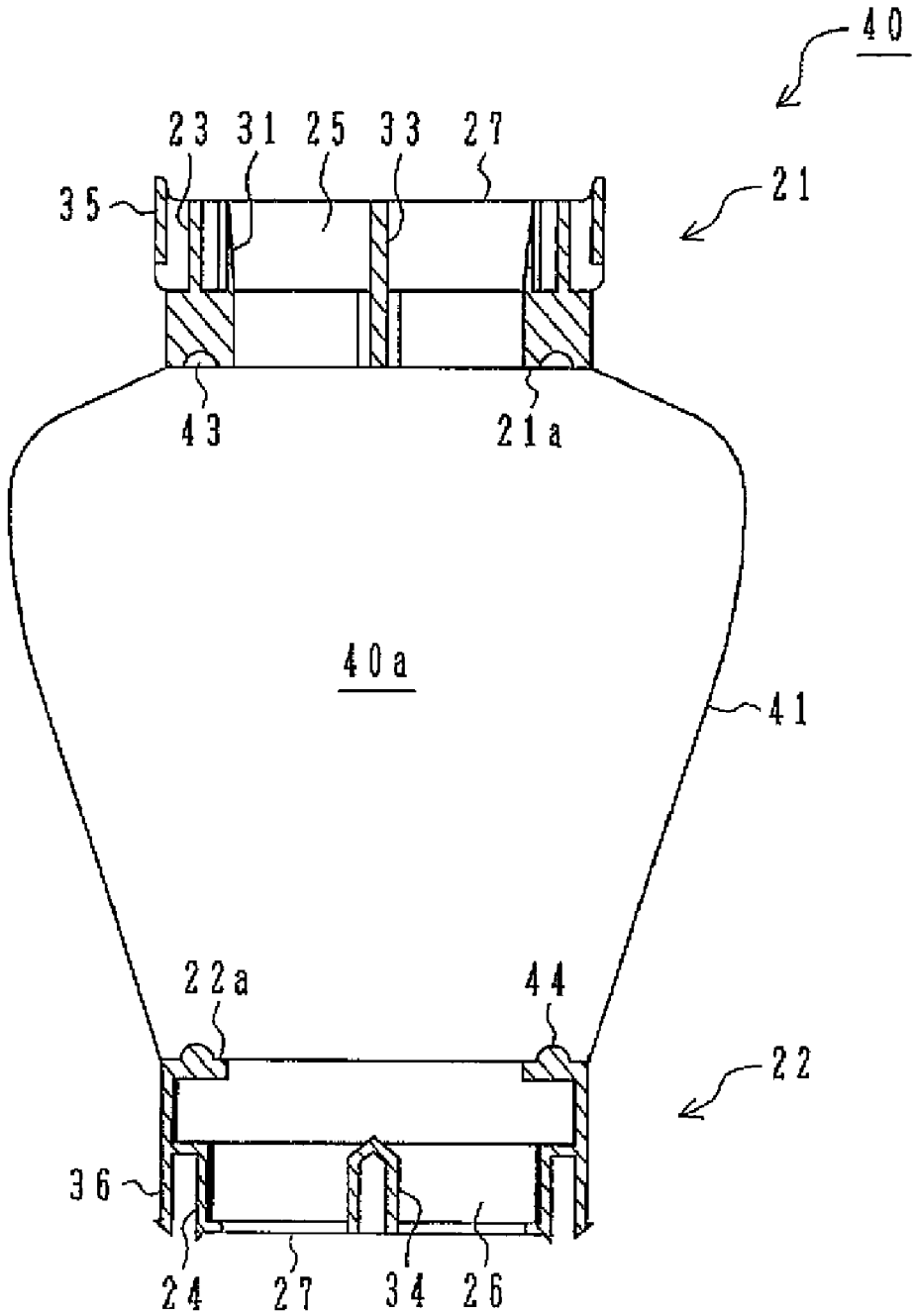
FIG. 15 is a section view showing a developing agent container according to a fifth embodiment of the invention.

An image forming apparatus shown in FIG. 15 is designed so that a plurality of stages of developing agent containers 40 can be set in the replenishing unit 13. In each of the developing agent containers 40, a freely deformable wall member 41 obtained by forming, for example, a vinyl resin material, etc. into a film is fabricated between the female opening 21 and the male opening 22 that that enable a plurality of stages of developing agent containers to be coupled to the developing unit 12. A toner storage space 40*a* is defined by the wall member 41. That is, the flexible wall member 41 can be deformed freely so that a lateral dimension may be reduced, and upper and lower ends can be made to approach each other, and here, the vertically located female opening 21 and male opening 22 can be made to approach to each other.

In the flexible wall member 41, the cross sectional shape of the storage space 40*a* that is defined in the flexible wall member becomes a larger area of a similar shape than the communication port 25 in the peripheral edge 23 of the female opening 21 as it approaches the upper portion of the flexible wall member, and the cross sectional shape is reduced to a shape substantially similar to the communication port 26 of the peripheral edge 24 of the male opening 2 as it goes to a lower portion of the flexible wall member 41.

As a result, since the cross sectional area of the flexible wall member 41 that defines the toner storage space 40*a* is reduced downward, the developing agent container 40 can be put into a state where a load is applied obliquely downward. Also, even if the stored toner flows out of the communication port 26 within the peripheral edge 24 of the lower male opening 22, a state where a load is obliquely downward applied to the flexible wall member 41 can be maintained. For this reason, when the stored toner is dropped, caused to flow in and thereby replenished via the communication ports 25 and 26 within the peripheral edges 23 and 24 of the female opening 21 and the male opening 22 that are coupled to each other on the side of the developing unit 12, the height of the stored toner within the storage space 40*a* will decrease according to the amount of outflow, without collapsing the appearance formed by the flexible wall member 41. As a result, when the stored toner has been replenished without remaining in the storage space, a bottom face 21*a* of the female opening 21 and a top face 22*a* of the male opening 22 that are connected to an upper portion and a lower portion of the flexible wall member 41 can be brought into facing contact with each other.

In addition, the top face 22*a* of the male opening 22 is formed by forming a portion opposite to the male locking pawl 36 in the shape of a flange so that it may project inward. Here, this developing agent container 40 may be designed so that the stored toner can be dropped and replenished without remaining in the storage space by adopting a form of setting the container within a prismatic sheathing member or hanging down the upper female opening 21 so that it may not fall down.

The female opening 21 and the male opening 22 engage with each other in a facing contact state so that they can be positioned and fixed horizontally. For this purpose, holes 43 are formed in a plurality of places of the bottom face 21*a* of the female opening 21, while projections 44 to be sheathed in the holes 43, respectively, are formed in a plurality of corresponding places of the top face 22*a* of the male opening 22.

As a result, when the upper female opening 21 of the developing agent container 40 approaches and comes into facing contact with the top face 22*a* of the lower male opening 22 as the stored toner is replenished to the developing unit 12 side, and the storage space 40*a* is reduced, the projections 44 of the top face 22*a* are fitted into the holes 43 of the bottom face 21*a*. This can suppress that the communication port 25 within the peripheral edge 23 deviates horizontally from the communication port 26 in the peripheral edge 24 of the lower male opening 22, and therefore a problem does not occur that the stored toner within the storage space 40*a* cannot be replenished to the developing unit 12 side, and consequently remains in the storage space. That is, the holes 43 of the bottom face 21*a* of the female opening 21 and the projections 44 of the top face 22*a* of the male opening 22 constitute inner engaging members that engage with each other so as to secure flow of toner.

Figure 16:
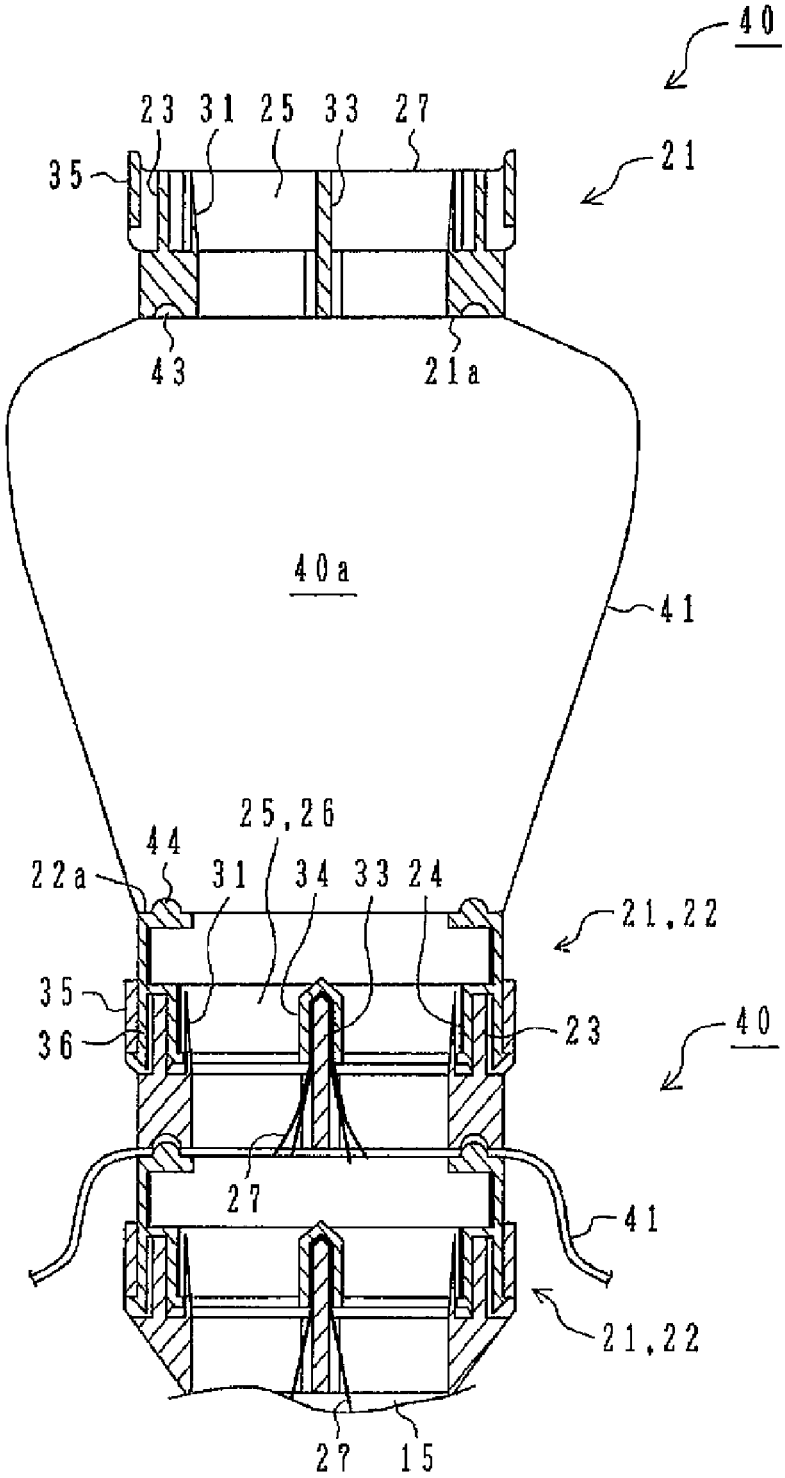
FIG. 16 is a section view showing a coupled state of the developing agent containers of FIG. 15.

Accordingly, in the developing agent container 40, when stored toner is consumed by the developing unit 12 and then there is a replenishing instruction from the apparatus body H side, as shown in FIG. 16, the flexible wall member 41 is deformed into the state of spreading outside according to its own shape while it descends (the female opening 21 approaches the male opening 22) so as to crush the storage space 40*a* according to a decrease in the stored toner. Thereby, the female opening 21 approaches the male opening 22 as it faces and contact the male opening. Thus, the developing agent container is brought into a compact state where the projection 44*s* of the top face 22*a* are fitted into and engaged with the holes 43 of the bottom face 21*a* without removing from the replenishing unit 13 (without performing the replacing work). Also, by coupling a male opening 22 of an unused developing agent container 40 to the upper female opening 21, toner can be replenished through the communication ports 25 and 26 in the peripheral edges 23 and 24 of the lower female opening 21 and male opening 22 whose opening directions coincides with each other.

Also, when the number of developing agent containers 40 that can be set within the set space 14 of the replenishing unit 13 are coupled together, and there is again an instruction of replenishment of toner from the apparatus body H side to the developing unit 12 side, it is determined as a serviceability limit (lifetime) of the developing unit 12. Then, the developing unit 12 and the replenishing unit 13 are removed together from the apparatus body H while female openings 21 and male openings 22 of a plurality of developing agent containers 40 are joined and connected to each other in multi stages, and then an unused developing unit 12, etc. is mounted newly Here, the developing agent container 40 is in a compact state where the upper female opening 21 and the lower male opening 22 come into direct facing contact with each other. Thus, the set space 14 of the replenishing unit 13 needs only to secure a volume that allows coupling of the last developing agent container 40 that causes the developing unit 12 to reach its serviceability limit in addition to female openings 21 and male openings 22 being coupled together in multi stages, in other words, a volume that allows coupling of the last storage space 40*a* in addition to multi-stages of female openings 21 and male openings 22. Accordingly it is possible to avoid that the space within the set space 14 will be wastefully occupied by a used developing agent container such that the toner to be replenished passes through.

As described above, according to the present embodiment, in addition to the advantageous effects according to the above-mentioned embodiments, developing agent containers 40 can be added compactly by stacking female openings 21 and male openings 22 so that they may not be collapsed. Also, an unused developing agent container 40 can be continuously coupled to the developing unit 12 side, without a used developing agent container 40 being bulky in the set space 14 of the replenishing unit 13. Accordingly, toner can be replenished from a plurality of developing agent containers 40 to the developing unit 12 while the volume of the set space 14 of the replenishing unit 13 is designed compactly.

Next, a sixth embodiment of the invention will be described.

Figure 17:
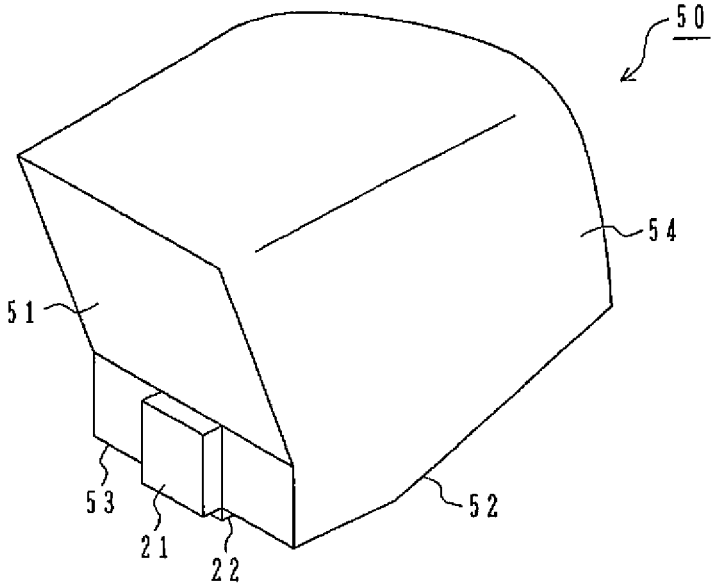
FIG. 17 is a perspective view showing a developing agent container according to a sixth embodiment of the invention.
Figure 18:
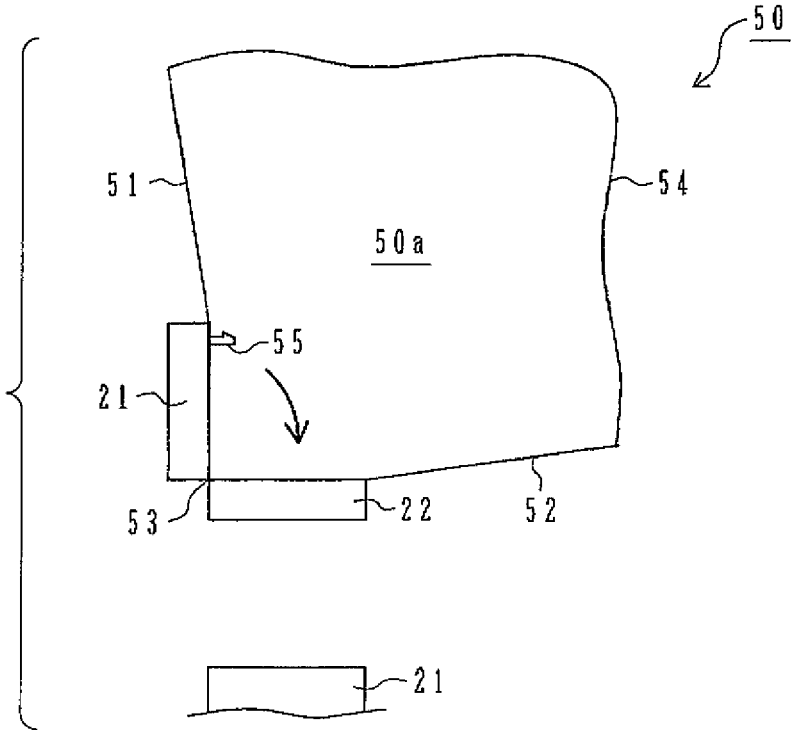
FIG. 18 is a schematic view showing a coupled and in-use state of the developing agent container of FIG. 17.

An image forming apparatus shown in FIGS. 17 and 18 is designed so that a plurality of stages of developing agent containers 50 can be set in the replenishing units 13. In each of the developing agent containers 50, a toner storage space 50*a* is defined by a pair of rigid wall members 51 and 52 that are formed in almost the same shape as the shape of the bottom face of the set space 14 of the replenishing unit 13, are connected via a hinge 53, and are made of a hard sheet material, and a flexible wall member 54 that is connected to lateral sides of the rigid wall members 51 and 52 other than the hinge 53, is made of, for example, a vinyl resin material, etc., and is formed in the shape of a film. In addition, the hinge 53 is made bendable by making a part between one side of the rigid wall member 51 and one side of the rigid wall member 52 thin.

Also, the flexible wall member 54 is manufactured so that the toner storage space 50*a* to be defined on the whole may have a substantially hexahedral box shape in a state where the rigid wall members 51 and 52 take a substantially vertical posture together via the hinge 53.

Figure 19:
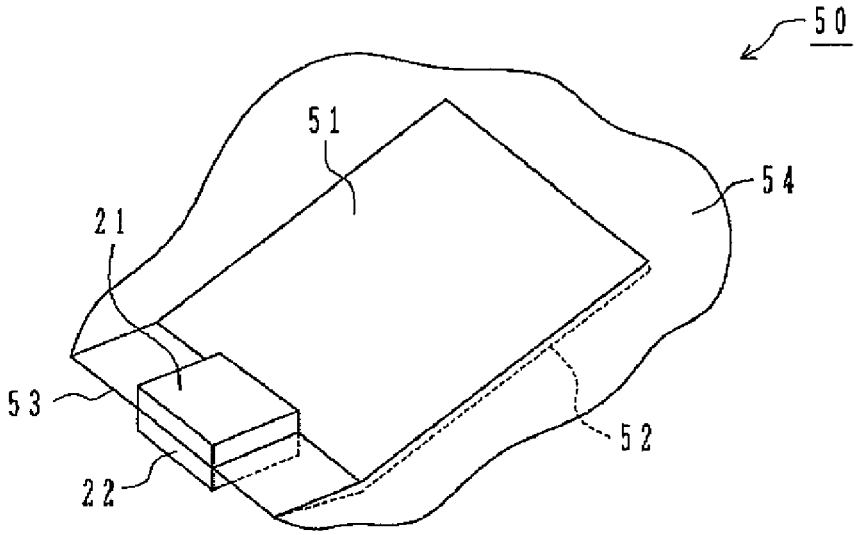
FIG. 19 is a perspective view showing a used state of the developing agent container of FIG. 17.

As a result, in the developing agent container 50, when the stored toner within the storage space 50*a* defined by the rigid wall members 51 and 52 and the flexible wall member 54 is reduced, as shown in FIG. 19, the rigid wall members 51 and 52 can be folded into a facing contact state (overlapping state) as they are bent at the hinge 53 and thereby rotate in the direction in which they approach each other. At this time, the flexible wall member 54 is deformed freely so that the lateral dimension may be reduced. In addition, as for the flexible wall member 54 or the rigid wall member 51, a supporting or hanging member may be arranged on the apparatus body H side. Also, the rigid wall member 51 may be folded by rotating the rigid wall member 51 in the direction in which it is brought into facing contact to the rigid wall member 52 after the stored toner within the developing agent container 50 is completely replenished to the developing unit 12 side.

Figure 20:
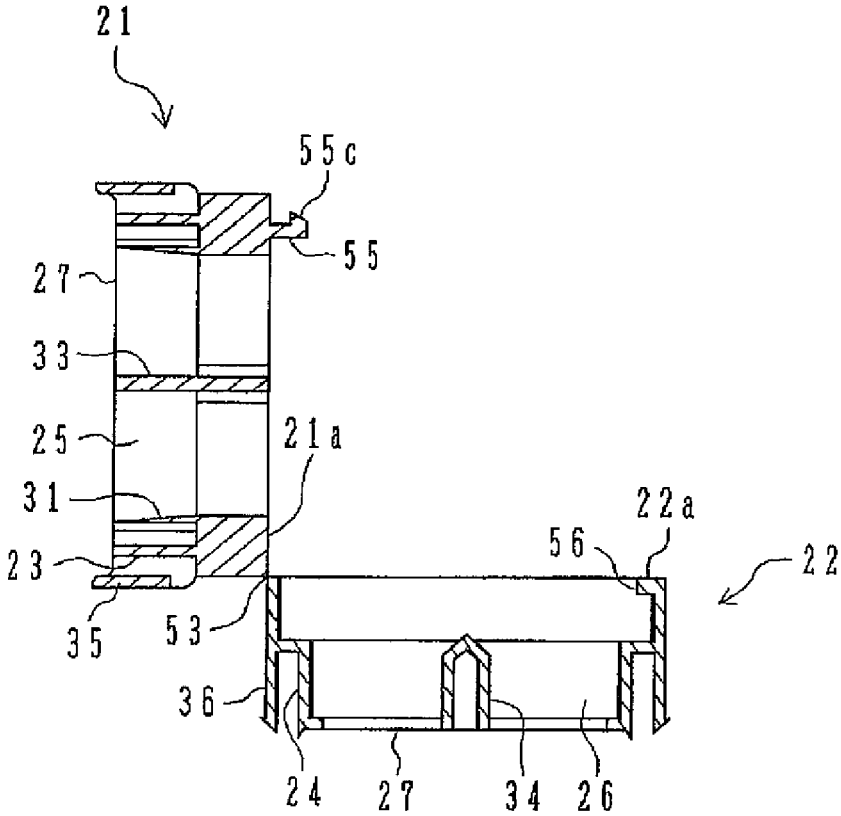
FIG. 20 is a section view showing configurations of a male opening and a female opening in the developing agent container of FIG. 17.

Further, as for the rigid wall members 51 and 52, as shown in FIG. 20, the female opening 21 and the male opening 22 are arranged in the places adjacent to the hinge 53. Specifically, the female opening 21 and the male opening 22 are adapted such that, when the rigid wall members 51 and 52 are bent by the hinge 53, the bottom face 21*a* and top face 22*a* of the female and male openings are brought into facing contact with each other similarly, and thereby the communication ports 25 and 26 within the peripheral edge 23 and 24 coincide with each other. The female opening 21 and the male opening 22 are integrally formed with locking mechanisms (inner engaging members) that can be engaged with and locked to each other so that a state in which the bottom face 21*a* and the top face 22*a* are brought into facing contact with each other may be maintained. Specifically, a female locking pawl 55 that has a claw part 55*a* that projects outwardly is erected from the bottom face 21*a* in the female opening 21, while a flange-shaped male locking receptacle 56 that projects inwardly on the side opposite to the male locking pawl 36 is formed in the male opening 22.

As a result, when the rigid wall members 51 and 52 are bent, after the claw part 55*a* of the female locking pawl 55 of the female opening 21 is elastically deformed in slide contact with the male locking receptacle 56 of the male opening 22, the claw part 55*a* is elastically restored and thereby engaged with and locked to on the bottom face. That is, the female opening 21 and the male opening 22 can be locked to secure a flow path of toner in a state where the rigid wall members 51 and 52 are bent and brought into facing contact with each other, and simultaneously, the communication ports 25 and 26 within the peripheral edges 23 and 24 coincide with each other.

Moreover, the parts of the rigid wall members 51 and 52 that are adjacent to the female opening 21 and the male opening 22 on the side opposite to the hinge 53 are bent toward the female opening 21. Specifically, the rigid wall member 52 on the side of the male opening 22 to be coupled to the developing unit 12 side is set so that its part that is spaced from the male opening 22 may rise and the stored toner may flow down toward the communication port 26, while the rigid wall member 51 is formed in the shape that resembles the rigid wall member 52 so as to come into facing contact therewith.

As a result, the rigid wall member 51 makes the stored toner within the storage space 50*a* slide on the upper side, and makes the toner flow into the communication port 26 within the peripheral edge 24 of the male opening 22. Thereby, the stored toner can be dropped and replenished to the developing unit 12 side without remaining in the storage space. Also, the flexible wall member 54 is deformed in the direction in which the lateral dimension is reduced according to a decrease in the stored toner within the storage space 50*a*, the rigid wall member 51 can be rotated about the hinge 53 in the direction in which it approaches the rigid wall member 52.

Figure 21:
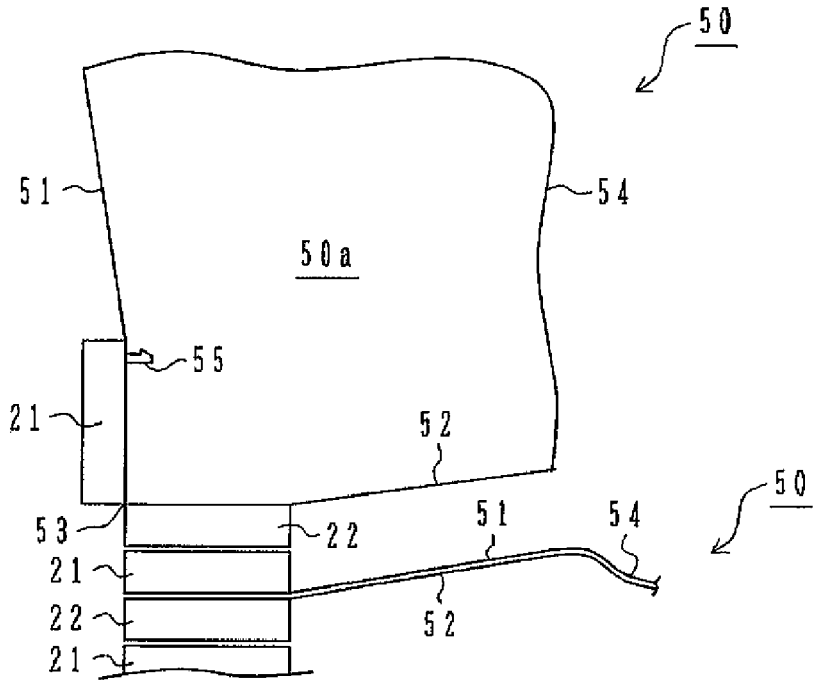
FIG. 21 is a schematic view showing a coupled state of the developing agent containers of FIG. 17.

Accordingly, in the developing agent container 50, when stored toner is consumed by the developing unit 12 and then there is a replenishing instruction from the apparatus body H side, as shown in FIG. 19, the flexible wall member 54 is deformed so that the storage space 50*a* may be crushed according to a decrease in the stored toner, and the rigid wall member 51 is rotated about the hinge 53 so that it may approach the rigid wall member 52 (the female opening 21 may approach the male opening 22). In this state, when the female opening 21 is rotated (depressed) about the hinge 53 so that it may be brought into facing contact with the male opening 22, the female locking pawl 55 on the side of the bottom face 21*a* is engaged with the male locking receptacle 56 on the side of the top face 22*a*, thereby making the developing agent container compact. Thereafter, as shown in FIG. 21, when a male opening 22 of an unused developing agent container 50 is coupled to the upper female opening 21, toner can be replenished through the communication ports 25 and 26 within the peripheral edges 23 and 24 of the lower female opening 21 and male opening 22 whose opening directions coincide with each other.

As described above, according to the present embodiment, in addition to the advantageous effects according to the above-mentioned embodiments, the developing agent container 50 can be put into a compactly stacked state by rotating the female opening 21 and the male opening 22 about the hinge 53 without any positional deviation therebetween. Also, it is possible to maintain a state where unused developing agent containers are continuously coupled together by locking the female locking pawl 55 to the male locking receptacle 56. Accordingly, even in a state where a plurality of developing agent containers 50 are coupled together, toner can be replenished to the developing unit 12 with high reliability.

Next, a seventh embodiment of the invention will be described.

Figure 22:
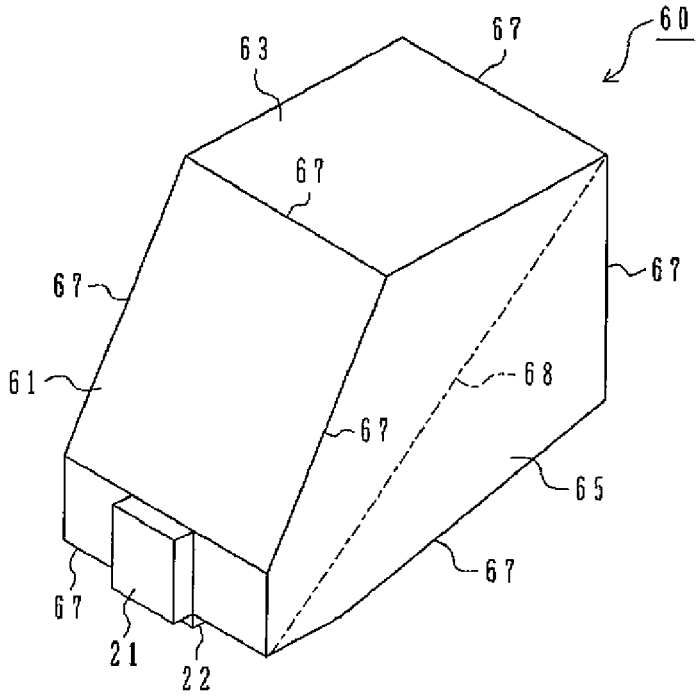
FIG. 22 is a perspective view showing a developing agent container according to a seventh embodiment of the invention.
Figure 23:
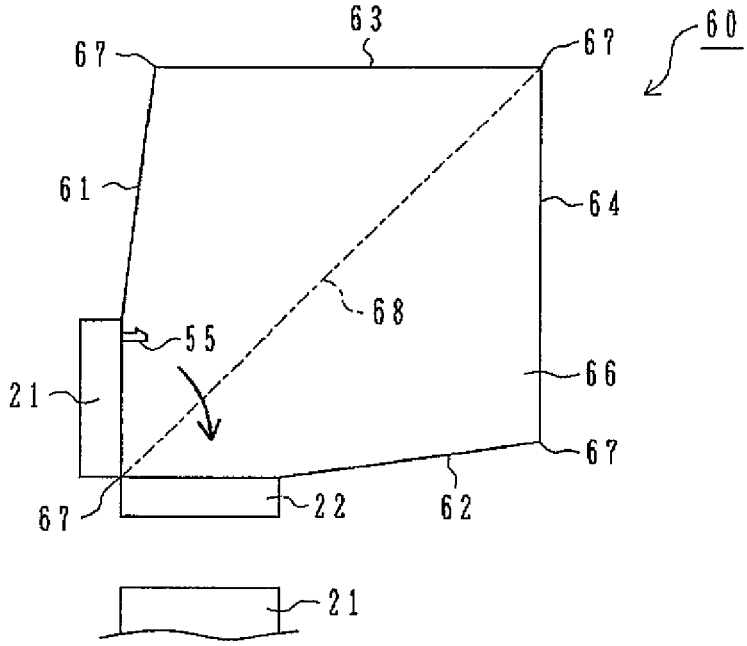
FIG. 23 is a schematic view showing a coupled and in-use state of the developing agent container of FIG. 22.

An image forming apparatus shown in FIGS. 22 and 23 is designed so that a plurality of stages of developing agent containers 60 can be set in the replenishing unit 13. In each of the developing agent containers 60, four flexible wall members 61 to 64 that are formed in almost the same shape as the shape of the bottom face of the set space 14 of the replenishing unit 13 and are made of a flexible sheet material, and a pair of expandable wall members 65 and 66 that are made of a flexible sheet material (a so-called elastic sheet material) that can be extended or retracted (refer to FIG. 24 for the expandable wall member 66) are coupled together via hinges 67, thereby defining a toner storage space 60*a* having a substantially hexahedral box shape. The flexible wall members 61 to 64 are connected between their lateral sides via the hinges 67 so as to define four faces that are continuous in one direction, while the expandable wall members 65 and 66 are connected via the hinges 67 that a portion surrounded by the flexible wall members 61 to 64 may be closed. In addition, since it is not necessary to perform rotation between the flexible wall member 62 and 64 and rotation between the expandable wall member 65 and 66 as will be described below, they may be connected to each other so as not to rotate.

Also, a thin straight hinge (folding line) 68 that connects between an end of the hinge 67 between the flexible wall members 61 and 62, and an end of the hinge 67 between the flexible wall members 63 and 64 is engraved in the expandable wall members 65 or 66, and the thin hinge is formed so that it can be bent.

Further, as for the flexible wall members 61 and 62, similarly to the above-mentioned embodiment, the female opening 21 and the male opening 22 are arranged in the places adjacent to the hinge 67. Specifically, the female opening 21 and the male opening 22 can maintain a state where, when they are brought into facing contact with each other, the female locking pawl 55 is engaged with and locked to the male locking receptacle 56, and thereby the communication ports 25 and 26 within the peripheral edges 23 and 24 coincide with each other.

Moreover, the parts of the flexible wall members 61 and 62 that are adjacent to the female opening 21 and the male opening 22 on the side opposite to the hinge 67 are bent. Specifically, the flexible wall member 62 on the side of the male opening 22 to be coupled to the developing unit 12 side, similarly to the above-mentioned embodiment, is set so that its part that is spaced from the male opening 22 may rise and the stored toner may flow down toward the communication port 26, while the flexible wall member 61 is bent in the direction opposite to the flexible wall member 62.

Figure 24:
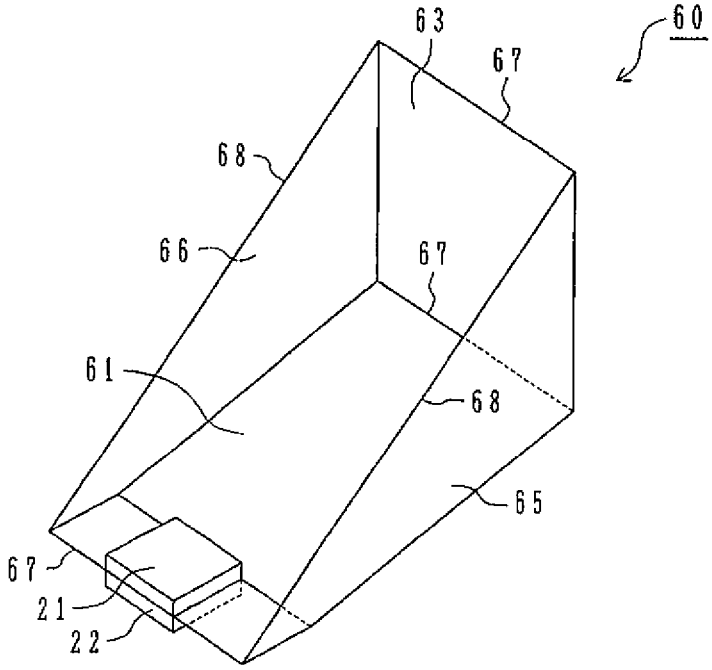
FIG. 24 is a perspective view showing a used state of the developing agent container of FIG. 22.

As a result, similarly to the above embodiment, when the stored toner within the storage space 60*a* is reduced as the toner slides on the top face of the flexible wall member 62, and is supplied to the developing unit 12 side through the communication port 26 within the peripheral edge 24 of the male opening 22, the flexible wall member 61, as shown in FIG. 24, can be brought into facing contact with the flexible wall member 62 (overlapping state) by pushing the flexible wall member 61 in a direction in which it approaches the flexible wall member 62, thereby rotating (bending) the flexible wall member 61 about the hinge 67.

At this time, the flexible wall members 61 and 63 and the flexible wall members 62 and 64 are rotated about the hinges 67 in the direction which they are widely opened while they expand the expandable wall members 65 and 66 (the hinge 67 between the flexible wall members 61 and 62 and the hinge 67 between the flexible wall member 63 and 64 are bent), and thereby they are deformed temporarily in a planar shape, and the hinges 68 within the expandable wall member 65 and 66 are bent. Thereafter, the flexible wall members 62 and 64 return to their original state, while the flexible wall members 61 and 63 are bent in a reverse direction and are deformed into a state where the inner faces thereof are brought into facing contact with the inner faces of the flexible wall members 62 and 64, respectively (the flexible wall member 61 is deformed into a shape that resembles the flexible wall member 62, and thereby brought into facing contact therewith). Simultaneously, in the female opening 21 and the male opening 22 on the side of the flexible wall members 61 and 62, similarly to the above-mentioned embodiments, the female locking pawl 55 is engaged with and locked to the male locking receptacle 56, thereby securing a flow path for the toner through the communication ports 25 and 26 within the peripheral edges 23 and 24.

Figure 25:
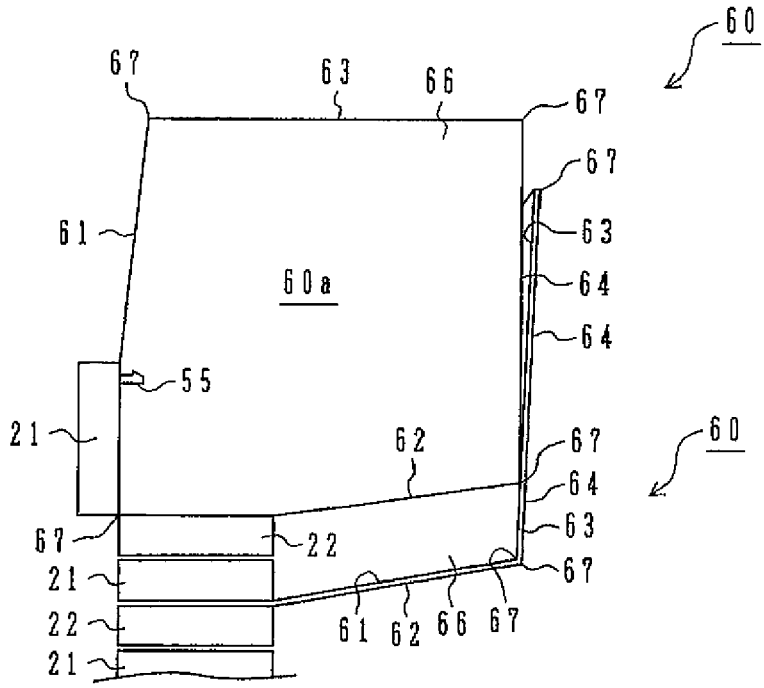
FIG. 25 is a schematic view showing a coupled state of the developing agent containers of FIG. 22.

Accordingly, in the developing agent container 60, when stored toner is consumed by the developing unit 12 and then there is a replenishing instruction from the apparatus body H side, as shown in FIG. 24, the flexible wall members 61 to 64 are brought into facing contact with each other so that the storage space 60*a* may be crushed, and the expandable wall members 65 and 66 are bent at the hinges 68, thereby making the developing agent container compact. Thereafter, as shown in FIG. 25, when a male opening 22 of an unused developing agent container 60 is coupled to the upper female opening 21, toner can be replenished through the communication ports 25 and 26 within the peripheral edges 23 and 24 of the lower female opening 21 and male opening 22 whose opening directions coincide with each other.

As described above, according to the present embodiment, in addition to the advantageous effects according to the above-mentioned embodiments, developing agent containers can be stacked compactly in a state where the wall members that define the storage space 60*a* of the developing agent container 60 do not spread but are folded. Accordingly, a plurality of developing agent containers 60 that are easy to handle can be easily coupled together, and thus their usability can be improved.

Next, an eighth embodiment of the invention will be described.

Figure 26:
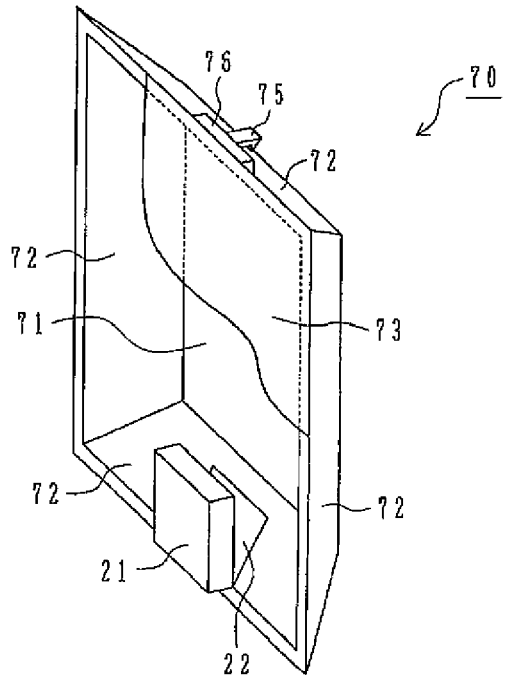
FIG. 26 is a perspective view showing a developing agent container according to an eighth embodiment of the invention.
Figure 27:
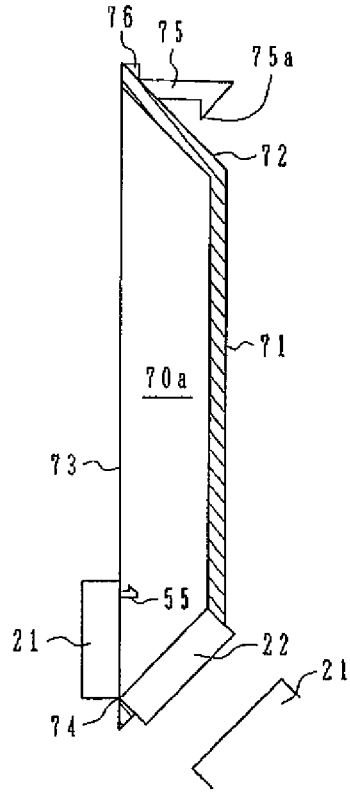
FIG. 27 is a section view of the developing agent container of FIG. 26.

An image forming apparatus shown in FIGS. 26 and FIG. 27 are designed so that a plurality of stages of developing agent containers 70 can be set by opening a front panel of the apparatus body H to open the set space 14 of the replenishing unit 13. The female opening 21 to be arranged at the conveyer 15 of the developing unit 12 is attached to the back side. of the container in a posture that is inclined so that it may face obliquely upward toward the opened front side of the set space 14.

On the other hand, the developing agent container 70 is formed in the shape of a rectangular bowl in which slope faces 72 that extend obliquely upward from lateral sides of a rectangular bottom face 71 are connected. A toner storage space 70*a* is closed by sticking a stretchable film 73 on peripheral open ends of the slope faces 72.

Figure 28:
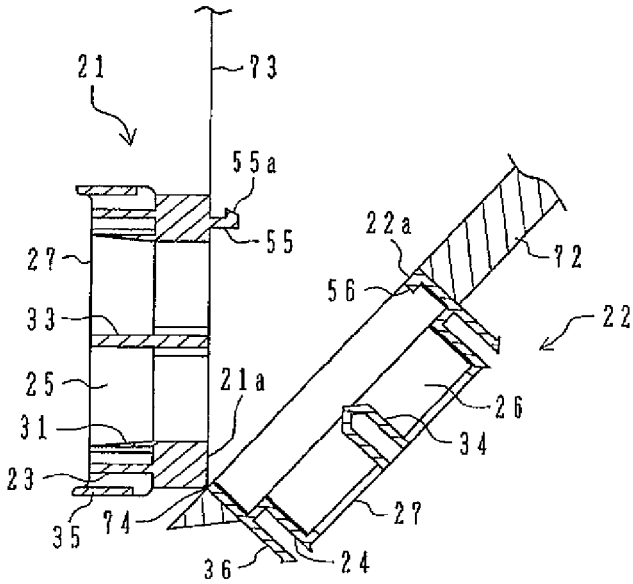
FIG. 28 is an enlarged section view showing configurations of a male opening and a female opening in the developing agent container of FIG. 26.

As for the developing agent container 70, as shown in FIG. 28, the male opening 22 that can be coupled to the female opening 21 on the side of the developing unit 12 is buried in a central part of one slope face 72 so that there may be no leak of the stored toner. Specifically, a hinge 74 is arranged at an end side of the slope face 72 so as to rotatably support the female opening 21, while the stretchable film 73 that closes the storage space 70*a* is stuck around the female opening 21 so that there may be no leak of the stored toner. Further, the female opening 21 and male opening 22, similarly to the above-mentioned embodiment, are connected to each other by the hinge 74 so that the bottom face 21*a* and the top face 22*a* may be brought into facing contact with each other. A female locking pawl 55 erected from the bottom face 21*a* is engaged with and locked to a male locking receptacle 56 that constitutes the top face 22*a*.

As a result, as for the developing agent container 70, similarly to the above-mentioned embodiment, the storage space 70*a* can be made to communicate through the communication ports 25 and 26 within the peripheral edges 23 and 24 to replenish the stored toner, by coupling the male opening 22 to the female opening 21 on the side of the developing unit 12 while cutting the sealing film 27.

Figure 29:
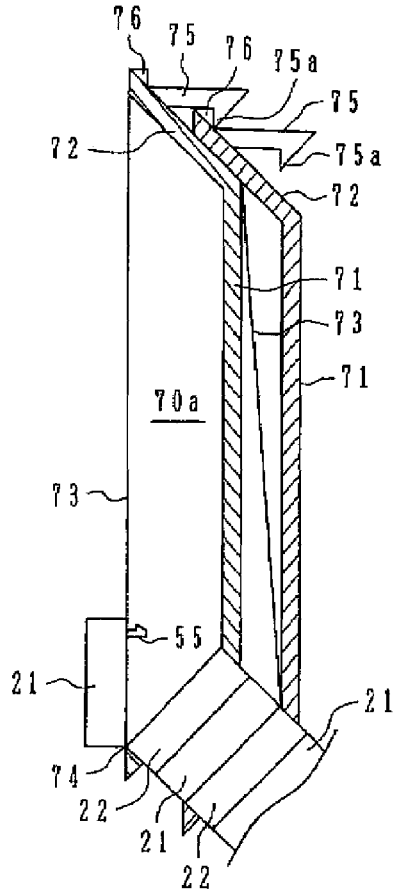
FIG. 29 is a section view showing a coupled state of the developing agent container of FIG. 26.

At this time, as shown in FIG. 29, when a male opening 22 of an unused developing agent container 70 is coupled to a female opening 21 of a used developing agent container 70, the female locking pawl 55 is engaged and locked to the male locking receptacle 56 by rotating the female opening 21 on the side of the used developing agent container about the hinge 74 in the direction in which the female opening is brought into facing contact to the male opening 22 in the storage space 70*a* while the stretchable film 73 that closes the storage space 70*a* is stretched. Thereby, the communication ports 25 and 26 within the peripheral edge 23 and 24 of the female opening 21 and the male opening 22 can be made to coincide with each other, thereby securing a flow path for toner. Thereafter, the male opening 22 on the side of the unused developing agent container can be coupled to the female opening 21 on the side of the used developing agent container by overlapping the bottom faces 71 and the slope faces 72 on the side of the unused and used developing agent containers, while the stretchable film 73 on the side of the used developing agent container is stretched similarly. That is, the bottom face 71 and slope faces 72 constitute rigid wall members that are difficult to deform and break, the sealing film 27 constitute a cut wall member that can be cut, and the stretchable film 73 constitute a cut wall member to be deformed.

Further, as for the developing agent container 70, the back side of the slope face 72 opposite to the hinge 74 is integrally molded with a locking mechanism (outer engaging member) that performs engaging and locking so that a state where the bottom face 71 and the slope faces 72 on the side of the used and unused developing agent containers overlap each other may be maintained. A locking pawl 75 that has a claw part 75*a* that projects inwardly is erected from the back side of the slope face 72. A locking receptacle 76 that projects outwardly is formed at an end side adjacent to the locking pawl 75 on the back side of the slope face 72.

As a result, when the male opening 22 is engaged with and locked to the female opening 21 by forcibly pushing the bottom face 71 of an unused developing agent container 70 while the stretchable film 73 of a used developing agent container 70 is stretched, the locking pawl 75 is elastically deformed by the end side of the slope face 72 and then elastically restored, even on the side opposite to the hinge. Thereby, the claw part 75*a* can be engaged with and locked to the locking receptacle 76. Accordingly, in the developing agent container 70, when stored toner is consumed by the developing unit 12 and then there is a replenishing instruction from the apparatus body H side, as shown in FIG. 29, the front side of the set space 14 of the replenishing unit 13 is opened, and then the female opening 21 is coupled to the male opening 22 while the stretchable film 73 on the side of the used developing agent container is stretched. Thereafter, the male opening 22 on the side of the unused developing agent container is coupled to the female opening 21 on the side of the used developing agent container. Thereby, the developing agent containers can be made compact by overlapping the bottom face 71 and the slope faces 72 on the side of the used and unused developing agent containers so that the storage space 70*a* on the side of the used developing agent container may be crushed. As a result, toner can be replenished through the communication ports 25 and 26 within the peripheral edges 23 and 24 of the female opening 21 and the male opening 22 whose opening directions coincide with each other.

As described above, according to the present embodiment, in addition to the advantageous effects according to the above-mentioned embodiments, toner can be replenished by opening the front side of the apparatus body H, and overlapping developing agent containers 70 to compactly connect and join them together. Accordingly, the degree of freedom in the layout on the side of the top face of the apparatus body H can be improved.

Next, a ninth embodiment of the invention will be described.

Figure 30:
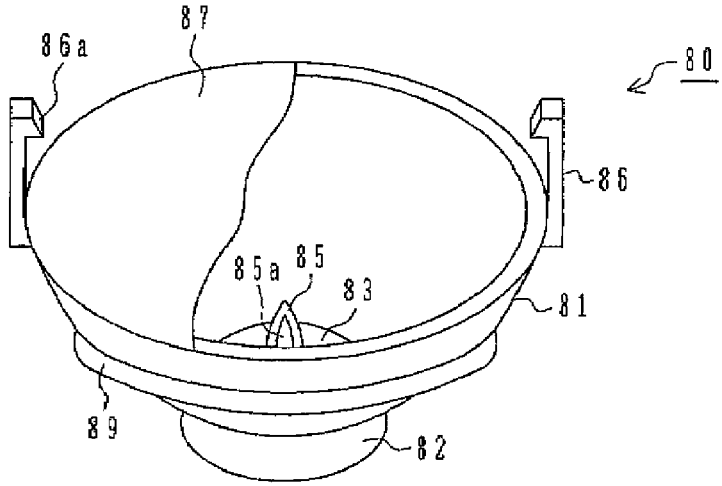
FIG. 30 is a perspective view showing a developing agent container according to a ninth embodiment of the invention.
Figure 31:
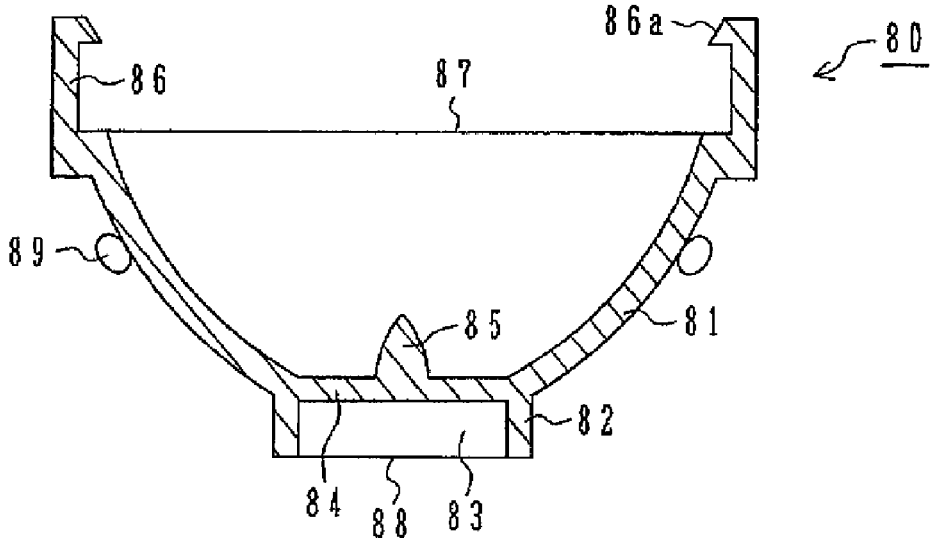
FIG. 31 is a section view of the developing agent container of FIG. 30.

An image forming apparatus shown in FIGS. 30 and 31 is designed so that a plurality of stages of developing agent containers 80 are set in the replenishing unit 13. Here, instead of the female opening 21, a hemisphere part 81 configured similarly to each of the developing agent containers 80 is attached to the upper portion of the conveyer 15 of the developing unit 12 in such a posture that its open end is directed upward so that the developing agent containers 80 can be set in an overlapping manner (refer to FIG. 33).

The hemisphere part 81 is designed such that a pedestal part 82 formed in the shape of a short cylinder is connected to the back side located opposite to the opening end, and the hemisphere part 81 is placed with the pedestal part 82 directed downward, and is thereby formed in the shape of a so-called bowl or vessel whose open end is directed upward so that a plurality of developing agent containers can be stacked on each other.

Figure 32:
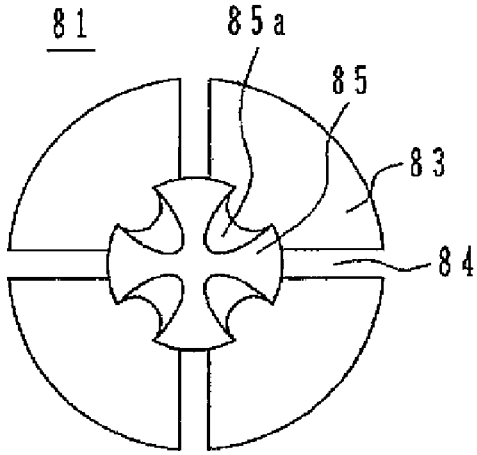
FIG. 32 is a plan view showing a coupled state of the developing agent containers of FIG. 30.

Further, in the hemisphere part 81, as shown in FIG. 32, a communication port 83 that allows communication of toner is opened within the pedestal part 82, and a cross member 84 is formed within the communication port 83. A needle member 85 having a substantially conical shape that projects inwardly of the hemisphere part 81 is erected in an intersecting position of the cross member 84, and a groove 85*a* that extends to a lower end from the top is formed in the peripheral face of the needle member 85.

Moreover, the hemisphere part 81 is formed integrally with locking mechanisms (outer engaging members) that perform engaging and locking so that a stacked state (refer to FIG. 33) may be maintained by directing the lower pedestal part 82 downward. Specifically, locking pawls 86, each of which extends upwardly from the outer face of the peripheral edge of the hemisphere part 81 and has a claw part 86*a* that project inwardly, are integrally formed in the opposed positions of the hemisphere part 81 with its center therebetween. In addition, although the case where a pair of locking pawls 86 are formed is described herein as an example, it goes without saying that locking pawls 86 are formed in three or more places.

As a result, by stacking the hemisphere part 81 so that the pedestal part 82 may be located at the bottom side, toner can be connected so that it can flow through the flow part 83 within the pedestal part 82. At this time, the stacked state can be maintained as the claw parts 86*a* of the locking pawls 86 are elastically deformed, then elastically restored, and thereby are engaged with and locked to the open end of the stacked hemisphere part 81.

Further, in the developing agent container 80, a stretchable sealing film 87 that can be stretched and cut is stuck on an outer peripheral opening end of the hemisphere part 81, and a sealing film 88 that can be cut is stuck on an opening end face of the pedestal part 82. Thereby, the opening end of the communication port 83 along with the opening end of the hemisphere part 81 is closed, thereby defining a storage space 80*a* that stores toner.

Moreover, a sealing member 89 that is made a rubber material and is brought into close contact to an inner peripheral face of a separate hemisphere part 81 so as to limit flow of toner when the pedestal part 82 is stacked in the separate hemisphere part 81 is installed in the outer peripheral face of the hemisphere part 81 of the developing agent container 80.

Figure 33:
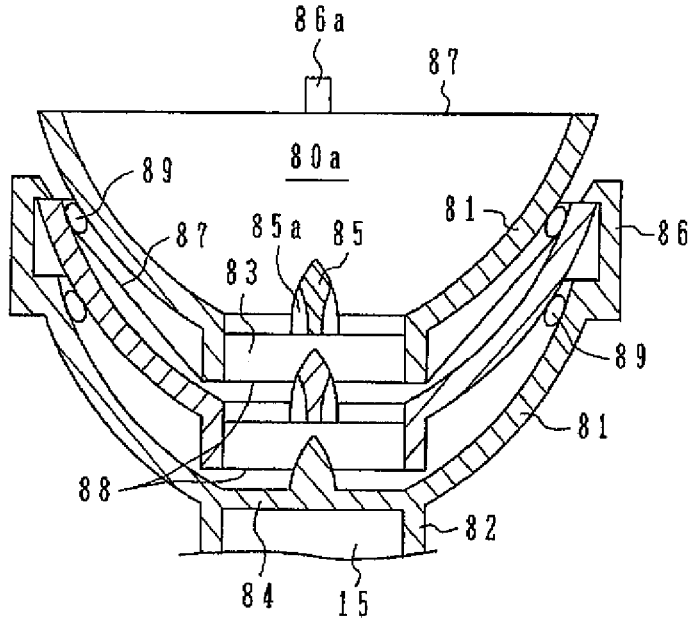
FIG. 33 is a section view showing the coupled state of the developing agent containers of FIG. 30.

As a result, in the developing agent container 80, as shown in FIG. 33, if the hemisphere part 81 is stacked in the hemisphere part 81 fixedly provided in the conveyer 15 of the developing unit 12, the needle member 85 will pierce the sealing film 88 of the pedestal part 82. Thereby, it is possible to establish opening and communication that allows the stored toner to be dropped downward at least through the groove 85*a* of the outer peripheral face of the needle member 85, and it is possible to establish coupling that secures a flow path that supplies the stored toner to the developing unit 12 side. Further, when an unused developing agent container 80 is stacked on a used developing agent container 80, the lower end of the pedestal part 82 is brought into pressure contact with the bottom face of the hemisphere part 81 by depressing the stretchable sealing film 87 on the side of the used developing agent container by the pedestal part 82 on the side of the unused developing agent container. Thereby, similarly, the needle member 85 on the side of the used developing agent container will pierce the stretchable sealing film 87 on the side of the used developing agent container and the sealing film 88 of the pedestal part 82 on the side of the unused developing agent container. As a result, it is possible to establish coupling so that the stored toner within the storage space 80*a* on the side of the unused developing agent container can be replenished to the developing unit 12 side.

At this time, the stretchable sealing film 87 of the used developing agent container 80 can maintain the storage space 80*a* on the side of the used developing agent container in a closed state by maintaining the state where the lower end of the pedestal part 82 of the unused developing agent container 80 is brought into pressure contact with the bottom face of the hemisphere part 81 on the side of the used developing agent container. Further, even if the cutting range of the stretchable sealing film 87 caused by piercing by the needle member 85 extends further outward than the periphery of the lower end of the pedestal part 82 that comes into pressure contact with the bottom face of the hemisphere part 81, and even if a developing agent container is stacked on the upper hemisphere part 81 of the conveyer 15 of the developing unit 12 (when the stretchable sealing film 87 does not exist), the sealing member 89 of the outer peripheral face of the hemisphere part 81 will come into pressure contact with the inner face of the other hemisphere part 81. Thereby, it is possible to avoid that the storage space 80*a* or the communication port 83 within the pedestal part 82 may be open to the outside.

Accordingly, in the developing agent container 80, when stored toner is consumed by the developing unit 12 and then there is a replenishing instruction from the apparatus body H side, as shown in FIG. 33, it is possible to establish engaging and locking in a compactly stacked state by the locking pawls 86 after the pedestal part 82 is pushed into the hemisphere part 81 so that it can be located in the hemisphere part. At this time, while the stretchable sealing film 87 of the opening end of the hemisphere part 81 is stretched, the stretchable sealing film 87 along with the sealing film 88 of the opening end of the pedestal part 82 is pierced by the needle member 85. Thereby, the storage space 80*a* can be coupled to the developing unit 12 side through the groove 85*a*, thereby replenishing the stored toner.

As described above, according to the present embodiment, in addition to the advantageous effects according to the above-mentioned embodiments, toner can be replenished by coupling storage spaces 80*a* together while developing agent containers 80 are stacked compactly like a vessel. Accordingly, a plurality of developing agent containers 80 can be easily coupled together.

Next, a tenth embodiment of the invention will be described.

Figure 34:
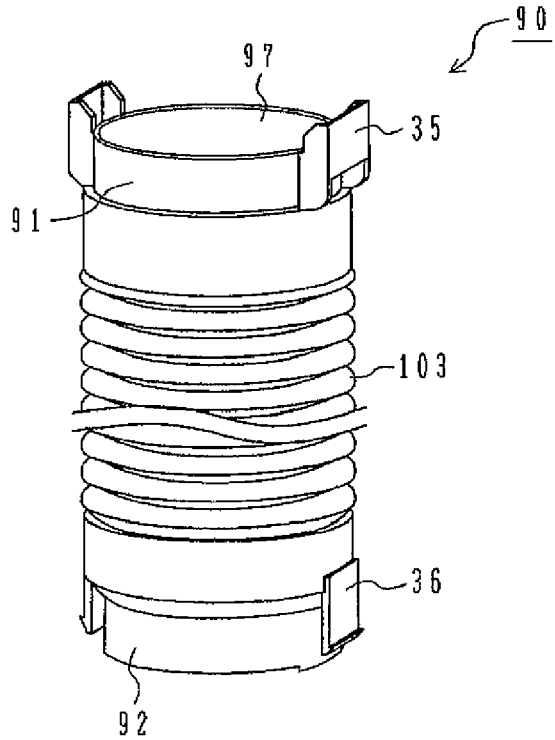
FIG. 34 is a perspective view showing a developing agent container according to a tenth embodiment of the invention.

An image forming apparatus shown in FIG. 34 is designed so that a plurality of stages of developing agent containers 90 are set in the replenishing unit 13. Here, similarly to the above-mentioned embodiment, instead of the female opening 21, a female opening 91 to be arranged at the upper portion of the developing agent container 90 is connected to the upper portion of the conveyer 15 of the developing unit 12 so that the developing agent containers 90 can be set. Thereby, a lower male opening 92 of the developing agent container 90 can be coupled to the female opening 91.

Figure 35A:
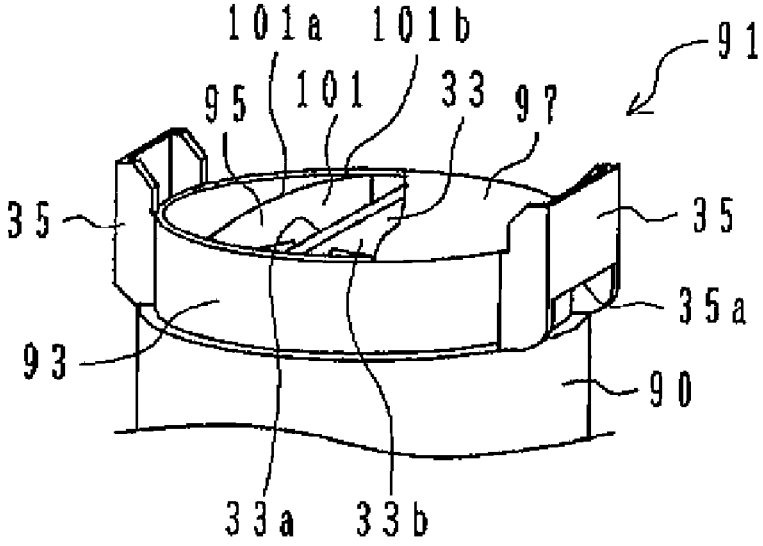
FIG. 35A is a perspective view showing a female opening provided in an upper part of the developing agent container of FIG. 34.
Figure 35B:
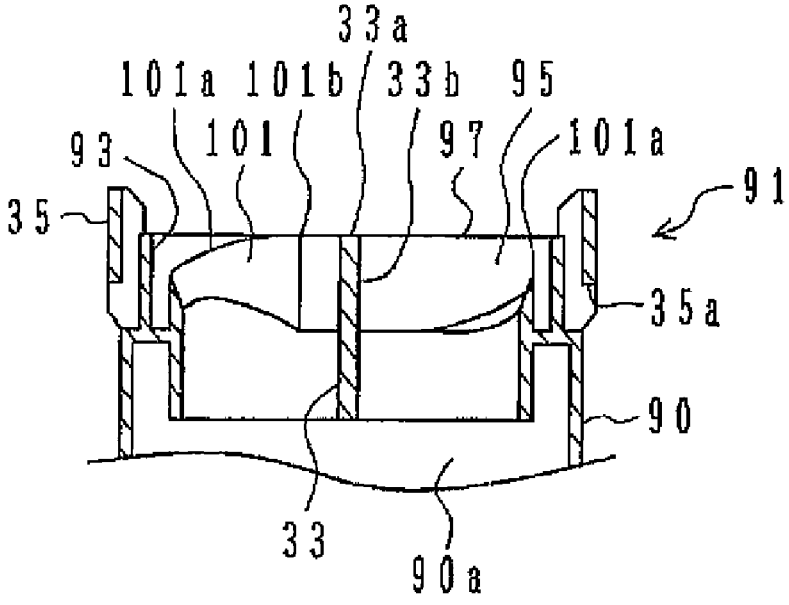
FIG. 35B is a section view of the female opening provided in the upper part of the developing agent container of FIG. 34.
Figure 36A:
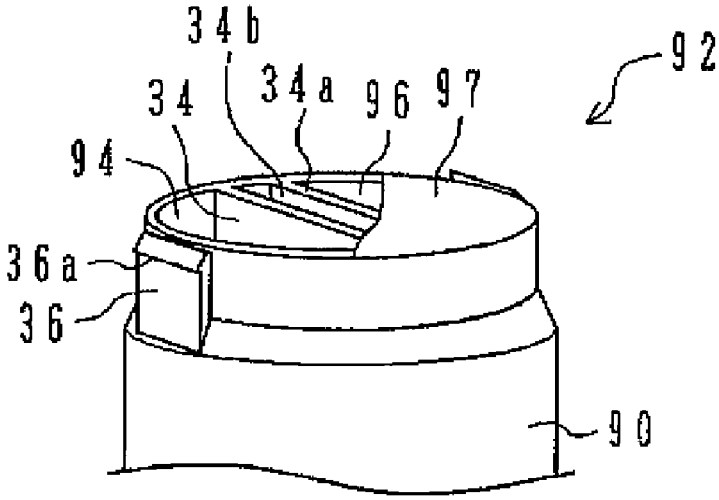
FIG. 36A is a perspective view showing a male opening provided in a lower part of the developing agent container of FIG. 34.
Figure 36B:
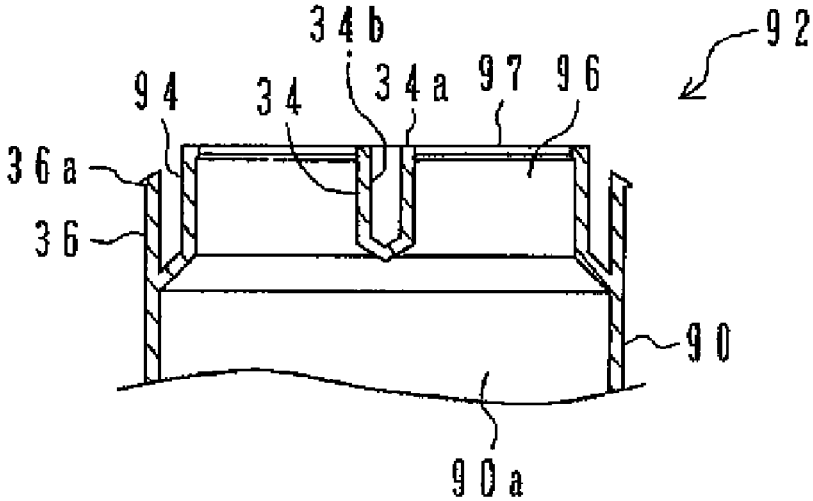
FIG. 36B is a section view of the male opening provided in the lower part of the developing agent container of FIG. 34.
Figure 39:
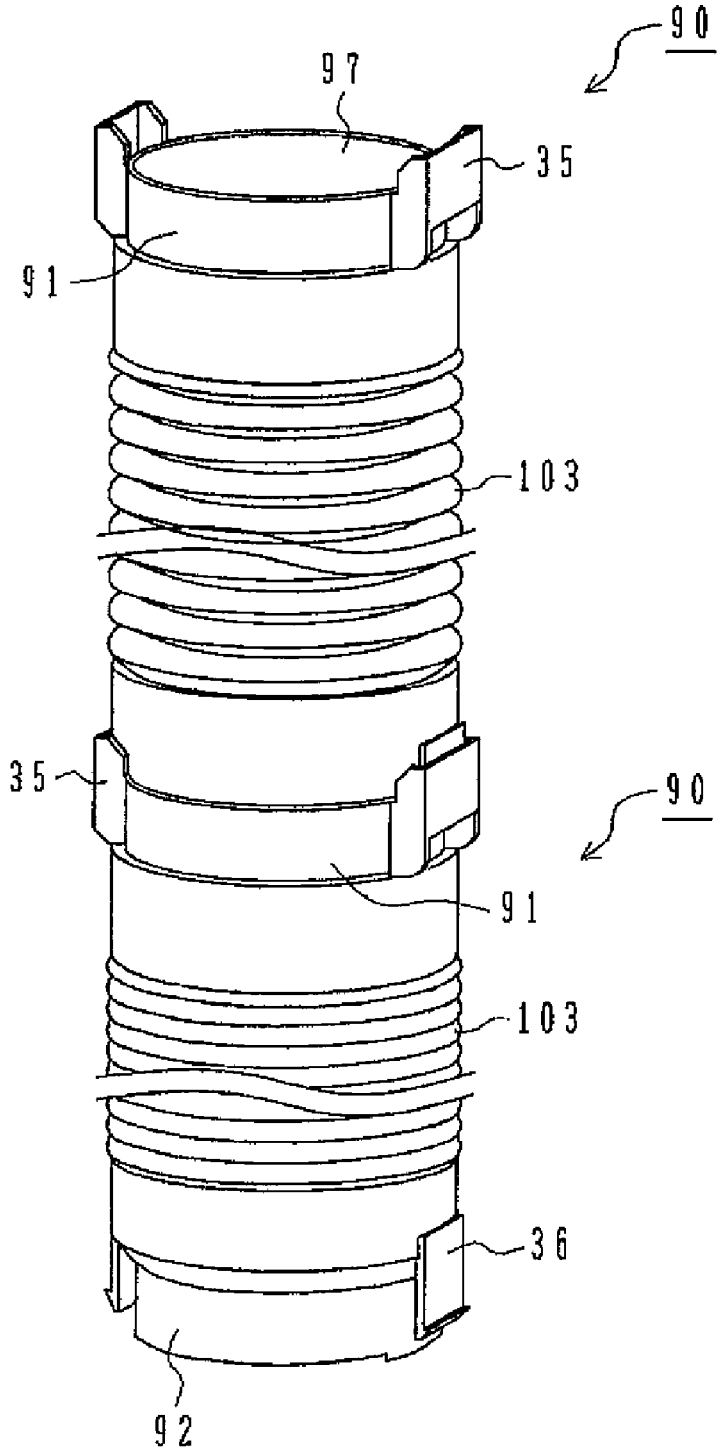
FIG. 39 is a perspective view showing a coupled state of the developing agent containers of FIG. 34.

As for the female opening 91, as shown in FIGS. 35A and 35B, a communication port 95 that allows flow of toner is opened in a peripheral edge 93 formed in a cylindrical shape. In the male opening 92, as shown in FIGS. 36A and 36B, a communication port 96 is opened in a peripheral edge 94 formed in a cylindrical shape. By setting the inner diameter of the peripheral edge 93 of the female opening 91 to almost the same dimension as the outer diameter of the peripheral edge 94 of the male opening 92, for example, as shown in FIG. 39, the peripheral edge 94 of the male opening 92 located at the upper portion can be fitted into the peripheral edge 93 of the female opening 91 located at the lower portion in a state where they come into face contact with each other while they are brought into slide contact with each other. That is, similarly to the female opening 21 and the male opening 22 of the above-mentioned embodiment, the female opening 91 and the male opening 92 are designed as a pair of male and female structures that can be coupled together so that the stored toner can be caused to flow in or flow out (flow) by allowing the toner to be dropped without leakage through the common communication ports 95 and 96.

As for the female opening 91 and the male opening 92, sealing films 97 are stuck on the opening end faces of the peripheral edges 93 and 94 so that the communication ports 25 and 26 may be closed. The sealing films 97 are designed such that they are cut by a cutter 101 within the peripheral edge 93 on the side of the female opening 91, and are wound so as to be sandwiched between the insertion member 33 within the peripheral edge 93 of the female opening 91 and the sheathing member 34 within the peripheral edge 94 of the male opening 92 so that the communication ports 25 and 26 can be opened.

Specifically, the insertion member 33 is integrally molded with the inner face of the peripheral edge 93 so as to transverse the communication port 95. On the other hand, the sheathing member 34 is integrally molded with the inner face of the peripheral edge 94 so as to transverse the communication port 96. The sheathing member 34 is so opened as to be able to accommodate the insertion member 33 of the female opening 91.

Further, a pair of cutters 101 that extend toward side faces 33*b* of the insertion member 33 from the vicinity of the left end along the inner peripheral face of the peripheral edge 93 to the vicinity of the opposite right end are integrally formed in the female opening 91. Each of the cutters 101 is erected so that it may take such a posture that a cutting blade 101*a* formed in the shape of a thin blade so that the sealing film 97 can be cut faces the outside of the opening direction of the communication port 95 of the female opening 91. The left end of the cutting blade 101*a* is formed at an acute angle toward the side face 33*b* of the insertion member 33 to form a blade edge 101*a* that starts the cutting of the sealing film 97. That is, the cutter 101 is formed in the symmetry of revolution so that the sealing film 97 may be cut in the same circumferential direction along the vicinity of the inner peripheral face of the peripheral edge 93 of the female opening 91.

As a result, when the peripheral edges 93 and 94 of the female opening 91 and the male opening 92 are fitted and connected to each other, and when they begins to fit to each other so as to be put in a closed state while the opening ends of the peripheral edges 93 and 94 are caused to face each other to stretch the sealing film 97, blade edges 101*b* of the cutters 101 will pierce two places in the vicinity of the radial inner faces in the peripheral edges 93 and 94 to start cutting of the sealing films 97 that close the opening end faces of the communication ports 95 and 96 in the peripheral edges 93 and 94. Further, when the degree of fitting of the peripheral edges 93 and 94 increases, the cutting blades 101*a* continue the cutting along the inner faces of the peripheral edges 93 and 94, thereby extending the cutting range. Also, as the sealing films 97 are sandwiched and towed between the insertion member 33 and the sheathing member 34 within the peripheral edges 93 and 94 of the female opening 91 and the male opening 92 concurrently with the cutting by the cutters 101, they are folded up compactly, thereby opening the communication ports 95 and 96 within the peripheral edges 93 and 94.

Figure 37:
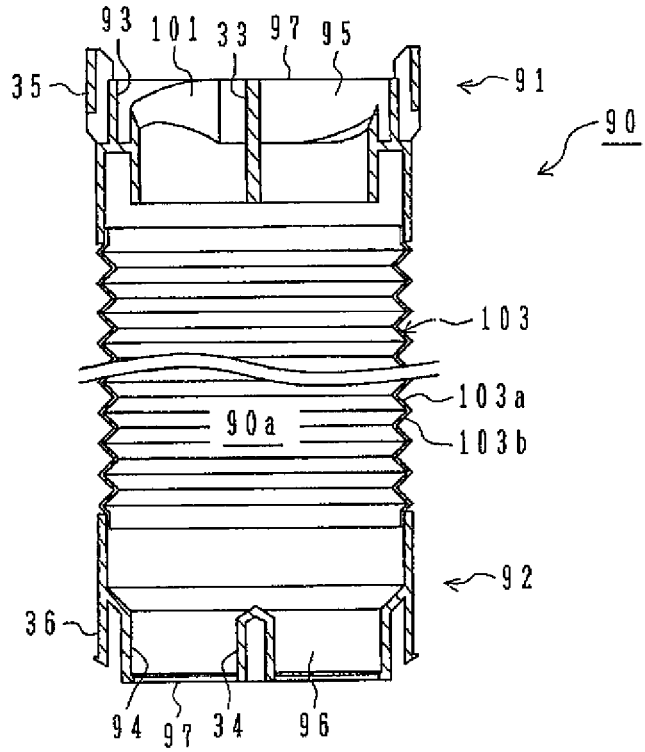
FIG. 37 is a section view showing a pre-used state of the developing agent container of FIG. 34.
Figure 38:
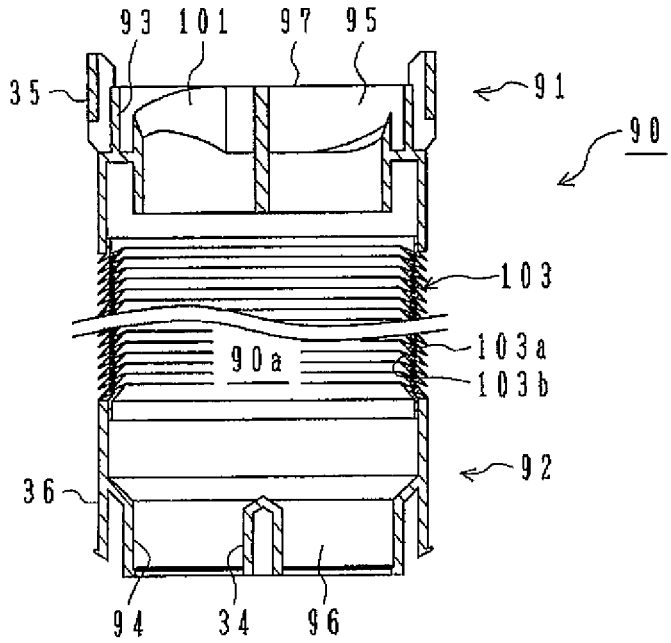
FIG. 38 is a section view showing a used state of the developing agent container of FIG. 34.

Moreover, the female opening 91 and male opening 92 are connected to both ends of a cylindrical bellows member 103 to constitute the developing agent container 90, and a storage space 90*a* that stores toner is defined within the bellows member 103. As for the bellows member 103, as shown in FIG. 37, in its expanded state, the female opening 91 and the male opening 92 are spaced as much as possible from each other, thereby defining a large volume of storage space 90*a*. On the other hand, as shown in FIG. 38, in the contracted state of the bellows member, the female opening 91 and the male opening 92 approach each other as much as possible, and thereby the volume of the storage space 90*a* can be reduced. At this time, the bellows member is designed so that a lower slope member 103*b* is deformed so as to enter an upper slope member 103*a* of the bellows member 103 and is facing brought into facing contact therewith may be maintained. That is, in the bellows member 103, the upper slope member 103*a* and the lower slope member 103*b* themselves constitute an inner engaging member that engages the female opening 91 with the male opening 92 while they approach each other.

Further, as for the female opening 91 and the male opening 92, similarly to the above-mentioned embodiment, the female locking receptacles 35 and the male locking pawls 36 are integrally formed at the outside of the peripheral edges 93 and 94. When the female opening 91 and the male opening 92 are coupled together, the male locking pawls 36 enters the corresponding female locking receptacle 35 and lock to them so that they may not pulled out of the locking receptacles, thereby maintaining the coupled state.

Accordingly, as for the developing agent container 90, when stored toner is consumed by the developing unit 12 and then there is a replenishing instruction from the apparatus body H side, as shown in FIG. 39, the stored toner can be replenished to the developing unit 12 side by coupling a lower male opening 92 of an unused developing agent container 90 to an upper female opening 91 of a used developing agent container 90. Also, the upper unused developing agent container 90 can be pressed downward to deform and contract the bellows member 103 of the lower used developing agent container 90 so that the lower slope member 103*b* enters the upper slope member 103*a*. As a result, it is possible to realize stacking in a compactly compressed state where the storage space 90*a* is reduced. Here, the whole bellows member 103 vibrates when it expands and contracts, so that the toner adhering to the inner face of the bellows member can be dropped.

As described above, according to the present embodiment, similarly to the advantageous effects according to the above-mentioned embodiments, the stored toner within the storage space 90*a* can be replenished to the developing unit 12 side by coupling developing agent containers 90 together. Also, developing agent containers can be stacked compactly by contracting the bellows member 103 that defines the storage space 90*a*. Accordingly, toner can be replenished from a plurality of developing agent containers 90 to the developing unit 12 while the volume of the set space 14 of the replenishing unit 13 is designed compactly.

Figure 40:
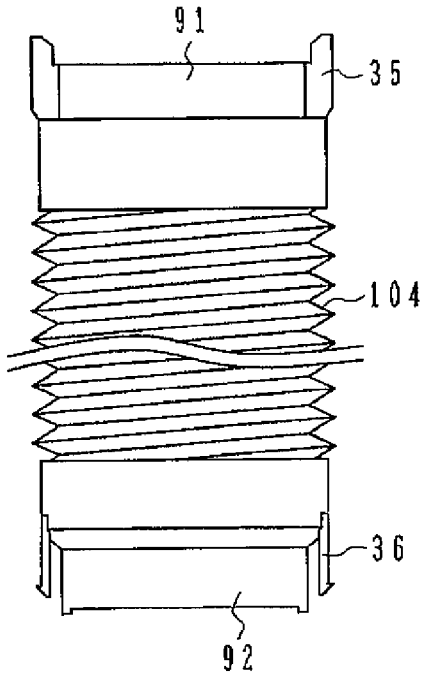
FIG. 40 is a side view showing a modified example of the developing agent container of FIG. 34.

Although the bellows member 103 in which a bellows shape extends within the same circle is used in the present embodiment, for example, as shown in FIG. 40, the female opening 91 and male opening 92 may be connected to both ends of a cylindrical bellows member 104 formed in a spiral shape. In this case, when the storage space 90*a* is compressed for contraction, the stored toner adhering to the inner face of the bellows member 104 is caused to slide downward and is replenished to the developing unit 12 side, even by the circumferential vibration generated when the storage space is compressed.

Further, although the case where the cylindrical female opening 91 and the cylindrical male opening 92 are connected to the similarly cylindrical bellows member 103 is described as an example in the present embodiment, it goes without saying that the invention is not limited thereto, and for example, bellows members of other shapes, such as a rectangular shape, may be adopted, and the substantially rectangular female opening 21 and male opening 22 in the above-mentioned embodiment may be connected to the bellow member.

Next, an eleventh embodiment of the invention will be described.

Figure 41:
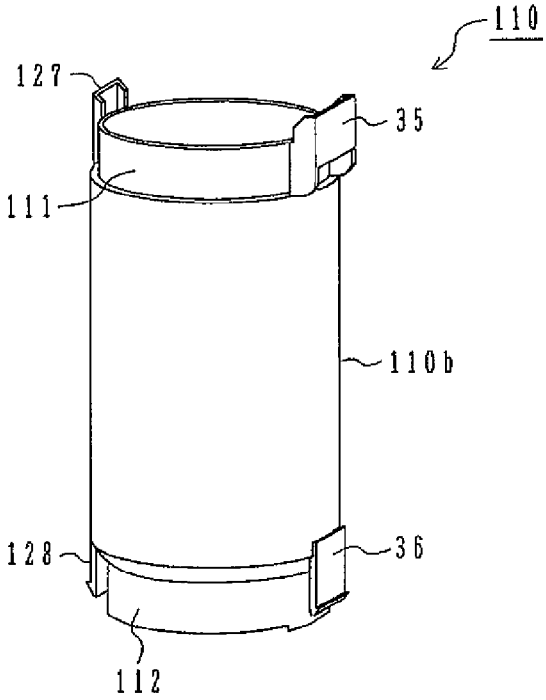
FIG. 41 is a perspective view of a developing agent container according to an eleventh embodiment.

An image forming apparatus shown in FIG. 41 is designed so that a plurality of stages of developing agent containers 110 are set in the replenishing unit 13. In each of the developing agent containers 110, a female opening 111 is connected to an upper portion of a wall member 111*b* formed in a simple cylindrical shape, while a male opening 112 is connected to a lower portion of the wall member, thereby defining a storage space 110*a* that stores the toner to be supplied to the developing unit 12. Further, similarly to the above-mentioned embodiment, instead of the female opening 21, a female opening 111' manufactured substantially similarly to the upper female opening 111 of the developing agent container 110 is connected to the upper portion of the conveyer 15 of the developing unit 12 so that the developing agent container 110 can be set. Thereby, the lower male opening 92 of the developing agent container 110 can be coupled to the female opening 111'. In addition, since the upper female opening 111' of the conveyer 15 of the developing unit 12 may have a communication port that is left wide open without opening and closing the inside of the peripheral edge 113, shutter members 121 to 123 as will be described below may be omitted.

Figure 42:
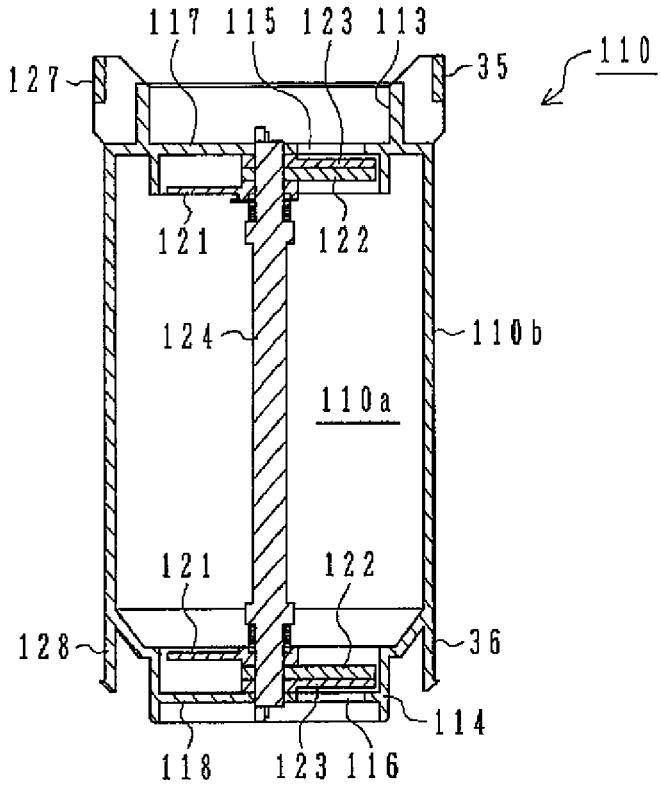
FIG. 42 is a section view of the developing agent container of FIG. 41.

As for the female opening 111, as shown in FIG. 42, a shielding plate 117 is connected within the peripheral edge 113 formed in a cylindrical shape, and an openable and closable communication port 115 is formed within the shielding plate 117 so as to permit or limit flow of toner. Further, similarly, as for the male opening 112, a shielding plate 118 is connected within a peripheral edge 114 formed in a cylindrical shape, and an openable and closable communication port 116 is formed within the shielding plate 118 so as to permit or limit flow of toner. By setting the inner diameter of the peripheral edge 113 of the female opening 111 to almost the same dimension as the outer diameter of the peripheral edge 114 of the male opening 112, the peripheral edge 114 of the male opening 112 located at the upper portion can be fitted into the peripheral edge 113 of the female opening 111 located at the lower portion in a state where they come into face contact with each other while they are brought into slide contact with each other, so that the communication ports 115 and 116 may coincide with each other. That is, similarly to the female opening 21 and the male opening 22 of the above-mentioned embodiment, the female opening 111 and the male opening 112 are designed as a pair of male and female structures that can be coupled together so that the stored toner can be caused to flow in or flow out (flow) by allowing the toner to be dropped without leakage through the common communication ports 115 and 116.

Figure 43A:
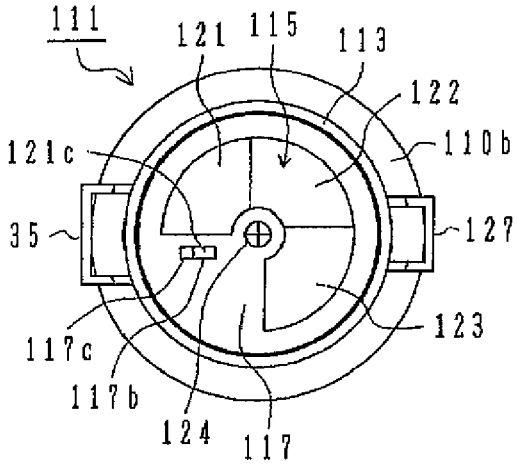
FIG. 43A is a plan view showing a female opening in the developing agent container of FIG. 41.
Figure 43B:
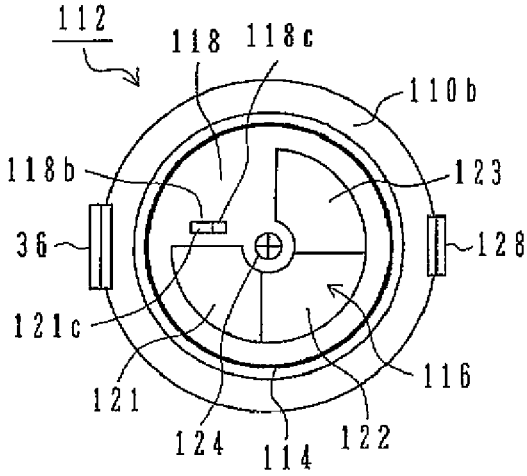
FIG. 43B is a plan view showing a male opening in the developing agent container of FIG. 41.

As shown in FIGS. 43A and 43B, the communication ports 115 and 116 of the female opening 111 and the male opening

Figure 44:
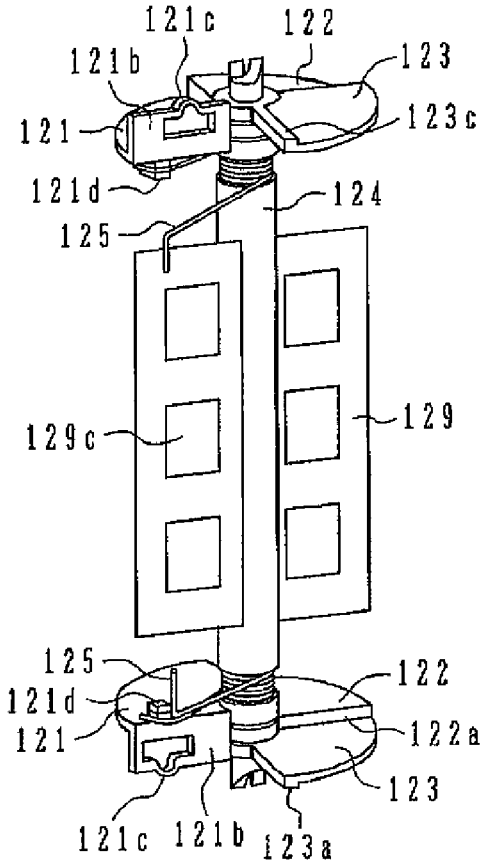
FIG. 44 is a perspective view showing an internal configuration of the developing agent container of FIG. 41.

112 are formed so that they may be opened in the shape of 314 sectors in the circumferential direction with the center of the circular peripheral edges 113 and 114 being a common center within the shielding plates 117 and 118. Further, in the female opening 111 and the male opening 112, as shown in FIG. 44, shutter members 121 to 123 as small-piece members formed in the shape of ¼ sector in the same circumferential direction are coupled to a shaft member 124 rotatably installed in the center (sector center) of the back side of the shielding plate 117 or 118 (inside the storage space 110*a*). When these shutter members 121 to 123 continuously rotate in the forward and backward directions, they are designed to advance and retreat from the back side of the shielding plate 117 or 118 so as to open and close the communication port 115 or 116. That is, the shutter members 121 to 123 can be opened and closed while opening the communication port 115 or 116 with a large area within the shielding plate 117 or 118 by forming them as small-piece members in the shape of an about ¼ sector in the circumferential direction, and overlapping them on the back side of the shielding plates 117 or 118.

Figure 45:
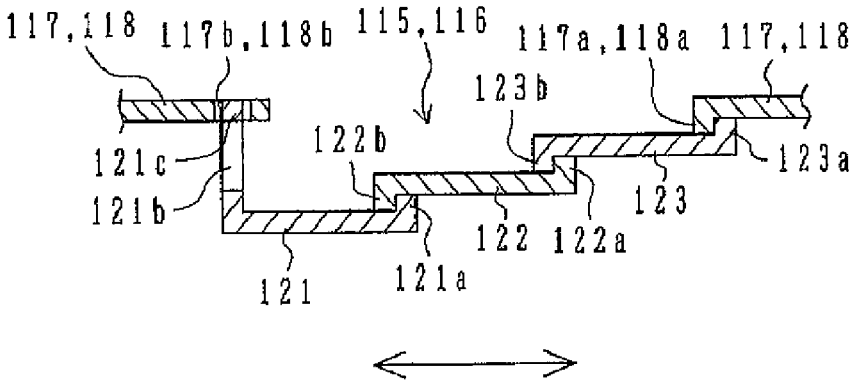
FIG. 45 is an enlarged section view showing shutter members in the developing agent container of FIG. 41.

As for the shutter members 121 to 123, as shown in FIG. 45, the shutter member 123 is coupled to the shaft member 124 so as to face the back side of the shielding plate 117 or 118, the shutter member 122 is coupled to the shaft member so as to face the shutter member 123, and the shutter member 121 is coupled to the shaft member 124 so as to face the shutter member 122 The shutter members 121 to 123 are designed to close the communication port 115 or 116 of the female opening 111 or the male opening 112 when they are sequentially pulled out from the back side of the shielding plate 117 or 118 and to open the communication port 115 or 116 when they are rotationally moved in the opposite direction. In addition, FIG. 45 is a sectional view when the shutter members 121 to 123 and the shielding plate 117 or 118 are cut in the circumferential direction using the shaft member 124 as the center.

Specifically, ribs 122*a* and 123*a* are erected from trailing edges of the shutter members 122 and 123 in their pullout direction from the back side of the shielding plate 117 or 118 so as to face the outer face side, and ribs 122*b* and 123*b* are erected from leading edges opposite to the trailing edges so as to face the inner face side (within the storage space 110). Further, similarly, a rib 121*a* is erected from a trailing edge of the shutter member 121 so as to face the outer face side, but a rib 121*b* is erected from a leading edge opposite to the trailing edge so as to face the same outer face side.

In contrast, rib 117*a* or 118*a* is erected from the shielding plate 117 or 118 on the back side of the edge of the communication port 115 or 116 corresponding to the trailing edge of the shutter member 123 in its pullout direction so as to face the storage space 110*a*.

As a result, when the shutter member 123 is rotated in the pullout direction from the back side of the shielding plate 117 or 118, the rib 123*a* of the outer face of the trailing edge of the shutter member is hit and stopped by the rib 117*a* or 118*a* of the back side of the shielding plate 117 or 118, thereby limiting that the communication port 115 or 116 may be opened. Further, when the shutter member 121 or 122 is rotated in the pullout direction from the back side of the shielding plate 117 or 118, the rib 121*a* or 122*a* of the outer face of the trailing edge of the shutter member is hit and stopped by the rib 122*b* or 123*b* of the inner face of the leading edge of the shutter member 122 or 123 and thus spaced from the leading edge of the shutter member 122 or 123, thereby limiting that the communication port 115 or 116 may be opened.

Further, the rib 121*b* of the leading edge of the shutter member 121 is formed with the same height (height to the back side of the shielding plate 117 or 118) as the thickness when the shutter members 122 and 123 are stacked on each other. In this case, when the shutter member 121 is rotated in a direction opposite to the pullout direction from the back side of the shielding plate 117 or 118, the shutter member can return to the back side of the shielding plate 117 or 118 while it hits the tip ends of the shutter members 122 and 123, to make them overlap each other.

Also, the shutter members 122 and 123 are rotatably coupled to both the shielding plates 117 or 118 and the shaft member 124. The shutter member 121 is rotatably coupled to both the shielding plate 117 or 118 and the shaft member 124 similarly on the side of the female opening 111, whereas the shutter member is connected such that it may be rotatable to the shielding plate 117 or 118 and may not be rotatable relative to the shaft member 124, on the side of the male opening 112. The shutter member 121 is biased in a direction in which it returns to the back side of the shielding plates 117 or 118 by a torsion spring (biasing member) 125 that is installed so as to be locked to a projection 121*d* erected from the back side (inner face) of the shutter member and a projection (not shown) erected from the inner face of the wall member 110*b*. That is, the shutter member 121 is always biased in a direction in which it is pulled back to the back side of the shielding plate 117 or 118 along with the shutter members 122 and 123, in other words, in a direction in which the communication port 115 or 116 within the shielding plate 117 or 118 is opened.

For this reason, the rib 121*b* of the leading edge of the shutter member 121 is formed with a projection 121*c* that projects outwardly from the upper end. In contrast, the edge of the communication ports 115 or 116 of the shielding plates 117 or 118 is formed with a locking hole 117*b* or 118*b* that houses the projection 121*c* of the shutter member 121 that limits the rotation of the shutter member in the opening direction from the closed state by the biasing force of the torsion spring 125. Further, projections 118*c* or 117*c* that projects so as to be inserted into the facing locking hole 117*b* or 118*b* when the peripheral edges 113 and 114 of the female opening 111 and the male opening 112 are fitted and connected to each other is erected from the outer face adjacent to the locking hole 117*b* or 118*b*.

Figure 46:
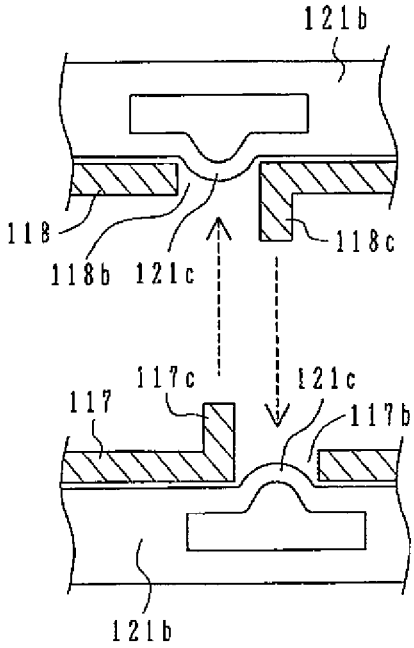
FIG. 46 is an enlarged section view showing a structure for releasing an opening limit performed by the shutter members.
Figure 47A:
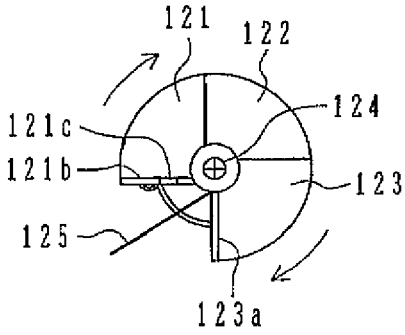
FIG. 47A is a plan view showing an opening operation of the shutter members in the female opening of FIG. 43B.
Figure 47B:
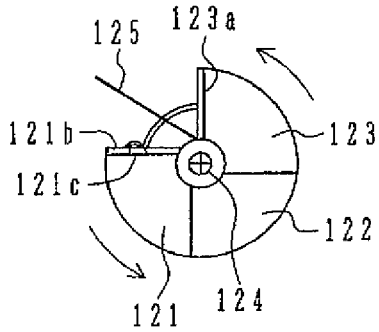
FIG. 47B is a plan view showing an opening operation of the shutter members in the male opening of FIG. 43B.

As a result, the shutter member 121 maintains a state of closing the communication port 115 or 116 against the biasing force of the torsion spring 125 since the projection 121*c* of the upper end of the rib 121*b* of the leading edge of the shutter member is housed into and locked to the locking hole 117*b* or 118*b* of the edge of the communication port 115 or 116 of the shielding plate 117 or 118. Further, as for the shutter member 121, as shown in FIG. 46, when the peripheral edges 113 and 114 of the female opening 111 and the male opening 112 are fitted into and connected to each other, the projections 118*c* and 117*c* of the shielding plates 117 and 118 are inserted into the facing locking holes 118*b* and 117*b*, and the projection 121*c* of the upper end of the rib 121*b* is depressed toward the inner face (toward the storage space 110*a*), thereby cancelling the locking. Thereby, as FIGS. 47A and 47B, the shutter member 121 along with the shutter members 122 and 123 is pulled back to the back side of the shielding plates 117 and 118 by the biasing force of the torsion spring 125, thereby opening the communication ports 115 and 116 within the shielding plates 117 and 118. That is, the projection 121*c* of the upper end of the rib 121*b* of the shutter member 121 and the locking holes 117*b* and 118*b* of the shielding plates 117 and 118 serve as a limiter, and the projections 117*c* and 118*c* of the shielding plates 117 and 118 serve as a releaser. Here, although the present embodiment is configured such that the projection 121*c* on the side of the shutter member 121, and the projections 117*c* and 118*c* on the side of the shielding plates 117 and 118 are struck directly, it goes without saying that a structure that the projections are interconnected indirectly with a separate member therebetween may be adopted.

Further, as for the female opening 111 and the male opening 112, the female locking receptacle 35 and the male locking pawl 36 are formed in the outer places of the peripheral edges 113 and 114 adjacent to the locking holes 117*b* and 118*b* or projections 117*c* and 118*c* of the shielding plates 117 and 118. On the side opposite to the locking receptacle and claw, a female locking receptacle 127 and a male locking pawl 128 that are made narrower than the female locking receptacle 35 and the male locking pawl 36 are formed.

As a result, the male locking pawl 36 cannot be locked to the female locking receptacle 127. Thus, when the female opening 111 and the male opening 112 are connected to each other, the relative direction of the peripheral edges 113 and 114 is limited so that the locking hole 117*b* or 118*b* and projection 117*c* or 118*c* of the shielding plates 117 and 118 may located in mutually facing positions. Also, the female opening and male opening can be joined together in a posture where the communication ports 115 and 116 of the shielding plates 117 and 118 coincide with each other.

Here, although the direction in which the female opening 111 and the male opening 112 are coupled together by making the female locking receptacle 127 and the male locking pawl 128 narrower than the female locking receptacle 35 and the male locking pawl 36 is limited in the present embodiment, it goes without saying that the invention is not limited thereto. For example, it goes without saying that thicknesses can be changed so that they can be combined together or that ribs and grooves may be formed so that they may be combined together.

Moreover, a pair of agitators 129 that extend parallel to each other and that has a plurality of openings 129*a* formed therein are fixedly provided in the circumferential symmetrical positions of the outer peripheral face between the innermost shutter members 121, in the shaft member 124 that couples the shutter members 121 to 123 of the female opening 111 and the male opening 112. The agitators 129 rotate within the storage space 110*a* in an interlocking manner with the rotation of the shaft member 124. That is, the shaft member 124 constitutes an extending member, and the agitators 129 constitute projecting members.

As a result, when the lower male opening 112 of the developing agent container 110 is connected to the female opening 111 on the side of the developing unit 12 (the upper portion of the conveyer 15 or used developing agent container 110), the closing lock of the communication ports 115 and 116 by the shutter members 121 to 123 is released automatically in an interlocking manner with the connecting operation. Thereby, the shutter member 121 rotates together with the shutter members 122 and 123 about the shaft member 124 by the biasing force of the torsion spring 125 to open the communication ports 115 and 116, and simultaneously, the shaft member 124 that rotates integrally with the shutter member 121 is caused to rotate so that the agitators 129 that extend from the outer peripheral face of the shaft member may be twirled. At this time, since the shutter member 121 is coupled to the shaft member 124 so as to be rotatable relative to the shaft member on the side of the female opening 111 to which the male opening 112 is not coupled, even if the shaft member 124 rotates, the shutter member 121 is not biased in the opening direction of the communication ports 115 and 116 even under the influence of the rotation of the shaft member, and the rotation of the agitators 129 that are connected to the shaft member 124 is not limited. For this reason, when a lower male opening 112 of an unused developing agent container 110 is connected to the female opening 111 on the side of the developing unit 12, the communication port 116 of the lower male opening 112 can be opened without making a communication port 115 of an upper female opening 111 of the developing agent container 110 open. Also, the stored toner can be replenished by rotating the agitators 129 within the storage space 110*a* while the storage space 110*a* is caused to communicate with the developing unit 12 to start replenishing of the toner. At this time, when an unused developing agent container 110 is connected to a used developing agent container 110, the vibration generated by the rotation of the agitators 129 can also be transferred to the wall member 110*b*, thereby shaking off the toner adhering to the inner face of the wall member without remaining, and then replenishing the toner, together with the stored toner, to the developing unit 12 side.

Accordingly, as for the developing agent container 110, when stored toner is consumed by the developing unit 12 and then there is a replenishing instruction from the apparatus body H side, the shutter members 121 to 123 that close the communication ports 115 and 116 are rotated automatically to open the communication ports when a lower male opening 112 of an unused developing agent container 110 is coupled to an upper female opening 111 of a used developing agent container 110. Thereby, the storage space 110*a* can be caused to communicate with the developing unit 12 side, thereby replenishing the stored toner to the developing unit.

As described above, according to the present embodiment, similarly to the advantageous effects according to the above-mentioned embodiments, the stored toner within the storage space 110*a* can be replenished to the developing unit 12 side simply by coupling developing agent containers 110 together. Accordingly, the replenishment work of toner can be completed by adding and mounting a developing agent container 110 simply and easily without choosing an operator.

Although the above-mentioned embodiment describes as an example the case where the circular female opening 111 and male opening 112 are provided as other forms of the present embodiment, the invention is limited thereto. For example, it goes without saying that the male and female openings may be formed in a rectangular shape and the shutter members may also be configured so as to open and close the communication ports not only by rotational movement, but by sliding in one direction (parallel movement).

Next, a twelfth embodiment of the invention will be described.

Figure 48:
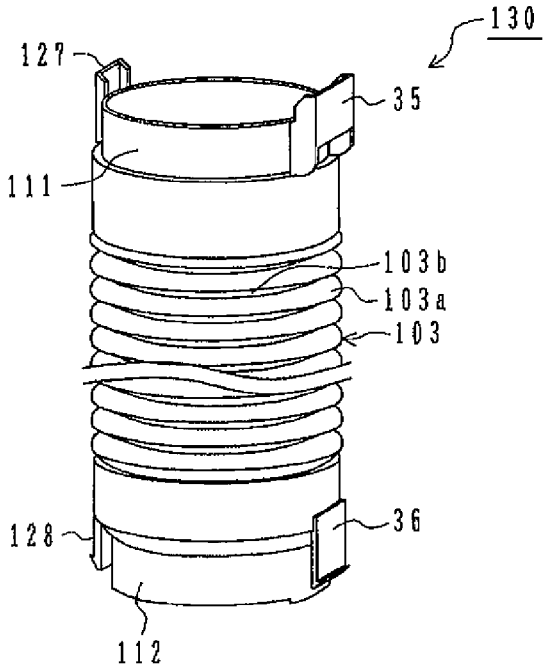
FIG. 48 is a perspective view showing a developing agent container according to a twelfth embodiment of the invention.

An image forming apparatus shown in FIG. 48 is designed so that a plurality of stages of developing agent containers 130 can be set in the replenishing unit 13. In each of the developing agent containers 130, instead of the wall member 110*b* in the above-mentioned eleventh embodiment, the female opening 111 and the male opening 112 are connected to both ends of the cylindrical bellows member 103, thereby defining a large volume of storage space. Meanwhile, when the bellows member is contracted after replenishing of the stored toner, the bellows member is designed so as to maintain the state (contracted state where the lower slope member 103*b* is made to enter the upper slope member 103*a* of the bellows member 103, and then come into facing contact therewith.

Figure 49:
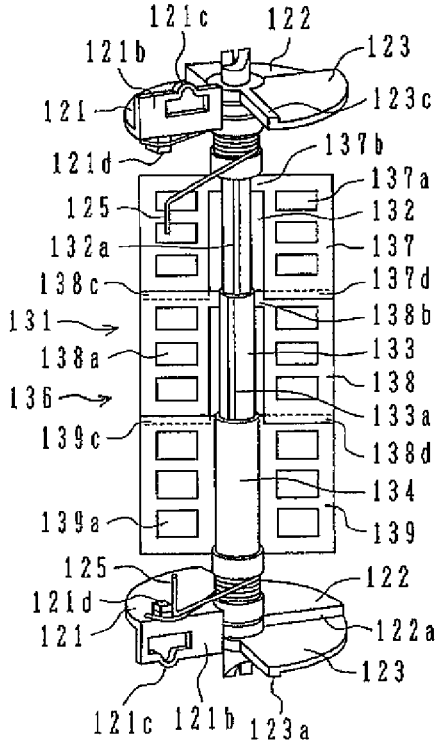
FIG. 49 is a perspective view showing an internal configuration of the developing agent container of FIG. 48.

Further, since the bellows member 103 can be contracted, as shown in FIG. 49, a retractable shaft member 131 that is designed as a so-called fishing rod structure (multiplex cylinder structure) obtained by combining cylindrical members 132 to 134 having different outer diameters, instead of the shaft member 124 in the above-mentioned embodiment, is interposed between the female opening 111 and the male opening 112. Further, instead of the agitators 129, a pair of small-piece agitators 137 to 139 which have opening 137*a* to 139*a* formed therein are connected to the cylindrical members 132 to 134, respectively, of the retractable shaft member in the symmetrical positions of the outer face of the retractable shaft member 131. A retractable agitator 136 that is extended and retracted together with the cylindrical members 132 to 134 is attached to the retractable shaft member by the small-piece agitators 137 to 139.

As for the retractable shaft member 131, the cylindrical member 132 having a smallest diameter is built within the cylindrical member 133 so that it can move relatively, and the cylindrical member 133 is built within the cylindrical member 134 so that it may move relatively. The cylindrical members 132 to 134 are assembled in a state where the inner faces and outer faces thereof are brought into slide contact with each other. Specifically, the cylindrical members 132 and 134 are rotatably coupled to the shielding plates 117 and 118, respectively, so that they may not drop out, and the cylindrical member 133 is brought into facing with and thereby hit and stopped by flange members (not shown) formed at ends of the inner faces or outer faces of the cylinder members 132 and 134 so that they may not drop out of the cylindrical members 132 and 134. Thereby, the cylindrical members can be extended or retracted without being disassembled. Further, the shutter members 122 and 123 are coupled to the cylindrical members 132 and 134 so as to be rotatable relative thereto, and the shutter member 121 is coupled to the cylindrical member 134 so as to be rotatable relative thereto on the side of the male opening 112, while the shutter member 121 is coupled to the cylindrical member 134 so as not to be rotatable relative thereto on the side of the female opening 111. In addition, it goes without saying that the cylindrical member 132 having a smallest diameter may be a cylinder member whose interior is filled with a material.

Further, as for the retractable shaft member 131, the mutually facing inner faces and outer faces between the cylindrical members 132 and 133 and between the cylindrical members 133 and 134 are formed with ribs 132*a* and 133*a* and grooves (not shown) that extend axially and can be combined together. By causing the ribs 132*a* and 133*a* to be housed within the grooves so as to be slidable therein, the cylindrical members 132 to 134 can be assembled so that they may not rotatable relative to each other and may be extendable and retractable.

On the other hand, as for the retractable agitator 136, the small-piece agitators 137 and 138 are connected to the outer peripheral faces of the cylindrical members 132 and 133 only by upper connectors 137*b* and 138*b*. Specifically, the small-piece agitator 137 houses the cylindrical member 133 between itself and the cylindrical member 132, and the small-piece agitator 138 houses the cylindrical member 134 between itself and the cylindrical member 133. Thereby, the small-piece agitators 137 and 138 can be overlapped with the small-piece agitator 139 without hindering extension and retraction of the retractable shaft member 131, thereby reducing the extension area.

Moreover, as for the retractable agitator 136, lower ends 137*d* and 138*d* of the small-piece agitators 137 and 138 extends so as to overlap upper ends 138*c* and 139*c* of the small-piece agitators 138 and 139, respectively, and the lower ends 137*d* and 138*d* opposite to the connectors 137*b* and 138*b* overlap the sides pushed on the upper ends 138*c* and 139*c* of the small-piece agitators 138 and 139 located below when the retractable shaft member 131 rotates. That is, as for the retractable agitator 136, when the shutter member 121, etc. rotates so as to open of the communication ports 115 and 116 of the shielding plates 117 and 118, the whole retractable agitator is rotated within the storage space while the opposite lower ends 137*d* and 138*d* of the small-piece agitators 137 and 138 supported by the cylindrical members 133 and 134 of the retractable shaft member 131 only with the connectors 137*b* and 138*b* are supported by the upper ends 138*c* and 139*c* of the small-piece agitators 138 and 139.

As a result, when the female opening 111 on the side of the developing unit 12 and the lower male opening 112 of the developing agent container 110 are coupled to each other, the shutter member 121 is rotated by the biasing force of the torsion spring 125, and simultaneously, the retractable shaft member 131 (cylindrical members 132 to 134) rotates integrally. Thereby, the retractable agitator 136 (small-piece agitators 137 to 139) supported by the outer peripheral face of each of the cylindrical members 132 to 134 can be rotated integrally so that it may be twirled, and similarly to the above-mentioned embodiment, the stored toner can be agitated and then replenished to the developing unit 12 side. Further, after the female opening 111 and the male opening 112 have been coupled to each other, the retractable shaft member 131 and the retractable agitator 136 can be retracted by compressing a bellows member 103 of a used developing agent container 130 in the retracted direction.

Accordingly, as for the developing agent container 130, when stored toner is consumed by the developing unit 12 and then there is a replenishing instruction from the apparatus body H side, the stored toner can be replenished to the developing unit 12 side by coupling a lower male opening 112 of an unused developing agent container 130 to an upper female opening 111 of a used developing agent container 130. Also, the upper unused developing agent container 130 can be pressed downward to deform and contract the bellows member 103 of the lower used developing agent container 130 so that the lower slope member 103*b* enters the upper slope member 103*a*. As a result, it is possible to realize stacking in a compactly compressed state where the storage space 90*a* is reduced.

As described above, according to the present embodiment, similarly to the advantageous effects according to the above-mentioned embodiments, the stored toner within the storage space can be replenished to the developing unit 12 side by coupling developing agent containers 130 together. Also, developing agent containers can be stacked compactly by contracting the bellows member 103 that defines the storage space. Accordingly, toner can be replenished from a plurality of developing agent containers 130 to the developing unit 12 while the volume of the set space 14 of the replenishing unit 13 is designed compactly.

In the present embodiment, the retractable shaft member 131 having a so-called fishing rod structure that is obtained by combining the cylindrical members 132 to 134 is interposed between the female opening 111 and the male opening 112 so that it can be retracted according to the contraction of the bellows member 103, and the small-piece agitators 137 to 139 are connected to the cylindrical members 132 to 134, respectively, to constitute the retractable agitator 136.

Figure 50:
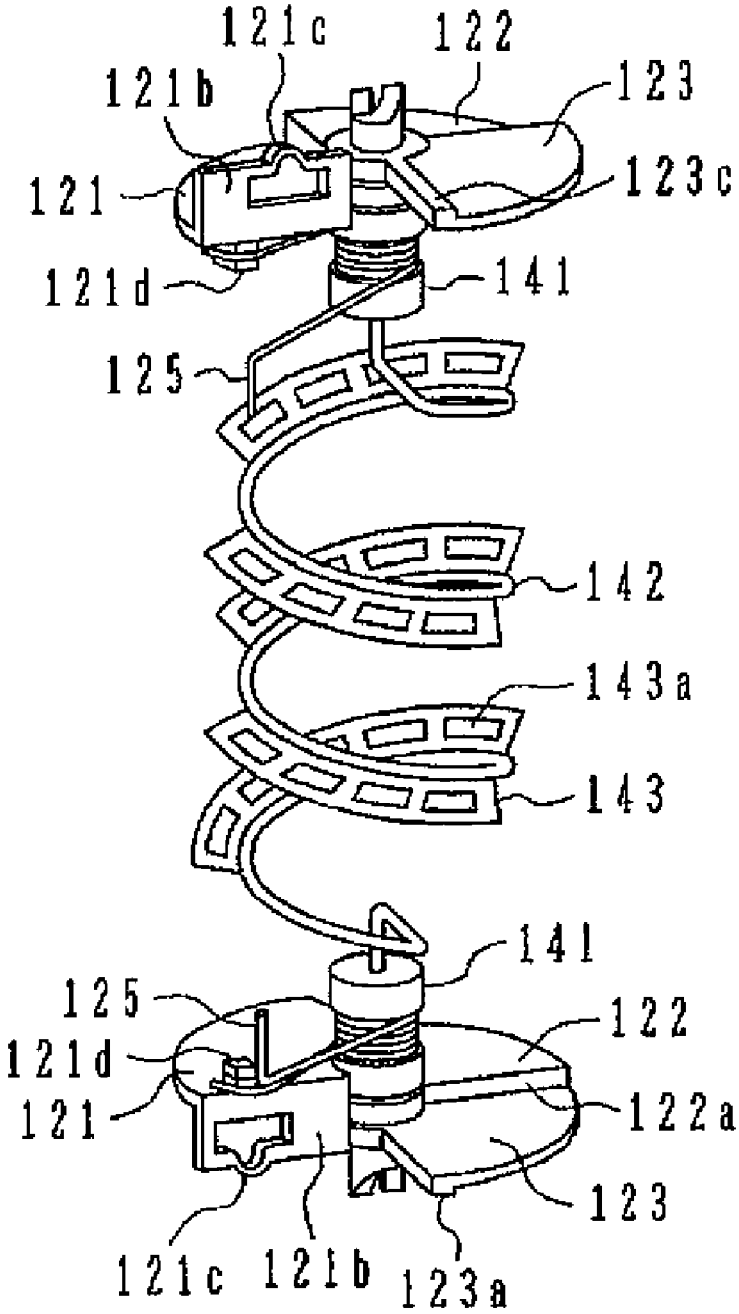
FIG. 50 is a perspective view showing a modified example of the developing agent container of FIG. 48.
Figure 51:
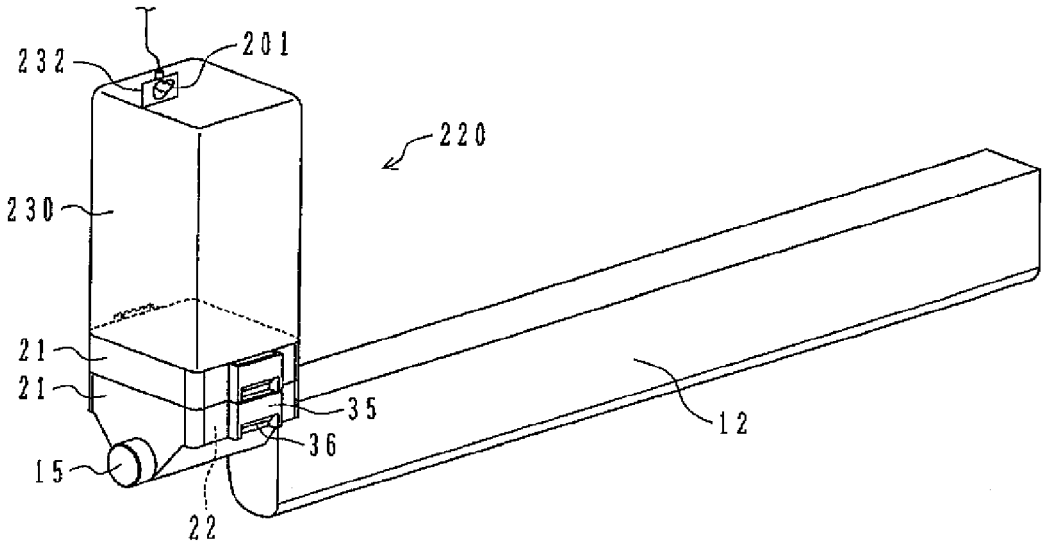
FIG. 51 is a perspective view showing a developing unit and a replenishing unit in an image forming apparatus according to a thirteenth embodiment of the invention.

However, for example, as shown in FIG. 50, shaft members 141 to which the shutter member 121 is connected so as not to be rotatable relatively and to which the shutter members 122 and 123 are coupled so as to be rotatable relatively may be rotatably coupled to the shielding plate 117 and 118, respectively. Also, a retractable spring (extending member) 142 may extend between the shaft members 41 of the shielding plates 117 and 118, and agitators 143 each having a plurality of openings 143*a* formed therein may be connected to a plurality of places of the spring 142 in such a posture that they project outward.

In this case, when the female opening 111 on the side of the developing unit 12 and the lower male opening 112 of the developing agent container 130 are coupled to each other, the shutter member 121 is rotated by the biasing force of the torsion spring 125, and simultaneously, the shaft members 141 (spring member 142) rotates integrally. Thereby, the agitators 136 connected to the spring 142 can also be rotated integrally so that it may be twirled, and similarly to the above-mentioned embodiment, the stored toner can be agitated. Further, in this case, since the spring 142 accumulates the rotation transmitted from the lower shaft member 141, it is possible to avoid forcing an upper shutter member 121 of an unused developing agent container 130 to rotate. Also, when the upper shutter member 121 of the used developing agent container 130 is rotated, the spring 142 releases the accumulated rotation while it rotates together with the shaft member 141, and then vibrates together with the agitators 143. Thereby, the toner adhering to the inner face of the bellows member 103 can be shaken off more effectively without remaining, and can then be supplied to the developing unit 12 side. After the female opening 111 and the male opening 112 have been coupled to each other, the spring 142 can also be retracted together when the bellows member 103 of the used developing agent container 130 is compressed in the retracted direction, thereby stacking developing agent container compactly. In addition, it goes without saying that the spring 142 may be relatively rotatably connected to the shaft member 141 on the side of the female opening 111 similarly to the above-mentioned embodiments.

Next, a thirteenth embodiment of the invention will be described.

As shown in FIGS. 51, 53, 54A, and 54C, in a developing agent container 220 of the present embodiment, a freely deformable wall member 230 manufactured by forming, for example, a film, such as a vinyl resin material (flexible material), in the shape of a bag, is continuously stuck on the outer peripheral face of the peripheral edge 23 of the upper female opening 21. A toner storage space 20*a* is defined within this flexible wall member 230.

This flexible wall member 230 is formed in the shape of, for example, a tube having a rectangular cross section, which is formed by making the peripheral edge 23 of the female opening 21 of the developing agent container 220 extend in the opening direction. The flexible wall member the tube shape when toner is stored within the storage space 20*a* that is defined in the flexible wall member, while and deforms freely as the stored toner is supplied to the developing unit 12 side and is thereby reduced in amount due to a reduction in the lateral dimension. Here, although the flexible wall member 230 is fabricated so that it may be deformed freely as a whole, it goes without saying that the invention is not limited thereto, and for example, a ceiling part of the flexible wall member may be fabricated of a rigid plate material.

Figure 52:
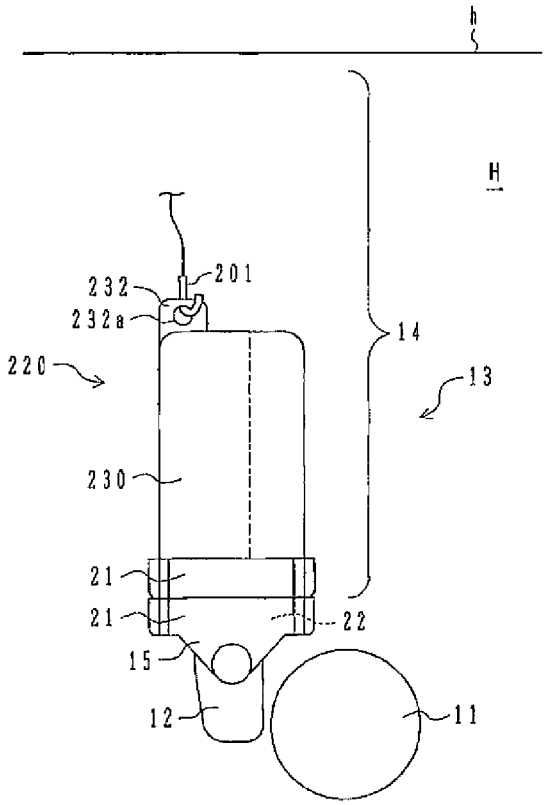
FIG. 52 is a side view showing a coupled state of the developing unit and the replenishing unit.
Figure 53:
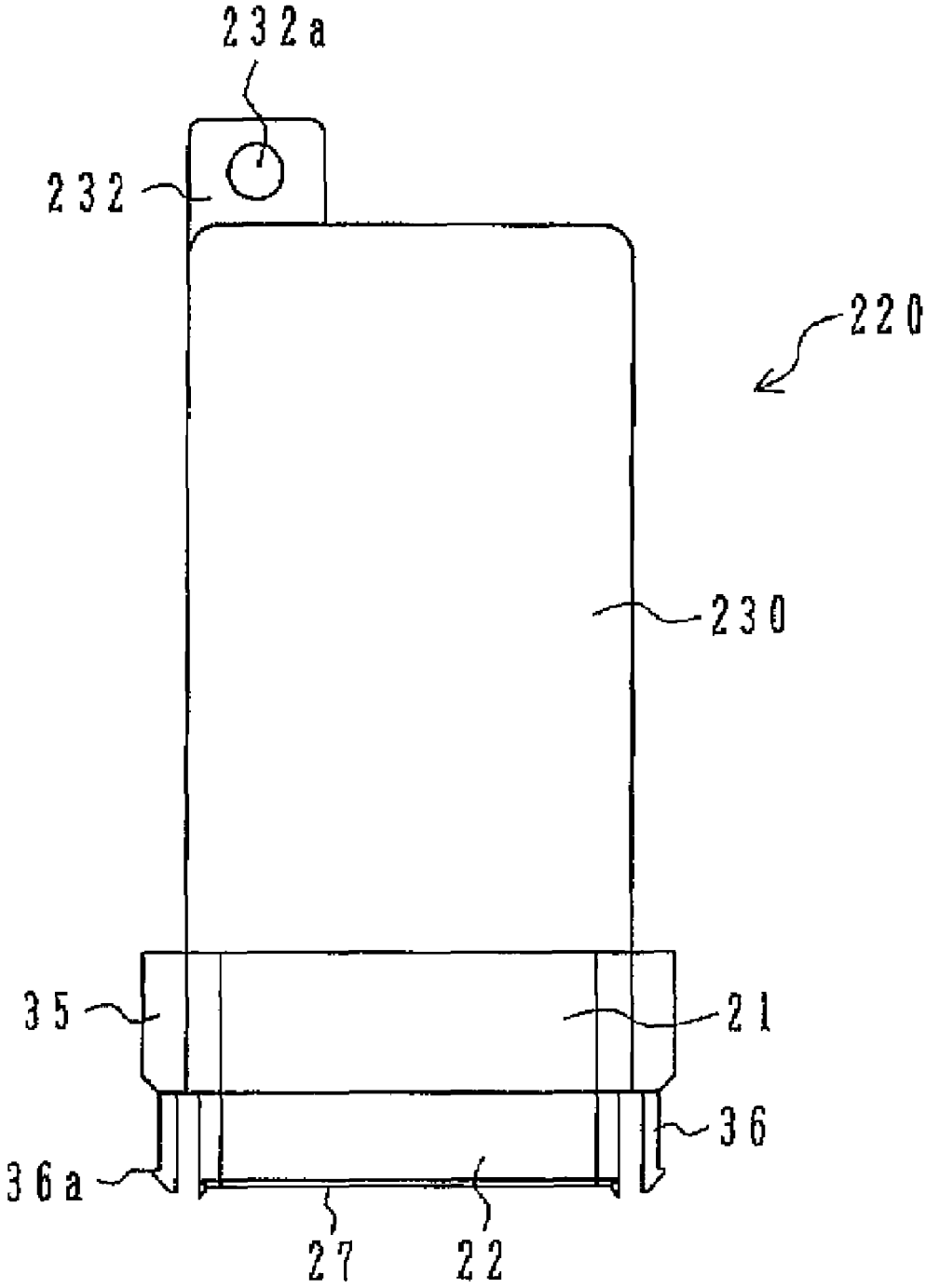
FIG. 53 is a side view showing a developing agent container in the image forming apparatus of FIG. 51.

For this reason, in this developing agent container 220, a hanging part 32 formed with a hole 232*a* that can hook a hook 201 (refer to FIGS. 51 and 52) arranged on the apparatus body H side in an upper portion of the flexible wall member 230.

As a result, as for the developing agent container 220, when the stored toner is caused to drop and flow in through the communication ports 25 and 26 within the peripheral edge 23 and 24 of the female opening 21 and the male opening 22 that are coupled together on the side the developing unit 12, the flexible wall member 230 can be maintained in a hung state so that it may not incline freely, and the stored toner within the storage space 20 can be replenished to the developing unit 12 side without remaining in the storage space.

Figure 54A:
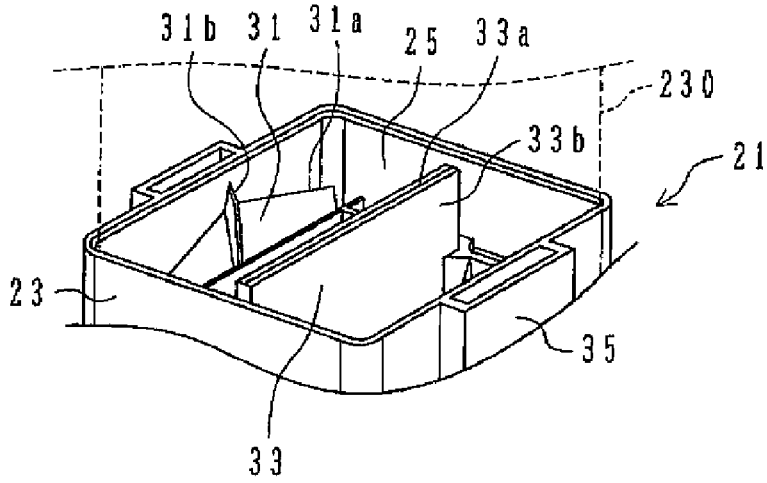
FIG. 54A is a perspective view showing a female opening of the developing agent container in the image forming apparatus of FIG. 51.
Figure 54B:
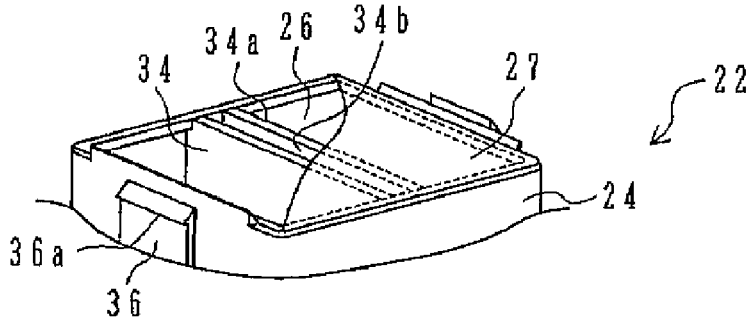
FIG. 54B is a perspective view showing a male opening of the developing agent container of FIG. 54A.
Figure 54C:
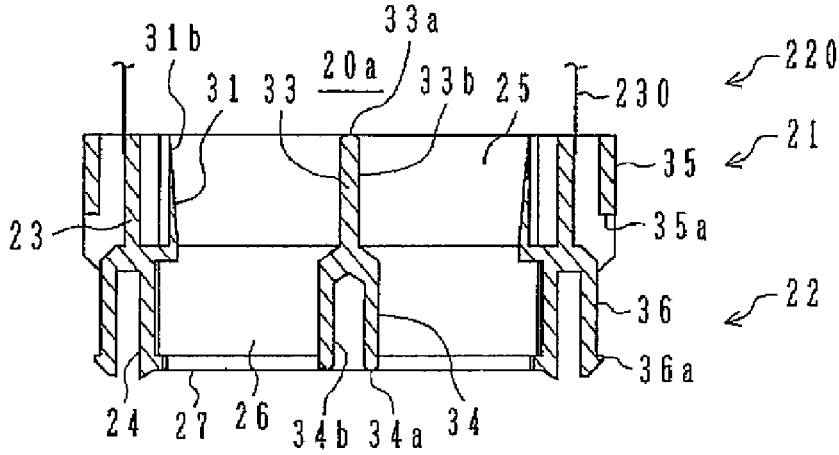
FIG. 54C is a perspective view showing a female opening of the developing agent container of FIG. 54A.

Moreover, as shown in FIG. 54B, the developing agent container 220 is manufactured in an easily handled manner so that an opening end face of the communication port 25 of the male opening 22 that is arranged at the lower end of the container may be closed by the sealing film 27 and thereby the stored toner within the storage space 20*a* may not leak before connection to the developing unit 12 (the conveyer 15 or the developing agent container 220 whose coupling has been completed).

Further, as for the developing agent container 220, when a male opening 22 of a lower end of an unused developing agent container 220 is coupled after the stored toner within the storage space 20*a* has been replenished to the developing unit 12 side, the male opening 22 of the lower end of the unused developing agent container 220 will be coupled to the female opening 21 in a state where the communication port 25 is closed by removing the hanging part 32 from the hook 201 on the side of the apparatus body H, and pushing down the flexible wall member 230 stuck on the peripheral edge 23 of the upper female opening 21.

For this reason, as for a female opening 21 and a male opening 22 of separate developing agent containers 220, various members that, when the peripheral edges 23 and 24 of the openings are coupled together, cut the flexible wall member 230 that closes the communication port 25 or the sealing film 27 that closes the communication port 26, and perform the processing that prevents the flexible wall member 230 or the sealing film 27 after the cutting from hindering flow of the toner in the communication ports 25 and 26 are arranged in the female and male openings.

Specifically, a pair of cutters 31 are erected from the female opening 21 in the vicinity of inside opposite faces (inner faces) of the substantially rectangular peripheral edge 23, and the cutters 31 are molded integrally with the female opening so that they may become parallel to each other in adjacent positions that are spaced from the inner faces by the thickness of the peripheral edge 24 of the male opening 22. Each of the cutters 31 is formed in the shape of a triangular plate whose center becomes an apex. Specifically, the oblique sides of the cutter are formed as cutting blades 31*a*, and an upwardly projecting needle 31*b* is formed in the apex. Further, this cutter 31 is molded integrally with the female opening 21 so that a tip end of the needle 31*b* may be located in a position that retreats further than an opening end of the peripheral edge 23 on which the sealing film 27 is stuck.

As a result, when the peripheral edges 23 and 24 of the female opening 21 and the male opening 22 and connected to each other by fitting, the cutters 31 can cut the flexible wall member 230 and the sealing film 27 that closes the opening end faces of the communication ports 25 and 26. In this case, when the female opening 21 and the male opening 22 begin to fit to each other so as to be put in a closed state while the opening ends of the peripheral edges 23 and 24 are caused to face each other to stretch the flexible wall member 230 and the sealing film 27, the needles 31*b* of the cutters 31 can be pierced into two places adjacent to the vicinity of the centers of the inner faces of the peripheral edges 23 and 24 to start cutting, and further when the degree of fitting of the peripheral edges 23 and 24 increases, the cutting blades 31*a* continue the cutting, thereby further extending the cutting range. That is, each of the cutters 31 is arranged only at the peripheral edge 23 of the female opening 21, the needle 31*b* constitutes a cutting starting part, and the cutting blades 31*a* constitute the cutting continuation part. In addition, in the present embodiment, a pair of cutters 31 are arranged so as to cut two places of the flexible wall member 230 or the sealing film 27. However, it goes without saying that the invention is not limited thereto, and one cutter or three or more cutters may be arranged, and each cutter 31 may have a plurality of needles 31*b* so as to start cutting from two or more places. Further, it may be designed that the cutters 31 are not only arranged at the peripheral edge 23 of the female opening 21 but also arranged at the peripheral edge 24 of the male opening 22 so that the flexible wall member 230 and the sealing film 27 may be cut from both sides. In this case, the relative positional relationship between the peripheral edges 23 and 24 that combine the female opening 21 and the male opening 22 are limited so that the cutters may not interfere with each other. Therefore, if cutting only is performed, arranging the cutters only at any one of the male and female openings can facilitate design (although the present embodiment may be limited because an insertion member 33 or sheathing member 34 as described below are also arranged).

Further, the female opening 21 is formed integrally with an insertion member 33 that is formed in the shape of an I-shaped cross section in the center between the cutters 31 within the peripheral edge 23. This insertion member 33 extends in a vertical posture parallel to the cutters 31, and thereby is formed so that the flexible wall member 230 that is stretched at the opening end of the peripheral edge 23 to close the communication port 25 may touch a tip end 33*a*. On the other hand, the male opening 22 is formed integrally with a sheathing member 34 that is formed in the shape of a U-shaped cross section in the center between the opposite faces within the peripheral edge 24. This sheathing member 34 extends in a vertical posture that its upper side (outer side) is open so as to sheathe the insertion member 33 on the side of the female opening 21, and thereby is formed so that the sealing film 27 that is stretched at the opening end of the peripheral edge 24 to close the communication port 26 may touch a tip end 34*a*. In addition, although a gap is formed between the insertion member 33 on the side of the female opening 21 and the inner faces of the peripheral edge 23 so that the peripheral edge 24 on the side of the male opening 22 may be inserted between the insertion member and the peripheral edges 23, the sheathing member 34 on the side of the male opening 22 is provided continuously across between the inner faces of the peripheral edge 24 because it can be inserted into the gap.

Figure 55:
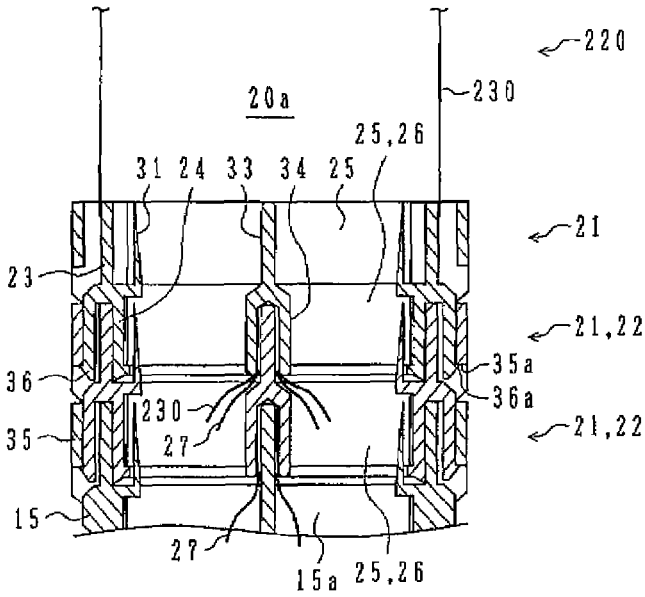
FIG. 55 is a section view showing a coupled state of the developing agent containers of FIG. 54A.

As a result, as shown in FIG. 55, in the conveyer 15 of the developing unit 12 that is opened to the set space 14 of the replenishing unit 13, when the peripheral edge 24 of the male opening 22 of the developing agent container 220 is fitted into the peripheral edge 23 of the female opening 21 arranged at the upper portion of the conveyer so that they may be coupled to each other while a closed state is secured, the insertion member 33 on the side of the female opening 21 enters the sheathing member 34 on the side of the male opening 22 concurrently when the sealing film 27 that closes the communication port 26 is cut and communicated. At this time, the sealing film 27 is sandwiched between the tip ends 33*a* and 34*a* of the insertion member 33 and sheathing member 34, and subsequently, enters the sheathing member 34 such that it is wrapped around the insertion member 33. Thereby, the sealing film is towed in the direction of the center between the cutters 31, so that the cutting range can be extended along the inner faces of the peripheral edge 24, and the sealing film is wrapped up gradually while being forcibly deformed in a state where it is sandwiched between side faces 33*b* and 34*b* of the insertion member 33 and sheathing member 34. That is, the insertion member 33 and the sheathing member 34 constitute a forcing member and a traction member. The cutting range of the sealing film 27 is extended not only in the parts to be cut by the cutters 31 but in a direction that is directed to the tip end 34*a* of the sheathing member 34 from the cutters 31 (direction that intersects the cutting by the cutters 31). Thereby, the sealing film is sandwiched between the side faces 33*b* and 34*b* of the insertion member 33 and the sheathing member 34, and is forcibly folded into two parts. In addition, although the sealing film 27 is folded into two in the present embodiment, the invention is not limited thereto. For example, one side of a cut film may be pressed down and may be bent forcibly downward in opening direction (along the inner face of the peripheral edge).

Accordingly, the stored toner within the developing agent container 220 can be caused to drop (flow) and supplied into the conveyer 15 on the side of the developing unit 12 without being hindered by the sealing film 27, via the communication ports 25 and 26 within the peripheral edges 23 and 24 of the female opening 21 and the male opening 22 that are coupled to each other so that there may be no leakage. Here, within the communication ports 25 and 26, the insertion member 33 is inserted from its tip end 33*a* into the tip end 34*a* of the sheathing member 34 in a downwardly opened posture. Thus, the falling toner is not accumulated between the sealing films 27 or within the sheathing member 34.

Similarly, in the developing agent container 220, a peripheral edge 24 of a male opening 22 of a lower end of an unused developing agent container 220 is fitted into the peripheral edge 23 of the female opening 21 arranged at the upper portion of the developing agent container so that they may be coupled to each other while a closed state is secured. At this time, the flexible wall member 230 and the sealing film 27 that close the communication ports 25 and 26 is sandwiched between the insertion member 33 and the sheathing member 34 while being cut by the cutters 31 simultaneously with the coupling, and thereby is compactly folded into two. That is, the replenishing unit 13 is designed so that toner can be replenished by repeating the coupling of upper openings and lower openings 22 of the same members that are arranged at the lower portion of the developing agent container 220 and are formed integrally with each other, thereby adding the number of the developing agent containers 20 that can be set within the set space 14.

Moreover, the female opening 21 and the male opening 22 include locking mechanisms (engaging members) that can be locked so that they may engage with each other at the outside of the peripheral edges 23 and 24 so as to maintain a coupled state. Specifically, female locking receptacles 35 are molded integrally with the female opening 21, and male locking pawls 36 are molded integrally with the male opening 22. Each female locking receptacle 35 of the female opening 21 extends laterally so as to face an outer face (outer face parallel to the insertion member 33) of the peripheral edge 23 adjacent to each cutter 31, and is opened downward. Each male locking pawl 36 of the male opening 22 is erected so as to face an outer face (outer face parallel to the sheathing member 34) of the peripheral edge 24 corresponding to the female locking receptacle 35. An outwardly projecting claw part 36*a* is formed at the tip end of the male locking pawl.

As a result, when the peripheral edges 23 and 24 of the female opening 21 and the male opening 22 are fitted to each other so that they may be coupled to each other while a closed state is secured, the male locking pawl 36 enters the female locking receptacle 35, and the claw part 36*a* of the tip end of the claw sticks out. Thereby, since the claw part 36*a* is brought into slide contact with the inner face of the female locking receptacle 35, is elastically deformed, and then is elastically restored so as to face a lower end 35*a* of the receptacle, the male locking pawl 36 is hit and stopped and thereby engaged and locked so that it cannot be pulled out even if it is intended to move in a retreating direction. That is, the female opening 21 and the male opening 22 are brought close to each other so that they may be combined together without peeling off the flexible wall member 230 or the sealing film 27, and are connected to each other by a simple one action (single operation) of inserting the peripheral edge 24 into the peripheral edge 23. Thereby, the communication ports 25 and 26 within the peripheral edge 23 and 24 are communicated with and joined to each other in a closed state with no leakage of toner, and are locked so that the communicative joined state may be maintained. As a result, the supplying or replenishment work of toner can be completed easily.

Accordingly, when the male opening 22 of the lower end of the developing agent container 220 is coupled to the upper female opening 21 of the conveyer 15 of the developing unit 12, and then the stored toner within the developing agent container 220 is consumed by repetition of a development process (toner development of electrostatic latent images on the photoconductive drum 11) by the developing unit 12, and there is an instruction of replenishment of toner from the apparatus body H side, the volume of only the female opening 21 located at the upper portion is obtained by pushing down the flexible wall member 230 of the used developing agent container 220 (the male opening 22 is fitted into a separate female opening 21 located at the lower side), and the male opening 22 of the lower end of the same unused developing agent container 220 is simply coupled to the female opening 21 of the upper portion of the used developing agent container 220, without removing the already mounted developing agent container 220 (without performing the replacing work). Now, the stored toner within the unused developing agent container 220 can be caused to flow into and be replenished to the conveyer 15 of the developing unit 12 (communication space 15*a*).

Also, when developing agent containers 220 are coupled together by stacking the number of female openings 21 that can be set within the set space 14 of the replenishing unit 13 on each other, and then there is again an instruction of replenishment of toner from the apparatus body H side to the developing unit 12 side, it is determined as the serviceability limit of the developing unit 12 without particularly managing the lifetime of the developing unit. Then, the developing unit 12 and the replenishing unit 13 are removed together from the apparatus body H while a plurality of stages of developing agent containers 220 (female openings 21 or male openings 22) are joined and connected to each other, and then an unused developing unit 12, etc. is newly mounted. That is, the set space 14 of the replenishing unit 13 is set so that the volume of developing agent containers 220 according to the serviceability limit of the developing unit 12 can be coupled together.

As described above, the present embodiment does not need to perform the replacing work of removing a used developing agent container 220. Therefore, an unused developing agent container 220 can be coupled to the used developing agent container so that toner can be replenished, by the operation of one action of inserting and fitting the male opening 22 into the female opening 21 compactly stacked on the side of the developing unit 12, without leaking out and scattering toner. Accordingly, the replenishment work of toner can be completed by simply and easily coupling a developing agent container 220 without securing a large volume of set space 14 and without choosing an operator.

Next, a fourteenth embodiment of the invention will be described.

Figure 56:
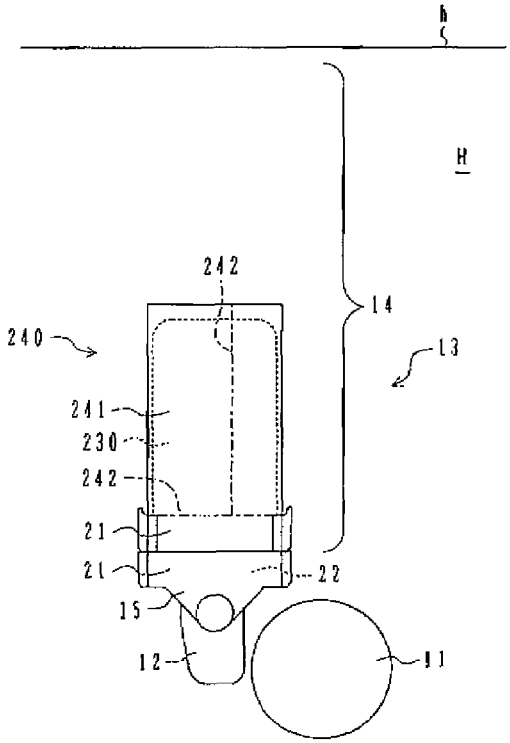
FIG. 56 is a perspective view showing a developing unit and a replenishing unit in an image forming apparatus according to a fourteenth embodiment of the invention.

An image forming apparatus shown in FIG. 56 is designed so that a plurality of stages of developing agent containers 240 can be set in the replenishing unit 13. In each of the developing agent containers 240, a flexible wall member 230 is stuck on the outer peripheral face of the peripheral edge 23 of the female opening 21, and an outer cylinder (sheathing member) 241 formed in a similar shape so as to cover the outside of the flexible wall member 230 is attached to the outer peripheral face.

The outer cylinder 241 is fabricated of a resin material harder than the flexible wall member 230, and thereby supports itself. Also, the outer cylinder is designed so as to be able to support the flexible wall member 230 to be built therein, and is formed in the shape of a cylinder with a rectangular cross section, in which the peripheral edge 23 of the female opening 21 extend in the opening direction.

Further, a portion of the outer cylinder 241 in the vicinity of an upper portion of the flexible wall member 230 to be built therein is stuck peelably, and thus limits that the flexible wall member 230 after supply of the stored toner descends freely.

Also, so-called perforations 242 as intermittent minute lines that can be cut off by hand are cut into the outer cylinder 241 in the longitudinal direction thereof, and also put into along an upper edge of the peripheral edge 23 of the female opening 21. By cutting off the perforations 242, the outer cylinder 241 can be removed from the female opening 21 or the flexible wall member 230.

As a result, as for the developing agent container 240, when the stored toner is caused to drop and flow in through the communication ports 25 and 26 within the peripheral edge 23 and 24 of the female opening 21 and the male opening 22 that are coupled together on the side the developing unit 12, the flexible wall member 230 can be maintained in such a posture that it supports itself by the outer cylinder 241 so that it may not incline freely. Meanwhile, after the stored toner within the storage space 20*a* has been supplied to the developing unit 12 side without remaining the flexible wall member can be put in a posture that it can be cut by the cutters 31, by cutting off and removing the outer cylinder 241 by the perforations 242, and then pushing down the flexible wall member so that the communication port 25 within the peripheral edge 23 of the female opening 21 may be closed.

As described above, according to the present embodiment, in addition to the advantageous effects according to the above-mentioned embodiments, the need for arranging the hook 201, etc. in the apparatus body H side can be eliminated, and the hooking work on the hook 201 can also be omitted. Accordingly, toner can be supplied to the developing unit 12 side by easily setting the developing agent container 240 within the set space 14 of the replenishing unit 13.

Although the present embodiment describes the case where the outer cylinder 241 is stuck on the outer face of the peripheral edge 23 of the female opening 21 as other forms of the present embodiment, the invention is limited thereto. For example, a mere cylindrical sheathing member that can cover the outside of the female opening 21 or male opening 22 may be fabricated so that the developing agent container 240 can be additionally set in the set space 14 while the female opening 21 is held from the outer face of the sheathing member. In this case, the sheathing member can be pulled out without being provided with the perforations.

Next, a fifteenth embodiment of the invention will be described.

Figure 57A:
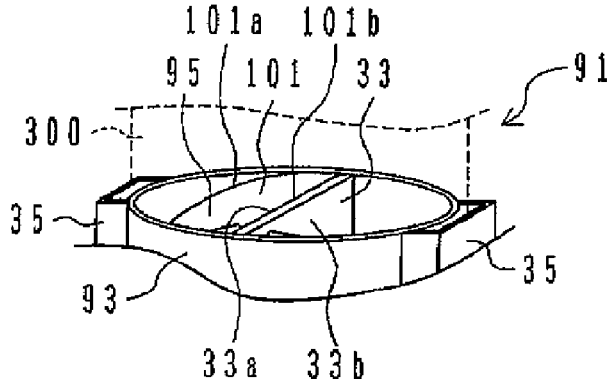
FIG. 57A is a perspective view showing a female opening of the developing agent container in the image forming apparatus of FIG. 56.
Figure 57B:
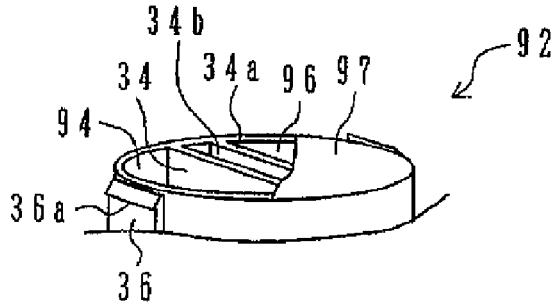
FIG. 57B is a perspective view showing a male opening of the developing agent container of FIG. 57A.
Figure 57C:
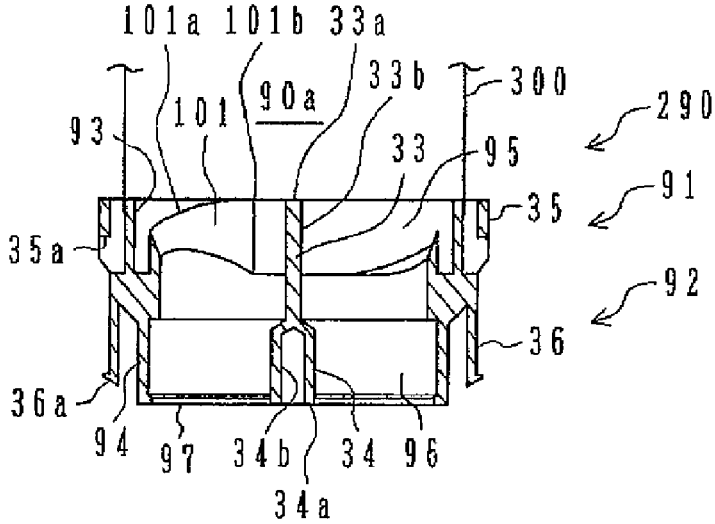
FIG. 57C is a perspective view showing a female opening of the developing agent container of FIG. 57A.

An image forming apparatus shown in FIGS. 57A to 57C is designed so that a plurality of developing agent containers 290 can be set in the replenishing unit 13 by continuously providing a female opening 91 and a male opening 92, respectively, instead of the female opening 21 and the male opening 22 in the above-mentioned embodiments.

Figure 58:
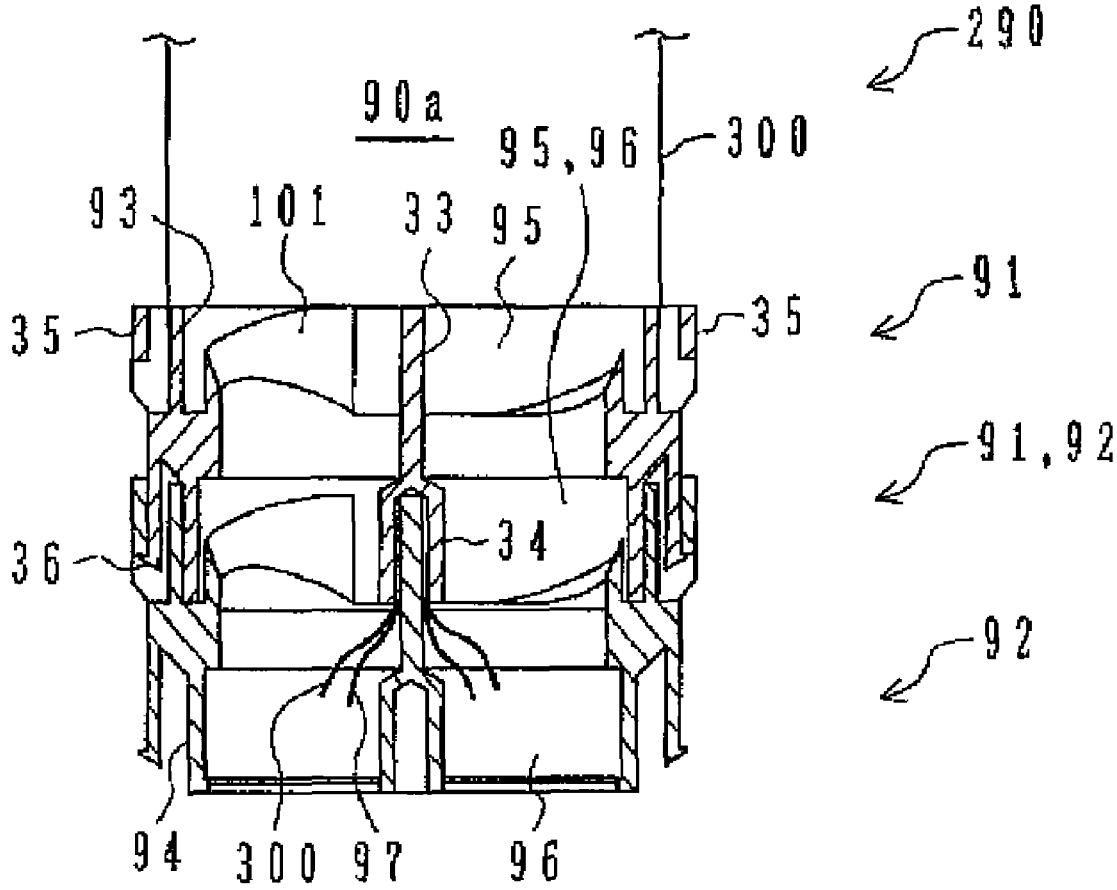
FIG. 58 is a section view showing a coupled state of the developing agent containers of FIG. 57A.

As for the female opening 91, as shown in FIG. 57A, a communication port 95 that allows flow of toner is opened in a peripheral edge 93 formed in a cylindrical shape. In the male opening 92, as shown in FIG. 57B, a communication port 96 is opened in a peripheral edge 94 formed in a cylindrical shape. By setting the inner diameter of the peripheral edge 93 of the female opening 91 to almost the same dimension as the outer diameter of the peripheral edge 94 of the male opening 92, for example, as shown in FIG. 58, the peripheral edge 94 of the male opening 92 located at the lower end can be fitted into the peripheral edge 93 of the female opening 91 located at the upper side in a state where they come into face contact with each other while they are brought into slide contact with each other. That is, similarly to the female opening 21 and the male opening 22 of the above-mentioned embodiment, the female opening 91 and the male opening 92 are designed as a pair of male and female structures that can be coupled together so that the stored toner can be caused to flow in or flow out (flow) by allowing the toner to be dropped without leakage through the common communication ports 95 and 96.

As for the male opening 92, a sealing film 97 is stuck on the opening end face of the peripheral edge 94 so as to close the communication port 26. Further, as for the female opening 91, as shown in FIG. 57C, a cylindrical flexible wall member 300 that defines a toner storage space 90*a* is stuck on the outer peripheral face of the peripheral edge 94 in a continuous manner therewith. As a result, after replenishing of the stored toner within the storage space 90*a*, the communication port 95 within the peripheral edge 94 is closed by the flexible wall member 300 by removing a hanging member (not shown) hung on a hook (hanger) 201 on the side of the apparatus body H.

For this reason, as for the female opening 92 and the male opening 22, various members that, when the peripheral edges 93 and 94 of the openings are coupled together, cut the flexible wall member 300 that closes the communication port 95 or the sealing film 97 that closes the communication port 96, and perform the processing that prevents the flexible wall member 300 or the sealing film 97 after the cutting from hindering flow of the toner in the communication ports 95 and 96 are arranged in the female and male openings.

Specifically, the insertion member 33 is integrally molded with the inner face of the peripheral edge 93 in the female opening 91 so as to transverse the communication port 95. On the other hand, the sheathing member 34 is integrally molded with the inner face of the peripheral edge 94 in the male opening 92 so as to transverse the communication port 96. The outside (opened side of the communication port 96) of the sheathing member 34 is opened so that the insertion member 33 of the female opening 91 can be fitted therein.

Further, a pair of cutters 101 that extend toward side faces 33*b* of the insertion member 33 from the vicinity of the left end along the inner peripheral face of the peripheral edge 93 to the vicinity of the opposite right end are integrally formed in the female opening 91. Each of the cutters 101 is erected so that it may take such a posture that a cutting blade 101*a* formed in the shape of a thin blade so that the sealing film 97 can be cut projects the outside of the opening direction of the communication port 95 of the female opening 91. The left end of the cutting blade 101*a* is formed at an acute angle to form a blade edge 101*a* that starts the cutting of the sealing film 97. That is, the cutter 101 is formed in the symmetry of revolution so that the sealing film 97 may be cut in the same circumferential direction along the vicinity of the inner peripheral face of the peripheral edge 93 of the female opening 91.

As a result, when the peripheral edges 93 and 94 of the female opening 91 and the male opening 92 are fitted and connected to each other, and when they begins to fit to each other so as to be put in a closed state while the opening ends of the peripheral edges 93 and 94 are caused to face each other to stretch the flexible wall member 300 or the sealing film 97, blade tip ends 101*b* of the cutters 101 will pierce two places in the vicinity of the radial inner faces in the peripheral edges 93 and 94 to start cutting of the flexible wall member 300 and the sealing film 97 that closes the opening end faces of the communication ports 95 and 96 in the peripheral edges 93 and 94. Further, when the degree of fitting of the peripheral edges 93 and 94 increases, the cutting blades 101*a* continue the cutting along the inner faces of the peripheral edges 93 and 94, thereby extending the cutting range. Also, as the flexible wall member 300 and the sealing film 97 are sandwiched and towed between the insertion member 33 and the sheathing member 34 within the peripheral edges 93 and 94 of the female opening 91 and the male opening 92 concurrently with the cutting by the cutters 101, they are folded up compactly, thereby opening the communication ports 95 and 96 within the peripheral edges 93 and 94.

Further, as for the female opening 91 and the male opening 92, similarly to the above-mentioned embodiment, the female locking receptacles 35 and the male locking pawls 36 are integrally formed at the outside of the peripheral edges 93 and 94. When the female opening 91 and the male opening 92 are coupled together, the male locking pawls 36 enter the corresponding female locking receptacles 35 and lockably engage them so that they may not pulled out of the locking receptacles, thereby maintaining the coupled state.

Accordingly, in the developing agent container 290, when stored toner is consumed by the developing unit 12 and then there is a replenishing instruction from the apparatus body H side, as shown in FIG. 58, a male opening 92 of a lower end of the same unused developing agent container 290 can similarly be coupled to the upper female opening 91 by pushing down the flexible wall member 300 of the used developing agent container 290 without removing the already mounted developing agent container 290 (without performing the replacing work). This alone enables the stored toner within the unused developing agent container 290 to drop and flow into the conveyer 15 (communication space 15*a*) of the developing unit 12.

As described above, similarly to the above-mentioned embodiments, the present embodiment does not need to perform the replacing work of removing a used developing agent container 290. Therefore, an unused developing agent container 290 can be coupled to the used developing agent container so that toner can be replenished, by the operation of one action of inserting and fitting the male opening 92 into the female opening 91 compactly stacked on the side of the developing unit 12, without leaking out and scattering toner. Accordingly, the replenishment work of toner can be completed by simply and easily adding and mounting a developing agent container 290 without securing a large volume of set space 14 and without choosing an operator.

Although the embodiments of the invention have been described up to now, it goes without saying that the invention is not limited to the above-mentioned embodiments, but may be embodied in various different forms within the scope of the technical idea of the invention. Although the case where only a so-called toner as a developing agent is set is described as an example in the above-mentioned embodiments, it goes without saying that the invention can be similarly applied to, for example, an image forming apparatus equipped with a developing device adapted to use a two-component developing agent containing a carrier or the like in addition to toner that develops an electrostatic latent image.

The disclosure of Japanese Patent Application Nos. 2005-361446 filed Dec. 15, 2006; 2005-361447 filed Dec. 15, 2006, 2005-361448 filed Dec. 15, 2006; 2005-361449 filed Dec. 15, 2006; and 2005-361450 filed Dec. 15, 2006, including specifications, drawings and claims are incorporated herein by reference in their entirety.

What is claimed is:

1. A container, adapted to be coupled with a first another container, the container comprising:

a first wall member, defining a first storage space adapted to store developing agent for forming an image on a recording medium;

a first coupler, adapted to be coupled with a second coupler provided with the first another container; and a first communicator, operable to communicate the first storage space with a second storage space provided with the first another container by way of the first coupler and the second coupler, when the container is coupled with the first another container, wherein:

the container is adapted to be coupled with a second another container, and further comprises:

a third coupler, adapted to be coupled with a fourth coupler provided with the second another container; and a second communicator, operable to communicate the first storage space with a third storage space provided with the second another container by way of the third coupler and the fourth coupler, when the container is coupled with the second another container.

2. The container as set forth in claim 1, further comprising:

a first retainer, provided on the first coupler and adapted to engage with a second retainer provided on the second coupler when the first coupler is coupled with the second coupler, thereby retaining the coupled state of the first coupler and the second coupler.

3. The container as set forth in claim 2 wherein:

at least one of a size and a shape of the first retainer is uniquely indicative of a type of the developing agent stored in the first storage space.

4. The container as set forth in claim 1, wherein:

the first wall member is deformable so that a volume of the first storage space is variable; and the first coupler and the third coupler are engageable with each other when the volume of the first storage space is reduced.

5. The container as set forth in claim 1, further comprising:

a sealing member, provided on the first wall member and adapted to seal a gap formed between the first wall member and a second wall member defining the second storage space when the first coupler is coupled with the second coupler.

6. The container as set forth in claim 1, wherein:

the first coupler comprises a vibration generator operable to generate vibration when the first coupler is coupled with the second coupler.

7. The container as set forth in claim 1, wherein:

the first communicator includes:

a first film member, sealing the first coupler; and a first cutter operable to cut the first film member when the first coupled is coupled with the second coupler; and the second communicator includes a second film member, sealing the third coupler and adapted to be cut by a second cutter provided with the fourth coupler when the third coupler is coupled with the fourth coupler.

8. The container as set forth in claim 7, wherein:

the first communicator includes a first traction member adapted to engage with a second traction member provided with the second coupler when the first coupler is coupled with the second coupler, thereby pulling the first film cut by the first cutter in a direction away from the first cutter; and the second communicator includes a third traction member adapted to engage with a fourth traction member provided with the fourth coupler when the third coupler is coupled with the fourth coupler, thereby pulling the second film cut by the second cutter in a direction away from the second cutter.

9. The container as set forth in claim 7, wherein:

the first cutter includes:

a needle portion adapted to first come in contact with the first film member; and a blade portion extending along an inner periphery of the first coupler, and adapted to come in contact with the first film member subsequent to the needle portion.

10. A container , adapted to be coupled with a first another container, the container comprising:

a first wall member, defining a first storage space adapted to store developing agent for forming an image on a recording medium;

a first coupler, adapted to be coupled with a second coupler provided with the first another container; and a first communicator, operable to communicate the first storage space with a second storage space provided with the first another container by way of the first coupler and the second coupler, when the container is coupled with the first another container, wherein:

the first wall member is deformable so that a volume of the first storage space is variable; and the first communicator includes a cutter operable to cut a part of the first wall member when the first coupler is coupled with the second coupler.

11. The container as set forth in claim 10, wherein:

the first wall member is flexible.

12. The container as set forth in claim 11, further comprising:

a first hanging member, provided on the first wall member and adapted to engage with a second hanging member provided with an image forming apparatus, thereby hanging up the first wall member.

13. The container as set forth in claim 11, further comprising:

a casing member, surrounding the first wall member and having a larger stiffness than the first wall member.

14. The container as set forth in claim 13, wherein:

the casing member is removably coupled with the first coupler.

15. The container as set forth in claim 10, wherein:

the first wall member includes a bellows section.

16. The container as set forth in claim 10, wherein:

the first communicator includes a first traction member adapted to engage with a second traction member provided with the second coupler when the first coupler is coupled with the second coupler, thereby pulling the part of the wall member in a direction away from the cutter.

17. The container as set forth in claim 10, wherein:

the cutter includes:

a needle portion adapted to first come in contact with the part of the first wall member; and a blade portion extending along an inner periphery of the first coupler, and adapted to come in contact with the part of the first wall member subsequent to the needle portion.

18. A container as, adapted to be coupled with a first another container, the container comprising:

a first wall member, defining a first storage space adapted to store developing agent for forming an image on a recording medium;

a first coupler, adapted to be coupled with a second coupler provided with the first another container; and a first communicator, operable to communicate the first storage space with a second storage space provided with the first another container by way of the first coupler and the second coupler, when the container is coupled with the first another container, wherein:

the container is adapted to be coupled with an image forming apparatus:

the first coupler is adapted to be coupled with a third coupler provided with the image forming apparatus;

the first communicator is operable to communicate the first storage with the image forming apparatus to supply the developing agent from the container to the image forming apparatus; and the first communicator includes a film member, sealing the first coupler and adapted to be cut by a cutter provided with the third coupler when the first coupler is coupled with the third coupler.

19. The container as set forth in claim 18, wherein:

the first communicator includes a first traction member adapted to engage with a second traction member provided with the third coupler when the first coupler is coupled with the third coupler, thereby pulling the film member in a direction away from the cutter.

* * * * *